US012133596B2

(12) United States Patent
Catan et al.

(10) Patent No.: US 12,133,596 B2
(45) Date of Patent: Nov. 5, 2024

(54) ERGONOMIC CHAIRS SUPPORTING ASYMMETRIC LEG CONFIGURATIONS

(71) Applicants: Carolyn G. Catan, Bethesda, MD (US); Helen L. Catan, Bethesda, MD (US); Ruth Catan, Bethesda, MD (US)

(72) Inventors: Mark A. Catan, Bethesda, MD (US); Carolyn G. Catan, Bethesda, MD (US); Helen L. Catan, Bethesda, MD (US)

( * ) Notice: Subject to any disclaimer, the term of this patent is extended or adjusted under 35 U.S.C. 154(b) by 0 days.

(21) Appl. No.: 18/527,232

(22) Filed: Dec. 1, 2023

(65) Prior Publication Data

US 2024/0164528 A1 May 23, 2024

Related U.S. Application Data

(63) Continuation of application No. 17/764,889, filed as application No. PCT/US2021/048357 on Aug. 31, 2021, now Pat. No. 11,844,434.

(51) Int. Cl.

| | |
|---|---|
| ***A47C 7/50*** | (2006.01) |
| ***A47C 1/024*** | (2006.01) |
| ***A47C 3/14*** | (2006.01) |

(52) U.S. Cl.

CPC ..... *A47C 3/14* (2013.01); *A47C 1/024* (2013.01); *A47C 7/503* (2013.01)

(58) Field of Classification Search

CPC ..... A47C 7/503

See application file for complete search history.

(56) References Cited

U.S. PATENT DOCUMENTS

| | | | |
|---|---|---|---|
| 242,573 | A | 6/1881 | Wilson |
| 246,652 | A | 9/1881 | Bailey |

(Continued)

FOREIGN PATENT DOCUMENTS

| | | | |
|---|---|---|---|
| DE | 102014003869 | B3 | 9/2015 |
| GB | 2482136 | A | 1/2012 |

(Continued)

OTHER PUBLICATIONS

5100 Stance Angle Sit-Stand Chair. SpecSheet [online]. Health Postures Inc., 2022 [retrieved on Mar. 29, 2022]. Retrieved from the Internet: <URL: https://healthpostures.com/wp-content/uploads/2015/11/Spec-Sheet-5100.pdf>. (1 page).

(Continued)

*Primary Examiner* — Rodney B White

(74) *Attorney, Agent, or Firm* — Rowan Tree Law Group, PLLC; Frederick F. Rosenberger

(57) ABSTRACT

An ergonomic chair has a back support member and means for arranging and supporting legs of the user in an asymmetric configuration, with a first leg extending in front of a body of the user and a second leg aligned with or extending behind the body of the user. An angle between the first and second legs in a side view can be at least 30 degrees. The means for arranging and supporting legs can comprise one or more fixed structures that support the first leg in a first orientation, or one or more dynamic structures that can be positioned by the user to support the first leg in a first orientation. In some embodiments, with the legs of the user in the asymmetric configuration, a centerline of the user is offset from a centerline of the back support member with respect to a lateral direction.

10 Claims, 29 Drawing Sheets

(56) References Cited

U.S. PATENT DOCUMENTS

| | | | | |
|---|---|---|---|---|
| 439,088 | A | 10/1890 | Allen | |
| 3,711,152 | A | 1/1973 | Sirpak et al. | |
| 4,221,370 | A | 9/1980 | Redwine | |
| 4,880,270 | A | 11/1989 | Cooper | |
| 4,915,450 | A | 4/1990 | Cooper | |
| 4,966,413 | A | 10/1990 | Palarski | |
| 5,261,723 | A | 11/1993 | Hosoe | |
| 6,056,363 | A | 5/2000 | Maddox | |
| 6,092,868 | A | 7/2000 | Wynn | |
| 6,315,358 | B1 | 11/2001 | Baru | |
| 6,417,894 | B1 | 7/2002 | Goff et al. | |
| 6,726,276 | B1 | 4/2004 | Tholkes et al. | |
| 7,134,719 | B2 | 11/2006 | Moglin | |
| 7,896,442 | B2 | 3/2011 | White | |
| 7,922,249 | B2 | 4/2011 | Marchand | |
| 8,087,724 | B2 | 1/2012 | Kosik et al. | |
| 8,141,949 | B2 | 3/2012 | Baru | |
| 8,864,233 | B2 | 10/2014 | Wei et al. | |
| 8,939,500 | B2 | 1/2015 | Voigt et al. | |
| 9,220,348 | B2 | 12/2015 | Stieler et al. | |
| 9,433,288 | B2 | 9/2016 | Voigt et al. | |
| 9,532,913 | B1 | 1/2017 | Jacks | |
| D789,105 | S | 6/2017 | Voigt et al. | |
| 9,955,785 | B2 | 5/2018 | Voigt et al. | |
| 10,973,725 | B2 | 4/2021 | Mason | |
| 11,219,311 | B1 | 1/2022 | Kondziela | |
| 11,844,434 | B2 * | 12/2023 | Catan | A47C 9/002 |
| 2005/0029846 | A1 | 2/2005 | Jonas | |
| 2007/0278834 | A1 | 12/2007 | Kielland | |
| 2009/0295213 | A1 | 12/2009 | White | |
| 2011/0031788 | A1 | 2/2011 | Kosik et al. | |
| 2011/0156465 | A1 | 6/2011 | White | |
| 2012/0086252 | A1 | 4/2012 | Hong | |
| 2016/0367027 | A1 | 12/2016 | Voigt et al. | |
| 2017/0079438 | A1 | 3/2017 | Speicher et al. | |
| 2022/0183918 | A1 | 6/2022 | Behrendt | |

FOREIGN PATENT DOCUMENTS

| | | | |
|---|---|---|---|
| KR | 1020200046600 | B1 | 5/2020 |
| WO | WO 2017-179034 | A1 | 10/2017 |
| WO | WO 2019-073467 | A1 | 4/2019 |

OTHER PUBLICATIONS

DuoBack Split Seat. Product Website [online]. Office Ergonomics Limited, Mar. 2021 [retrieved on Mar. 29, 2022]. Retrieved from the Internet: <URL: https://www.duoback.co.uk/duoback-split-seat>. (6 pages).

International Search Report and Written Opinion, mailed Jan. 25, 2022, in International Application No. PCT/US21/48357. (18 pages).

Lean Chair. Product Website [online]. Lean Chair, Inc., Mar. 2021 [retrieved on Mar. 29, 2022]. Retrieved from the Internet: <URL: http://web.archive.org/web/20210321005756/http://leanchair.com/>. (10 pages).

Notice of Allowance, issued Sep. 7, 2023 (Sep. 7, 2023), in parent U.S. Appl. No. 17/764,889. (8 pages).

Office Action, issued Jun. 26, 2023 (Jun. 26, 2023), in parent U.S. Appl. No. 17/764,889. (12 pages).

* cited by examiner

ERGONOMIC CHAIRS SUPPORTING ASYMMETRIC LEG CONFIGURATIONS

FIELD

The present disclosure relates generally to chairs, such as office or task chairs, and more particularly, to ergonomic chairs supporting asymmetric leg configurations, for example, to allow extension of the hip flexor.

BACKGROUND

Task chairs (e.g., used by office workers) take a variety of forms, and many are designed with comfort and health in mind. Many of the designs focus on back problems. Examples include ergonomic chairs with adjustable lumbar supports. Other designs encourage the user to support the back without leaning and while reducing slouching. Examples include ball chairs and kneeling chairs. Other designs include saddle stools that drop the knees to make it easier for the user to self-support the back rather than relying on a backrest. Another design, which can be referred to as a leaning standing-type chair, allows the user to stand while partially leaning back such that a portion of a user's weight is taken off the legs. Yet another design, referred to as zero-gravity chairs, allows a user to partially recline. The user's back is thus allowed to rest with a lower tendency for gravity to cause slumping. In some examples, zero-gravity chairs have been integrated into computer workstations, with the chair being separate from a support for a keyboard and monitor.

However, in conventional chairs, the legs of the user are positioned and/or supported in a symmetrical way and typically without extension of either hip flexor of the user. Also, the configuration of conventional chairs offers little ability for the user to stretch muscles or change pressure points on the body by changing position. While some chairs may allow for repositioning (e.g., by rotating to change between upright and reclined positions), the user's body is still positioned symmetrically, and the repositioning does not allow for complete straightening or hyperextension of the hip flexor.

Embodiments of the disclosed subject matter may address one or more of the above-noted problems and disadvantages, among other things.

SUMMARY

Embodiments of the disclosed subject matter system provide ergonomic chairs that support legs of the user in asymmetric leg configurations. For example, in some embodiments, one of the legs of the user can be disposed in a forward orientation with respect to the upper body of the user, and the other leg can remain aligned with the spine in a side view or can be disposed in a rearward orientation with respect to the upper body of the user. Such asymmetric configurations can allow the user to stretch the hip flexor muscles on one side of the user's body, while otherwise still supported by portions of the chair. In some embodiments, the user can change positions on the chair or change orientation of the chair support structures, for example, to adopt an opposite asymmetric leg configuration that stretches the hip flexor muscles on the other side of the user's body. By allowing for stretching in the hip flexor, embodiments of the disclosed subject matter can avoid, or at least reduce, problems associated with sitting for long periods, for example, back pain.

In one or more embodiments, an ergonomic chair can comprise a back support member and means for arranging and supporting legs of the user in an asymmetric configuration. The back support member can be constructed to contact at least a portion of a back of a user. The asymmetric configuration can comprise (i) a first leg extending in front of a body of the user and (ii) a second leg aligned with or extending behind the body of the user. An angle between the first and second legs in a side view can be at least 30 degrees.

In some embodiments, the means for arranging and supporting legs of the user comprises one or more fixed structures constructed to support the first leg in a first predetermined orientation. In some embodiments, the one or more fixed structures are arranged such that, with the legs of the user in the asymmetric configuration, a centerline of the user is offset from the centerline of the back support member with respect to a lateral direction. Alternatively or additionally, in some embodiments, the means for arranging and supporting legs of the user comprises one or more dynamic structures constructed to be positioned by the user to support the first leg in a first orientation.

In one or more embodiments, an ergonomic chair can comprise a back support, a first configurable body support, and a second configurable body support. The first configurable body support can be connected to the back support and can be configurable to support one buttock and thigh or one foot. The second configurable body support can be connected to the back support and can be configurable to support one buttock and thigh or one foot. The first and second configurable body supports can be independently movable, such that a user may selectively be supported at once by one buttock and thigh and an opposite foot.

In one or more embodiments, an ergonomic chair can comprise a back support, a first body support, and a second body support. The first body support can be connected to the back support to support a first foot of a user. The second body support can be connected to the back support to support a second foot of the user. The first and second body supports can permit a hip flexion angle difference of at least 30 degrees.

In one or more embodiments, an ergonomic chair can comprise a seat and leg support. The seat can be sized and positioned in a frame to support a left or right buttock of a user. The leg support can be sized and positioned in said frame to support a foot or knee of the user on a side opposite said left or right buttock. The positions of the seat and leg support can be such that the opposing thighs can have different angles of flexion relative to a hip of the user.

Any of the various innovations of this disclosure can be used in combination or separately. This summary is provided to introduce a selection of concepts in a simplified form that are further described below in the detailed description. This summary is not intended to identify key features or essential features of the claimed subject matter, nor is it intended to be used to limit the scope of the claimed subject matter. The foregoing and other objects, features, and advantages of the disclosed technology will become more apparent from the following detailed description, which proceeds with reference to the accompanying figures.

BRIEF DESCRIPTION OF THE DRAWINGS

Embodiments will hereinafter be described with reference to the accompanying drawings, which have not necessarily been drawn to scale. Where applicable, some elements may be simplified or otherwise not illustrated in order to assist in the illustration and description of underlying features. Throughout the figures, like reference numerals denote like elements.

FIG. 41 is a side view of a user in the chair of FIGS. 4A-4B with the backrest in an upright configuration.

DETAILED DESCRIPTION

General Considerations

Figure 1A:
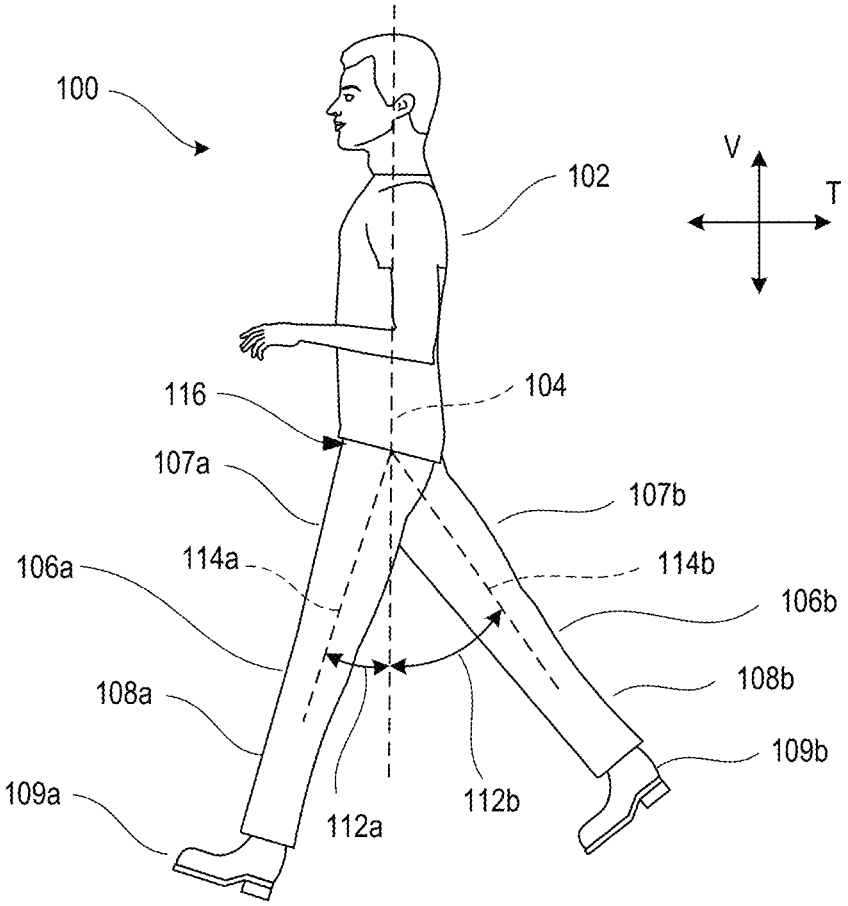
FIG. 1A is a side view showing aspects of a user's body.

For purposes of this description, certain aspects, advantages, and novel features of the embodiments of this disclosure are described herein. The disclosed methods and systems should not be construed as being limiting in any way. Instead, the present disclosure is directed toward all novel and nonobvious features and aspects of the various disclosed embodiments, alone and in various combinations and subcombinations with one another. The methods and systems are not limited to any specific aspect or feature or combination thereof, nor do the disclosed embodiments require that any one or more specific advantages be present, or problems be solved. The technologies from any embodiment or example can be combined with the technologies described in any one or more of the other embodiments or examples. In view of the many possible embodiments to which the principles of the disclosed technology may be applied, it should be recognized that the illustrated embodiments are exemplary only and should not be taken as limiting the scope of the disclosed technology.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

The disclosure of numerical ranges should be understood as referring to each discrete point within the range, inclusive of endpoints, unless otherwise noted. Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods, as known to those of ordinary skill in the art. When directly and explicitly distinguishing embodiments from discussed prior art, the embodiment numbers are not approximates unless the word "about" is recited. Whenever "substantially," "approximately," "about," or similar language is explicitly used in combination with a specific value, variations up to and including 10% of that value are intended, unless explicitly stated otherwise.

Directions and other relative references may be used to facilitate discussion of the drawings and principles herein, but are not intended to be limiting. For example, certain terms may be used such as "inner," "outer,", "upper," "lower," "top," "bottom," "interior," "exterior," "left," right," "front," "back," "rear," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same.

As used herein, "comprising" means "including," and the singular forms "a" or "an" or "the" include plural references unless the context clearly dictates otherwise. The term "or" refers to a single element of stated alternative elements or a combination of two or more elements, unless the context clearly indicates otherwise.

Although there are alternatives for various components, parameters, operating conditions, etc. set forth herein, that does not mean that those alternatives are necessarily equivalent and/or perform equally well. Nor does it mean that the alternatives are listed in a preferred order, unless stated otherwise. Unless stated otherwise, any of the groups defined below can be substituted or unsubstituted.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Features of the presently disclosed subject matter will be apparent from the following detailed description and the appended claims.

Overview of Terms

The following explanations of specific terms and abbreviations are provided to facilitate the description of various aspects of the disclosed subject matter and to guide those of ordinary skill in the art in the practice of the disclosed subject matter.

Fixed Structure: Structures of the chair for supporting portions of a user's lower body (e.g., feet, legs, buttocks) that remain in a substantially fixed position with respect to other portions of the chair (e.g., backrest, floor support, etc.) whether or not being used by the user. In some embodiments, portions of the fixed structures can be repositionable (e.g., including one or more pivots or hinges, with a locking mechanism, such as friction lock) to allow customization to the user's body while otherwise remaining in a generally fixed orientation with respect to the other portions of the chair.

Dynamic Structure: Structures of the chair for supporting portions of a user's lower body (e.g., feet, legs, buttocks) that move, with respect to other portions of the chair (e.g., backrest, floor support, etc.), between a first position (e.g., a stowed position or configuration out of the way of the user) and a second position (e.g., a deployed position or configuration for supporting the user). In some embodiments, portions of the dynamic structures can be repositionable (e.g., including one or more pivots or hinges, with a locking mechanism, such as friction lock) to allow customization to the user's body, in addition to, or to enable, moving between the first and second positions.

Lateral Direction (L): A direction corresponding to the left-right axis in a coordinate system relative to the user or the chair (e.g., egocentric coordinates).

Transverse Direction (T): A direction corresponding to the front-back axis in a coordinate system relative to the user or the chair (e.g., egocentric coordinates).

Vertical Direction (V): A direction corresponding to the up-down axis in a coordinate system relative to the user or the chair (e.g., egocentric coordinates). In some orientations, the vertical direction is substantially parallel to the direction of gravity.

Central or longitudinal plane: An imaginary plane along the vertical direction that divides the body of the user into ventral (front) and dorsal (back) sections. In some embodiments, the spine of the user is substantially aligned with the central plane 104 in a side view.

Median or lateral plane: An imaginary plane along the vertical direction that divides the body of the user into left and right halves.

Center axis: An imaginary axis defined by the intersection of the central and median planes. In some embodiments, the spine of the user is substantially aligned with the center axis 105 in a front view.

User: A person having a back 102, a left leg 106*a*, and a right leg 106*b*, as shown in FIG. 1A, that sits in or is otherwise supported by an ergonomic chair. In some embodiments, the left leg 106*a* of the user 100 can be divided into an upper leg region or thigh 107*a* (e.g., extending from the hip to the knee), a lower leg region or shank 108*a* (e.g., extending from the knee to the foot), and a left foot 109*a*. Similarly, the right leg 106*b* of the user can be divided into an upper leg region or thigh 107*b*, a lower leg region or shank 108*b*, and a right foot 109*b*. In some embodiments, the hip flexors (generally in area 116) on one or both sides of the user can be stretched using the disclosed ergonomic chairs.

Asymmetric leg configuration: The left leg 106*a* or the right leg 106*b* is disposed forward of the central plane 104, while the other leg 106 is disposed rearward of or substantially aligned with the central plane 104, such that the left and right legs define an angle between each other (in a side view) of at least 30°. In some embodiments, at least the thigh 107 of each leg 106 extends along a respective direction 114 that makes an angle with respect to the central plane 104. In the example of FIG. 1A, the extension direction 114*a* of the left thigh 107*a* makes an angle 112*a* in front of the central plane 104, and the extension direction 114*b* of the right thigh 107*b* makes an angle 112*b* behind the central plane 104. In some embodiments, the angle between the legs 106*a*, 106*b* can be considered to the combination of angles 112*a* and 112*b* (e.g., summation of their absolute values).

Introduction

Disclosed herein are ergonomic chairs that can support legs of the user in asymmetric leg configurations. For example, in some embodiments, one of the legs of the user can be disposed in a forward orientation with respect to the upper body of the user, and the other leg can remain aligned with the spine in a side view or can be disposed in a rearward orientation with respect to the upper body of the user. Such asymmetric configurations can allow the user to restfully stretch the hip flexor muscles on one side of the user's body, while otherwise still supported by portions of the chair. In some embodiments, the user can change positions on the chair or change orientation of the chair support structures, for example, to adopt an opposite asymmetric leg configuration that restfully stretches the hip flexor muscles on the other side of the user's body. By allowing for stretching in the hip flexor, embodiments of the disclosed subject matter can avoid, or at least reduce, problems associated with sitting for long periods, for example, back pain, without requiring the user to stand. Note that a continuous state of flexion of the hip flexor is believed to contribute to lower back pain, so the ability to extend the hip flexor is considered desirable.

Conventional standing desk workstations can allow a user to adopt asymmetric leg configurations, but the user must support the entire weight of the body on one or both legs. In contrast, embodiments of the disclosed subject matter allow for asymmetric leg configurations while supporting at least some of the user's body weight. In some embodiments, the ergonomic chair can support the upper body of the user and a forward-extended leg of the user in an inclined position with respect to the direction of gravity, for example, to provide comfort similar to a zero-gravity chair while allowing extension of the hip flexor. In some embodiments, at least some of the user's body weight can be borne by a part of ergonomic chair, such that the legs do not support and are not subject to all the forces that would otherwise be associated with continuous standing.

While the disclosed ergonomic chairs may have the same goal of comfort as conventional chairs and workstations, the source of comfort may be different. In conventional chairs, the chair supports the user in the same symmetrical posture. A user being in such a posture, even in an otherwise comfortable chair, will become uncomfortable over time because there no opportunity to change position. In contrast, embodiments of the disclosed subject matter allow the user to change between supported symmetric and asymmetric leg configurations, thereby stretching different muscles (e.g., hip flexors) and changing pressure points.

In some embodiments, an ergonomic chair comprises a back support member and one or more structures that support the user with legs in an asymmetric configuration, where a first leg extends in front of the user and a second leg is aligned with or extends behind the body of the user. In some embodiments, an angle between the first and second legs in a side view is at least 30 degrees, which angle may be effective to stretch a hip flexor of the user. In some embodiments, the ergonomic chair can further support positioning of the user with legs in a symmetric configuration, in addition to the asymmetric configuration. In some embodiments, the back support member can be disposed at a non-zero angle, or at least capable of being rotated to have a non-zero angle, with respect to a direction of gravity. In some embodiments, the back support member can have a contoured cushion or bladder (e.g., as an integrated part of the back support member or coupled thereto). In some embodiments, the first leg is bent at the knee, and/or the second leg is substantially straight. In some embodiments, the ergonomic chair can include (e.g., be integrated with or coupled to) one or more workstation components, for example, a desk surface disposed in front of the body of the user and/or a monitor support arm constructed to support a monitor (e.g., full-size monitor or small-size tablet screen) in front of the face of the user.

In some embodiments, the one or more structures can include one or more fixed structures. The one or more fixed structures can be arranged such that, with the legs of the user in the asymmetric configuration, a centerline of the user is offset from a centerline of the back support member with respect to the lateral direction. In some embodiments, with the legs of the user in the asymmetric configuration, the first leg can be in contact with the first fixed structure or the second fixed structure, while the second leg can be out of contact with the first fixed structure and the second fixed structure. Alternatively or additionally, in some embodiments, the one or more structures can include one or more dynamic structures. The one or more dynamic structures can be arranged such that, with the legs of the user in the asymmetric configuration, a centerline of the user is substantially aligned with (e.g., substantially collinear), or at least intersecting with, a centerline of the back support member with respect to the lateral direction. In some embodiments, the one or more dynamic structures can be arranged such that, with the legs of the user in the asymmetric configuration, each leg can be in contact with a respective dynamic structure.

Figure 1B:
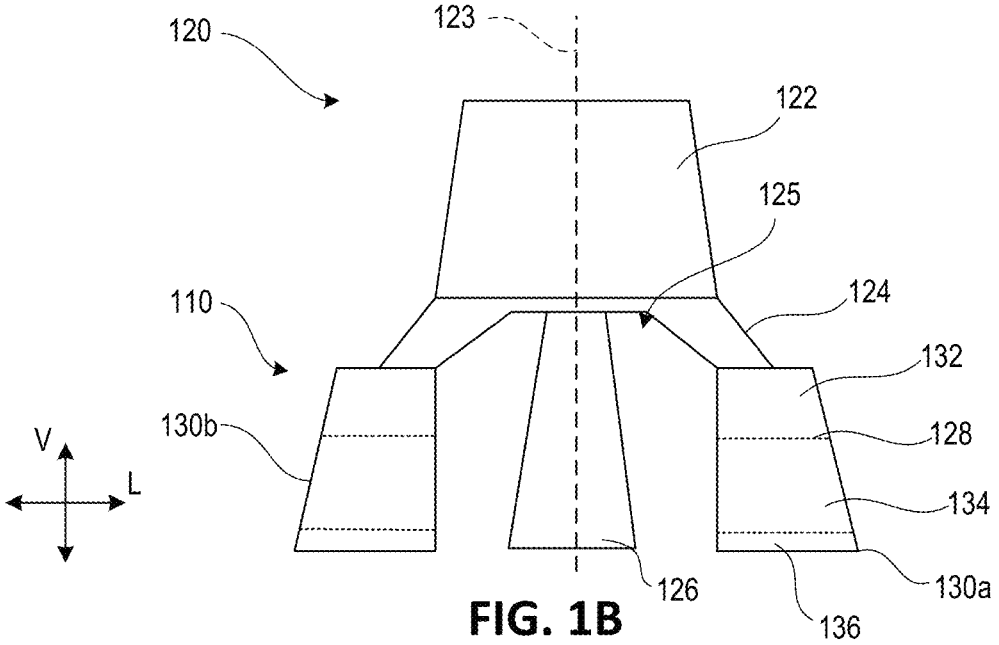
FIG. 1B is a simplified schematic diagram of an ergonomic chair with a pair of fixed structures for supporting legs in asymmetric configurations, according to one or more embodiments of the disclosed subject matter.

Referring to FIG. 1B, a generalized example of an ergonomic chair 120 with a fixed structure is shown. The ergonomic chair 120 can include a back support portion 122 (also referred to herein as a backrest), a seat portion 124 (also referred to herein as a seat or seat support portion), a floor support portion 126 (also referred to herein as base), and means 110 for arranging and supporting legs of the user. A central axis 123 with respect to the lateral direction can define a bilateral symmetry (e.g., reflection symmetric) in a front view for the chair 120, or for at least the backrest 122. In the illustrated example of FIG. 1B, the means 110 for arranging and supporting legs of the user includes a pair of fixed structures disposed on opposite lateral sides of the chair with a central gap 125 therebetween, in particular, a left fixed structure 130*a* and a right fixed structure 130*b*. In the illustrated example, the seat portion 124 is only partially divided by the gap 125, such that at least a part of the seat portion 124 extends across the central axis 123 with respect to the lateral direction. Alternatively, in some embodiments, the seat portion 124 can be fully divided into separate parts by the gap 125, such that separate seat portions 124 extend forward from the backrest 122.

Each fixed structure 130*a*, 130*b* can be constructed to support a respective one of the legs. In the illustrated example, each fixed structure 130*a*, 130*b* has a first member 132 constructed to support a thigh of the user, a second member 134 constructed to support a shank of the user, and optionally a footrest 136. In the illustrated example of FIG. 1B, the first member extends from a respective front end of the seat portion. Alternatively, in some embodiments, the first member and the seat support portion can be integrated, for example, where the seat support portion is part of the first member 132 closest to backrest 122. In the illustrated example, the second member 134 can be connected to and/or extend from a front end of the first member 132, for example, at connection 128, which can correspond to a location of a knee of the user (e.g., to define a bend for the knee). Alternatively, in some embodiments, the second member can be separate from the first member, for example, to support a portion of the opposite leg (e.g., as a kneeling platform). Alternatively, in some embodiments, the fixed structure 130*a*, 130*b* includes only a first member 132, for example, without any separate second member to support the shank of the user.

For example, a user can sit on seat portion 124 centered in the ergonomic chair 120 (e.g., with center axis 105 substantially aligned or at least intersecting with the chair central axis 123) with both legs extending through gap 125 in a symmetric configuration. To stretch the hip flexors or at least change pressure points, the user can move laterally outward to one side, for example, such that the outer left leg is supported in a forward orientation by fixed structure 130*a*, while the inner right leg extends through the gap 125, for example, aligned with central plane 104 of the user's body, thereby allowing the legs to adopt an asymmetric configuration. The center axis 105 of the user is thus offset from the chair central axis 123 when the legs are in the asymmetric configuration. To stretch the other hip flexors, the user can move to the opposite side of the chair, for example, such that the now outer right leg is supported in the forward orientation by fixed structure 130*b*, while the now inner left leg extends through gap 125.

Figure 1C:
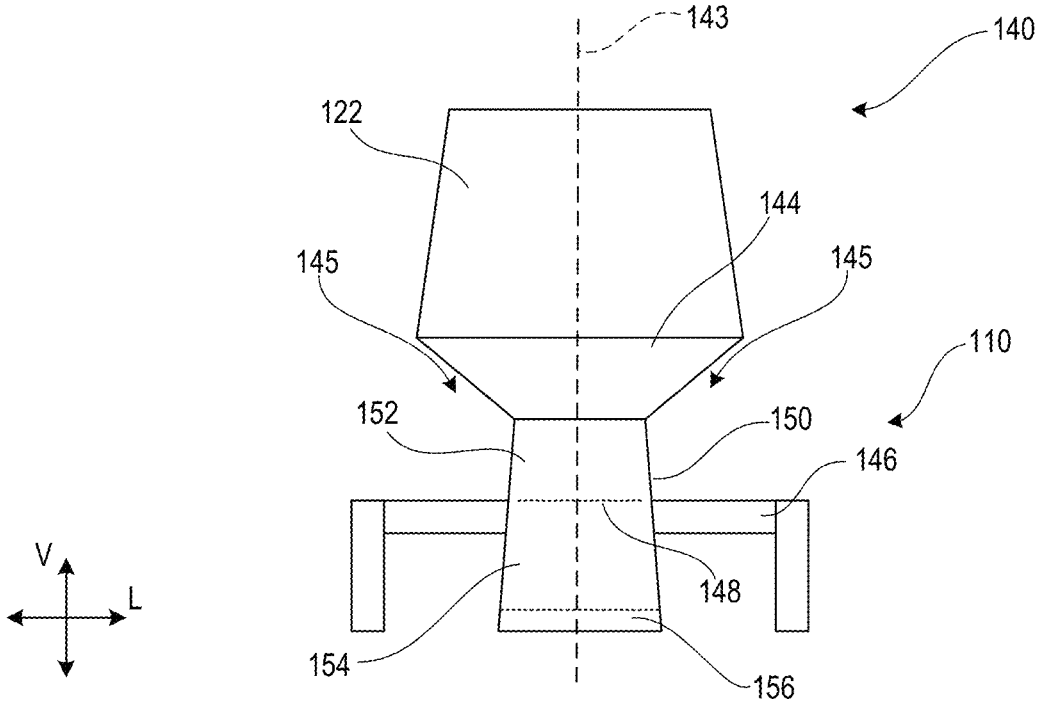
FIG. 1C is a simplified schematic diagram of an ergonomic chair with a single fixed structure for supporting legs in asymmetric configurations, according to one or more embodiments of the disclosed subject matter.

Referring to FIG. 1C, a generalized example of another ergonomic chair 140 with fixed structure is shown. The ergonomic chair 140 can include a back support portion 122, a seat portion 144 (also referred to herein as a seat or seat support portion), a floor support portion 146 (also referred to herein as base), and means 110 for arranging and supporting legs of the user. A central axis 143 with respect to the lateral direction can define a bilateral symmetry (e.g., reflection symmetric) in a front view for the chair 140, or for at least the backrest 122. In the illustrated example of FIG. 1C, the means 110 for arranging and supporting legs of the user includes a single fixed structure 150 centrally disposed between a pair of laterally-outward recesses 145, each of which can be sized to accommodate a leg of the user.

The single fixed structure 150 can be constructed to support one or both of the legs of the user. In the illustrated example, fixed structure 150 has a first member 152 constructed to support a thigh of the user, a second member 154 constructed to support a shank of the user, and optionally a footrest 156. In the illustrated example of FIG. 1C, the first member 152 extends from a respective front end of the seat portion 144. Alternatively, in some embodiments, the first member and the seat support portion can be integrated, for example, where the seat support portion is part of the first member 152 closest to backrest 122. In the illustrated example, the second member 154 can be connected to and/or extend from a front end of the first member 152, for example, at connection 148, which can correspond to a location of a knee of the user (e.g., to define a bend for the knee). Alternatively, in some embodiments, the second member can be separate from the first member, and/or fixed structure 150 can include only a first member 152, for example, without any separate second member to support the shank of the user.

For example, a user can sit on seat portion 144 centered in the ergonomic chair 140 (e.g., with center axis 105 substantially aligned or at least intersecting with the chair central axis 143) with both legs supported by the central fixed structure 150 in a symmetric configuration. To stretch the hip flexors or at least change pressure points, the user can move laterally outward to one side, for example, such that the inner left leg is supported in a forward orientation by fixed structure 150, while the outer right leg extends through lateral recess 145, for example, aligned with central plane 104 of the user's body, thereby allowing the legs to adopt an asymmetric configuration. The center axis 105 of the user is thus offset from the chair central axis 143 when the legs are in the asymmetric configuration. To stretch the other hip flexors, the user can move to the opposite side of the chair, for example, such that the now inner right leg is supported in the forward orientation by fixed structure 150, while the now outer left leg extends through the opposite lateral recess 145.

Figure 1D:
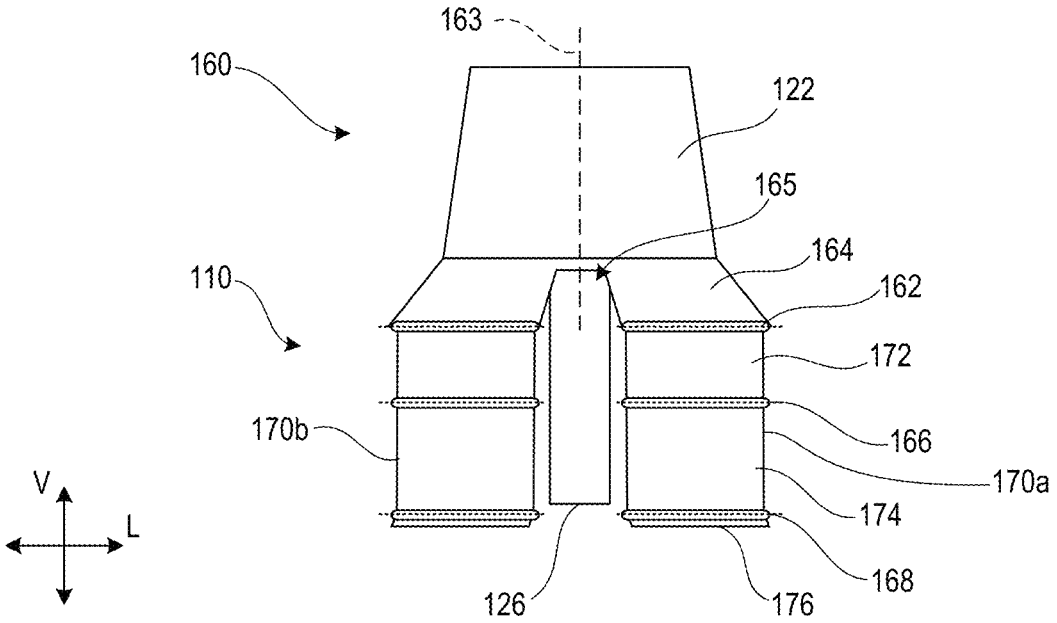
FIG. 1D is a simplified schematic diagram of an ergonomic chair with a pair of dynamic structures for supporting legs in asymmetric configurations, according to one or more embodiments of the disclosed subject matter.

Referring to FIG. 1D, a generalized example of an ergonomic chair 160 with a dynamic structure is shown. The ergonomic chair 160 can include a back support portion 122, a seat portion 164, a floor support portion 126, and means 110 for arranging and supporting legs of the user. A central axis 163 with respect to the lateral direction can define a bilateral symmetry (e.g., reflection symmetric) in a front view for the chair 160, or for at least the backrest 122. In the illustrated example of FIG. 1D, the means 110 for arranging and supporting legs of the user includes a pair of dynamic structures disposed on opposite lateral sides of the chair with a central gap 165 therebetween, in particular, a left fixed structure 170*a* and a right fixed structure 170*b*. In the illustrated example, the seat portion 164 is only partially divided by the gap 165, such that at least a part of the seat portion 164 extends across the central axis 163 with respect to the lateral direction. Alternatively, in some embodiments, the seat portion 164 can be fully divided into separate parts by the gap 165, such that separate seat portions 164 extend forward from the backrest 122. In some embodiments, a size of the gap 165 may be insufficient for a leg of the user to extend therethrough.

Each dynamic structure 170*a*, 170*b* can be constructed to be independently moved (e.g., manually by a user or by one or more integrated actuators) into various configurations supporting a respective one of the legs. In the illustrated example, each dynamic structure 170*a*, 170*b* has a first member 172 constructed to contact or support a thigh of the user, a second member 174 constructed to contact or support a shank of the user, and optionally a footrest 176. In the illustrated example of FIG. 1D, the second member 174 can be connected to a front end of the first member 172 by a rotating hinge or pivot coupling 166, which can correspond to a location of a knee of the user (e.g., to define a bend for the knee), and the footrest 176 can be connected to a front end of the second member 174 by another rotating hinge or pivot coupling 168, which can correspond to a location of an ankle of the user.

The first member 172 can extend from a respective front end of the seat portion 164. In the illustrated example, the first member 172 can be connected to a front end of the seat portion 164 by a rotating hinge or pivot coupling 162, which can correspond to a junction between a buttock and thigh of the user. Alternatively, in some embodiments, the first member and the seat support portion can be integrated, for example, where the seat support portion is part of the first member 172 closest to backrest 122. In such embodiments, the first member 172 can be connected to the backrest 122 by a rotating hinge or pivot coupling. By virtue of hinges 162, 166, and 168 (e.g., that allow rotation about respective axes parallel to the lateral direction), the dynamic structures 170*a*, 170*b* can thus be independently positioned into custom configurations supporting respective legs of the user in front of, behind, or aligned with the central plane 104.

For example, a user can sit on seat portion 164 centered in the ergonomic chair 160 (e.g., with center axis 105 substantially aligned or at least intersecting with the chair central axis 163) with legs supported by respective dynamic structures 170*a*, 170*b* in a symmetric configuration. To stretch the hip flexors or at least change pressure points, the user can reposition members of one of the dynamic structures 170*a*, 170*b* (e.g., by releasing a friction lock or other locking mechanism of the hinges 162, 166, 168) such that the corresponding leg is supported in a forward orientation while the other leg remains aligned with central plane 104 of the user's body, thereby allowing the legs to adopt an asymmetric configuration. The center axis 105 of the user thus remains substantially aligned with the chair central axis 163 when the legs are in the asymmetric configuration. To stretch the other hip flexors or to adopt a different position, the user can reposition members of the dynamic structures 170*a*, 170*b* to support the legs in any other desired symmetric or asymmetric configuration.

Figure 1E:
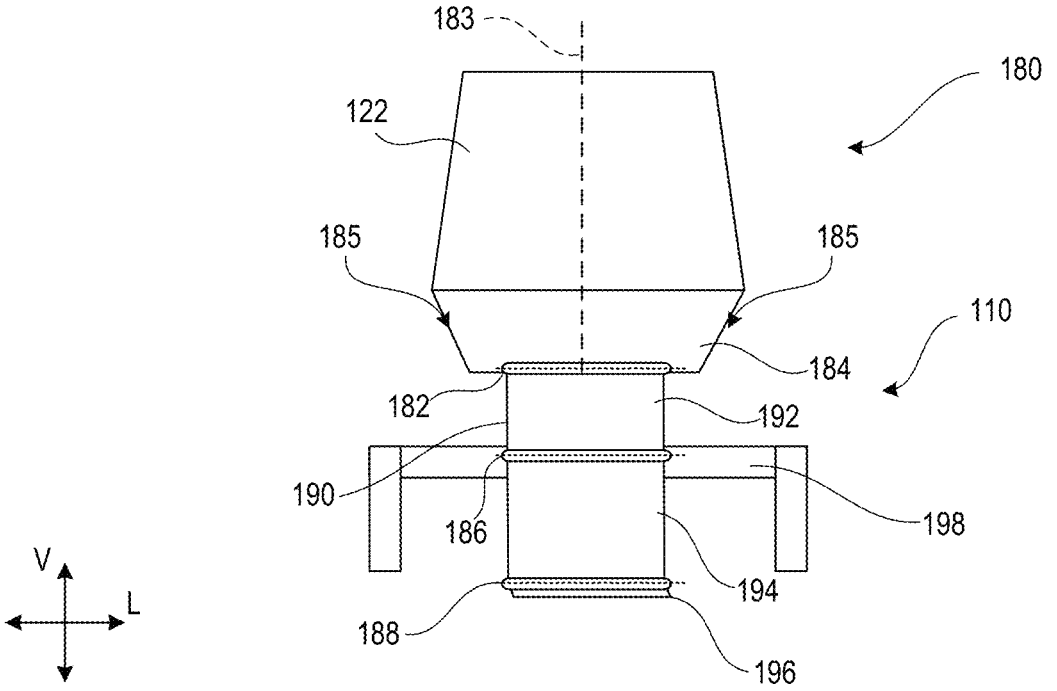
FIG. 1E is a simplified schematic diagram of an ergonomic chair with a single dynamic structure for supporting legs in asymmetric configurations, according to one or more embodiments of the disclosed subject matter.

Referring to FIG. 1E, a generalized example of another ergonomic chair 180 with a dynamic structure is shown. The ergonomic chair 180 can include a backrest or back support portion 122, a seat support portion 184, a floor support portion 198, and means 110 for arranging and supporting legs of the user. A central axis 183 with respect to the lateral direction can define a bilateral symmetry (e.g., reflection symmetric) in a front view for the chair 180, or for at least the backrest 122. In the illustrated example of FIG. 1E, the means 110 for arranging and supporting legs of the user includes a single dynamic structure 190 centrally disposed between a pair of laterally-outward recesses 185, each of which can be sized to accommodate a leg of the user. Alternatively or additionally, the dynamic structure can be movable laterally (e.g., by rotary or translation motion in a plane parallel to the vertical and lateral planes) from a first location spaced from central axis 183 to a second location aligned with, or at least closer to, central axis 183 for use by the user.

The single dynamic structure 190 can be constructed to support one or both of the legs of the user and can be constructed to be independently moved (e.g., manually by a user or by one or more integrated actuators) into various configurations supporting one or both legs. In the illustrated example, dynamic structure 190 has a first member 192 constructed to contact or support a thigh of the user, a second member 194 constructed to contact or support a shank of the user, and optionally a footrest 196. In the illustrated example of FIG. 1E, the second member 194 can be connected to a front end of the first member 192 by a rotating hinge or pivot coupling 186, which can correspond to a location of a knee of the user (e.g., to define a bend for the knee), and the footrest 196 can be connected to a front end of the second member 194 by another rotating hinge or pivot coupling 188, which can correspond to a location of an ankle of the user.

The first member 192 can extend from a respective front end of the seat portion 184. In the illustrated example, the first member 192 can be connected to a front end of the seat portion 184 by a rotating hinge or pivot coupling 182, which can correspond to a junction between a buttock and thigh of the user. Alternatively, in some embodiments, the first member and the seat support portion can be integrated, for example, where the seat support portion is part of the first member 192 closest to backrest 122. In such embodiments, the first member 192 can be connected to the backrest 122 by a rotating hinge or pivot coupling. By virtue of hinges 182, 186, and 188 (e.g., that allow rotation about respective axes parallel to the lateral direction), the dynamic structure 190 can thus be positioned into a custom configuration supporting one or both legs of the user in front of, behind, or aligned with the central plane 104.

For example, a user can sit on seat portion 184 centered in the ergonomic chair 180 (e.g., with center axis 105 substantially aligned or at least intersecting with the chair central axis 163) with both legs supported by dynamic structure 190 in a symmetric configuration. To stretch the hip flexors or at least change pressure points, the user can move laterally outward to one side and can reposition members of dynamic structure 190 (e.g., by releasing a friction lock or other locking mechanism of the hinges 182, 186, 188) such that the inner leg is supported in a forward orientation while the outer leg extends through lateral recess 185 aligned with or positioned behind a central plane 104 of the user's body, thereby allowing the legs to adopt an asymmetric configuration. The center axis 105 of the user is thus offset from the chair central axis 183 when the legs are in the asymmetric configuration. To stretch the other hip flexors or to adopt a different position, the user can move to the opposite side of the chair, for example, such that the now inner leg is supported by the dynamic structure 190 in the forward orientation, while the now outer leg extends through opposite lateral recess 185. Alternatively or additionally, the single dynamic structure 190 can repositioned to support one or both legs in any other desired symmetric or asymmetric configuration.

Examples of Ergonomic Chairs with Fixed Structures

Figure 2A:
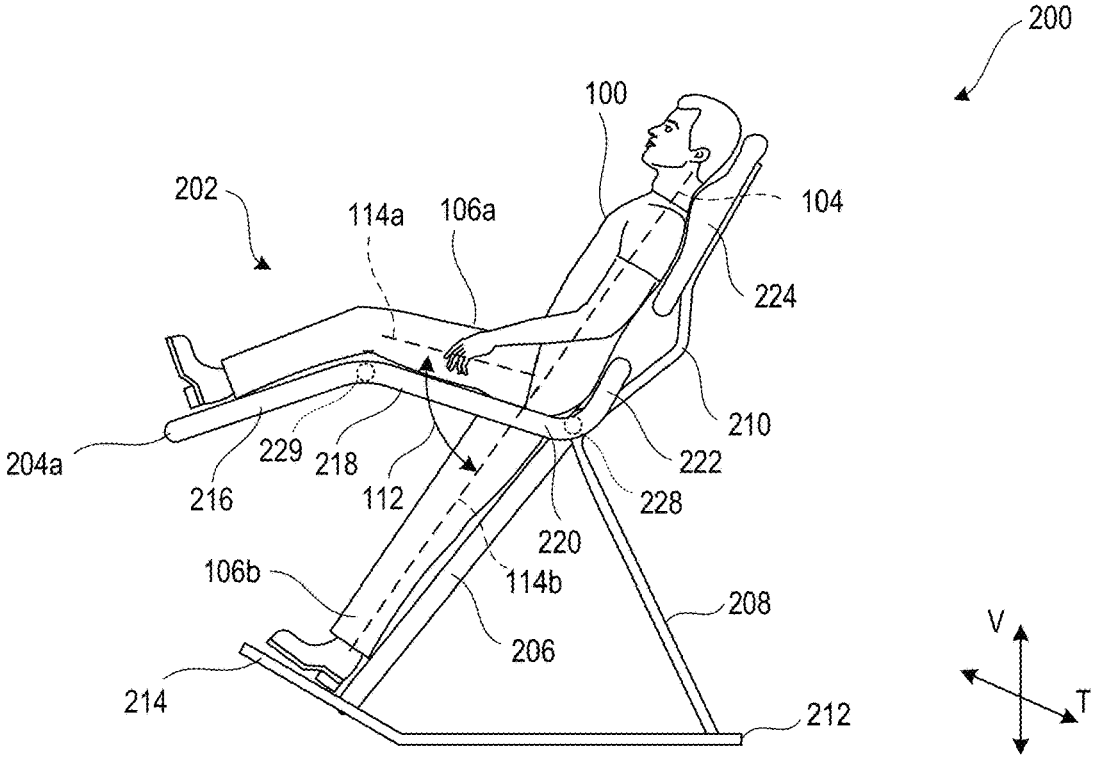
FIG. 2A is a side view of a user in an exemplary ergonomic chair with laterally outer fixed structures for supporting legs in asymmetric configurations, according to one or more embodiments of the disclosed subject matter.

FIG. 2A shows an exemplary ergonomic chair 200 with fixed structures 202 for supporting legs 106*a*, 106*b* of a user 100 in asymmetric configurations. The fixed structures 202 can include laterally-outer fixed structures (of which, only the left fixed structure 204*a* is shown) separated by a lateral gap (not shown). Each laterally-outer fixed structure can have a thigh support member 218 and a shank support member 216 extending at an angle from the thigh support member 218 (e.g., to define a natural bend for the user's knee). Each laterally-outer fixed structure can extend from (e.g., be coupled to or integrated with) a respective lateral end portion of a seat support member 220. In some embodiments, the fixed structure can optionally be provided with one or more hinges or pivots 228, 229 to allow adjustment or customization of supported leg position by the user. The seat support member 220 can be constructed to support buttocks of the user and can include a lower back support portion 222 (e.g., with a laterally central portion 232 designed to contact part of buttocks of user 100), for example, to contact and/or support a lower back of user 100.

An upper back support portion 224, which contacts and/or supports an upper back and head of user 100, can be connected to the lower back support portion 222 and/or chair support member 208 via a backrest connection member 210. The chair support member 208 can be coupled to the seat support member 220 to support the seat support member 220 above and with respect to chair base 212, which can include an angled portion 214 at the front to act as a footrest. In some embodiments, seat support member 220 and/or the upper back support portion 224 can be rotatably coupled to the chair support member 208 (e.g., via a hinge or pivot at 229) to allow the user 100 to adopt a partly reclined position with respect to the vertical direction. The ergonomic chair 200 can also include a centrally-located secondary leg structure 206, which can contact or position one or both legs of the user substantially in alignment with central plane 104 of the body of the user 100. In the illustrated example, the user 100 sits laterally offset toward the left side of the chair 200 with the left leg 106*a* supported by left fixed structure 204*a* while the right leg 106*b* is supported by secondary leg structure 206. The left leg 106*a* and right leg 106*b* are thus supported in an asymmetric configuration, with an angle 112 therebetween, so as to provide at least some stretch to the hip flexor.

As shown in FIG. 2A, the left half of the user 100 can be supported in a manner similar to a zero-gravity chair, while the right half of the user 100 can adopt a partly-reclined standing configuration at least partially supported by right leg 106*b* (e.g., where the back support portions 222, 224 at least partially reduce a weight required to be supported by extended leg 106*b*). The user 100 can move along the lateral direction to the opposite side of the chair 200 to position the right leg on a corresponding right fixed structure, such that the right half of the user is supported in a manner similar to a zero-gravity chair and the left half of the user adopts the inclined standing configuration at least partially supported by the left leg 106*a*. If desired, the user 100 can also move to be centrally aligned with the chair 200, for example, such that neither leg is supported by the fixed structures 204 and both legs have an extended symmetric configuration. The user 100 may thus enjoy the benefits of standing but without having to bear the entire weight of the user in view of the semi-reclining arrangement of the chair.

Figure 2B:
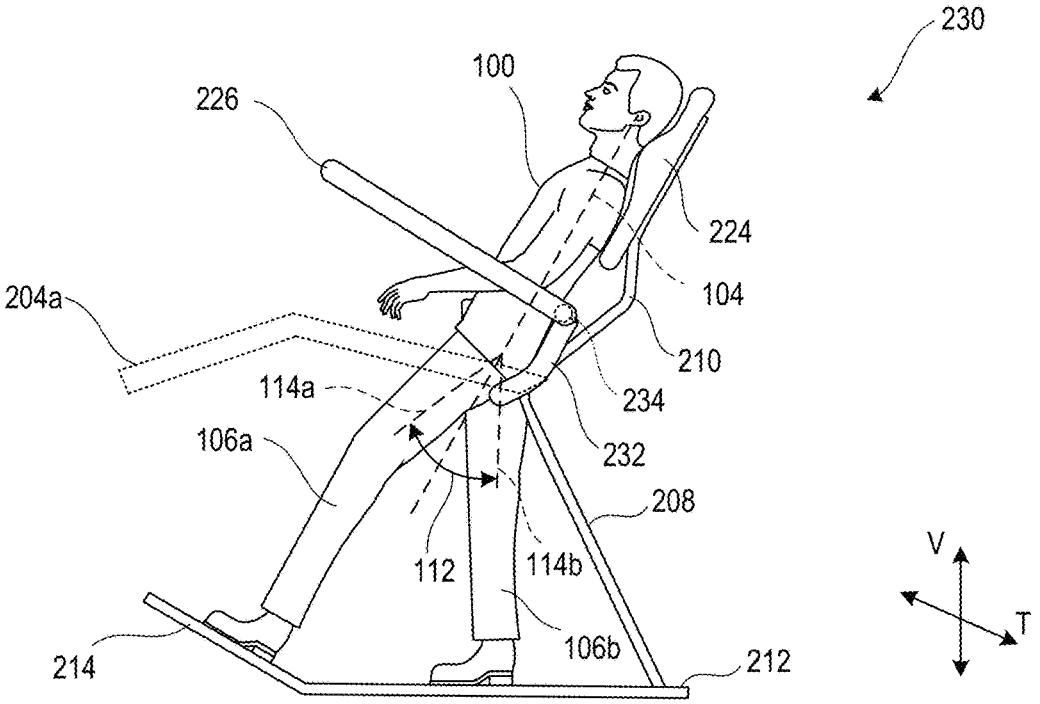
FIG. 2B is a side view of a user in a first variation of the ergonomic chair of FIG. 2A, according to one or more embodiments of the disclosed subject matter.

FIG. 2B shows another exemplary ergonomic chair 230 with fixed leg support structures. The ergonomic chair 230 can be substantially similar in structure and operation to chair 200 of FIG. 2A, but without secondary leg structure 206. The lack of any secondary leg structure can allow the user 100 to position the inner leg in a rearward orientation with respect to central plane 104, thereby extending the angle 112 between the legs 106*a*, 106*b* and increasing a stretch of the hip flexor. The configuration of the base 212, in particular with the angled portion 214 acting as a forward footrest and the flat portion acting as an intermediate footrest, can support the legs in an asymmetric configuration even when the user 100 is centrally disposed within the chair (e.g., without using fixed leg support structures 204). In the illustrated example, the chair 230 optionally includes an integrated desk surface 226, which can be repositionable via pivot or hinge 234, for example, to allow a user to enter or exit the chair 230.

FIGS. 3A-3F show another exemplary ergonomic chair 300 with fixed structures 302 for supporting legs 106*a*, 106*b* of a user 100 in asymmetric configurations. The ergonomic chair 300 includes a lower back support portion 312 extending from and integrated with a laterally-extending seat support portion 310, and an upper back support portion 314 extending from and integrated with the lower back support portion 312. The fixed structures 302 can include laterally-outer fixed structures 304*a*, 304*b* separated by opening 324 sized and shaped to accommodate extension of a single leg therethrough. Each fixed structure 304*a*, 304*b* can extend from and be integrated with seat support portion 310. The left fixed structure 304*a* can have a thigh support member 308*a* and a shank support member 306*a* extending at an angle from the thigh support member 308*a* (e.g., to define a natural bend for the user's knee), and the right fixed structure 304*b* can have a thigh support member 308*b* and a shank support member 306*b* extending at an angle from the thigh support member 308*b*. In the illustrated example, the left and right fixed structures 304*a*, 304*b* can be connected at a top end by the seat support portion 310 and at a bottom end by intervening connection portion 322. Alternatively, in some embodiments, the left and right fixed structures may be connected only at the top end by the seat support portion (e.g., such that a gap extends completely from the seat support portion 310 to a bottom end of the chair).

Figure 3A:
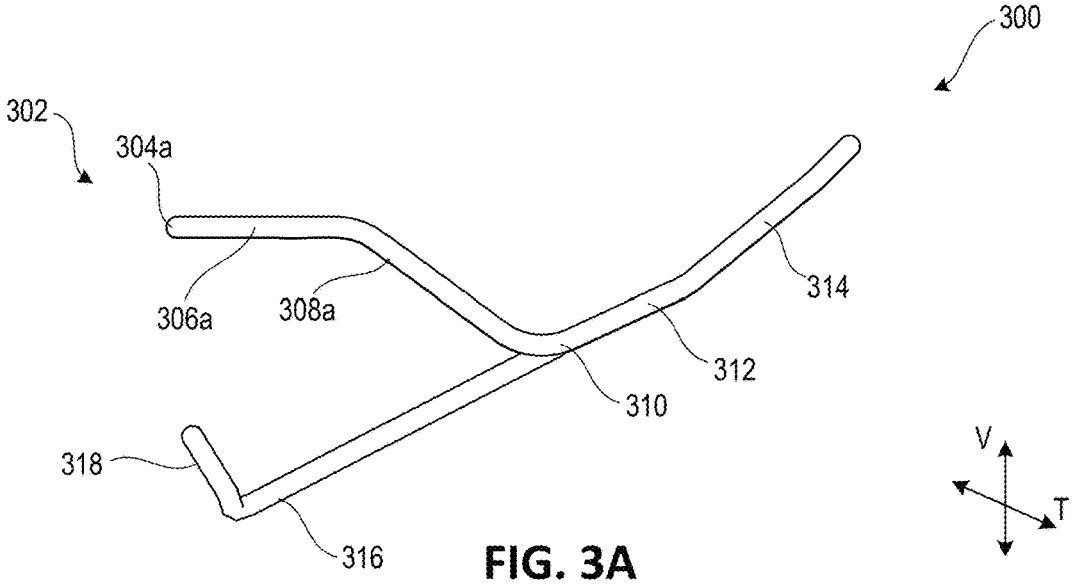
FIGS. 3A-3B are side and front views, respectively, of another exemplary ergonomic chair with laterally outer fixed structures for supporting legs in asymmetric configurations, according to one or more embodiments of the disclosed subject matter.
Figure 3B:
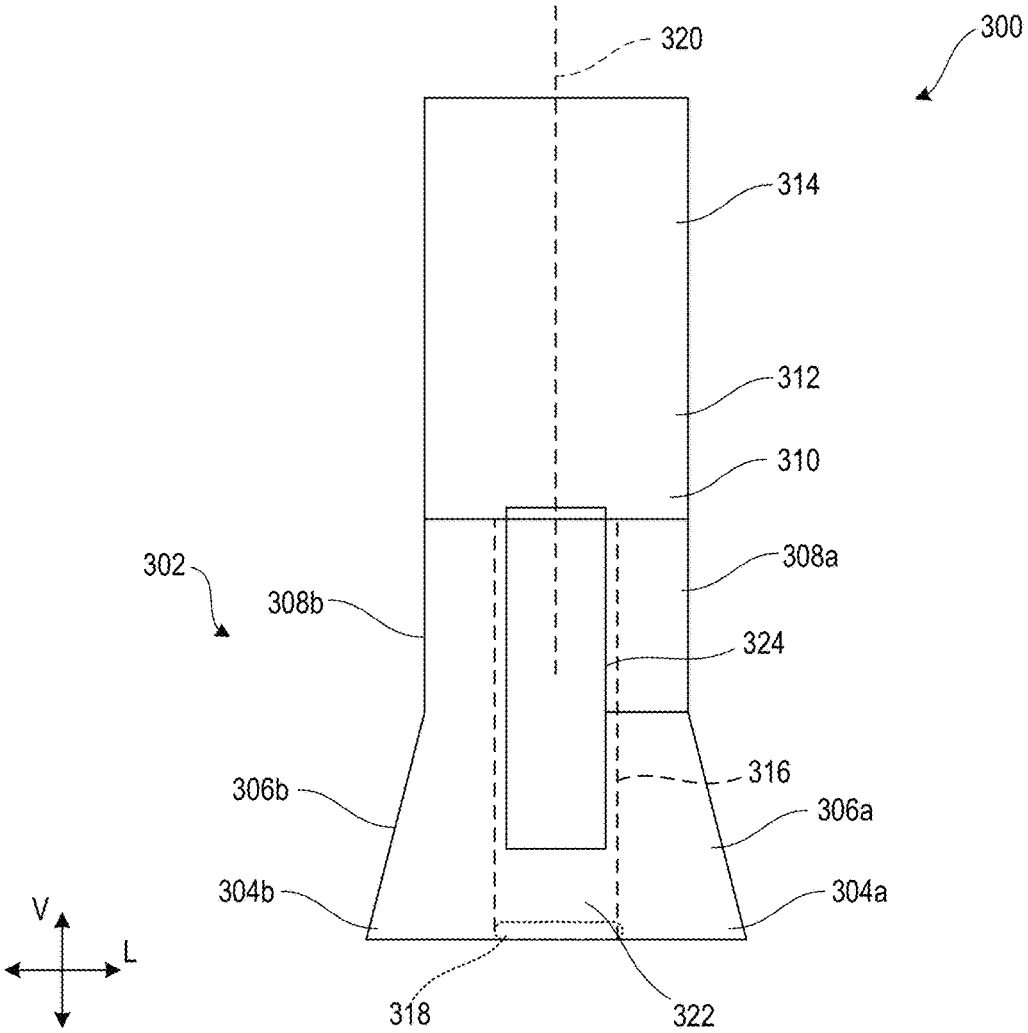
Figure 3C:
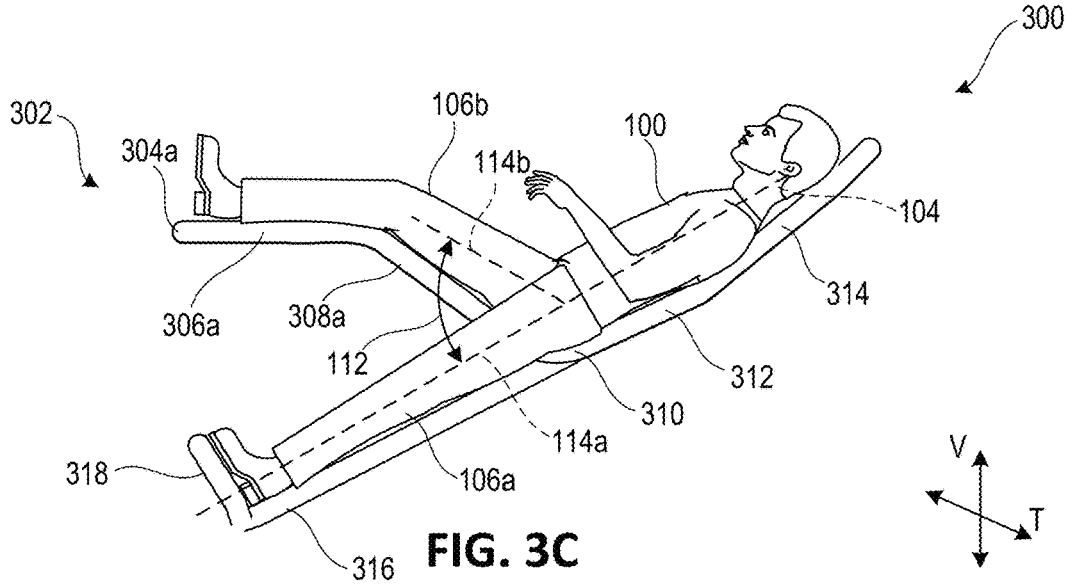
FIGS. 3C-3D are side and front views, respectively, of a user in the chair of FIGS. 3A-3B using one of the outer fixed structures to support the right leg in a forward orientation.
Figure 3D:
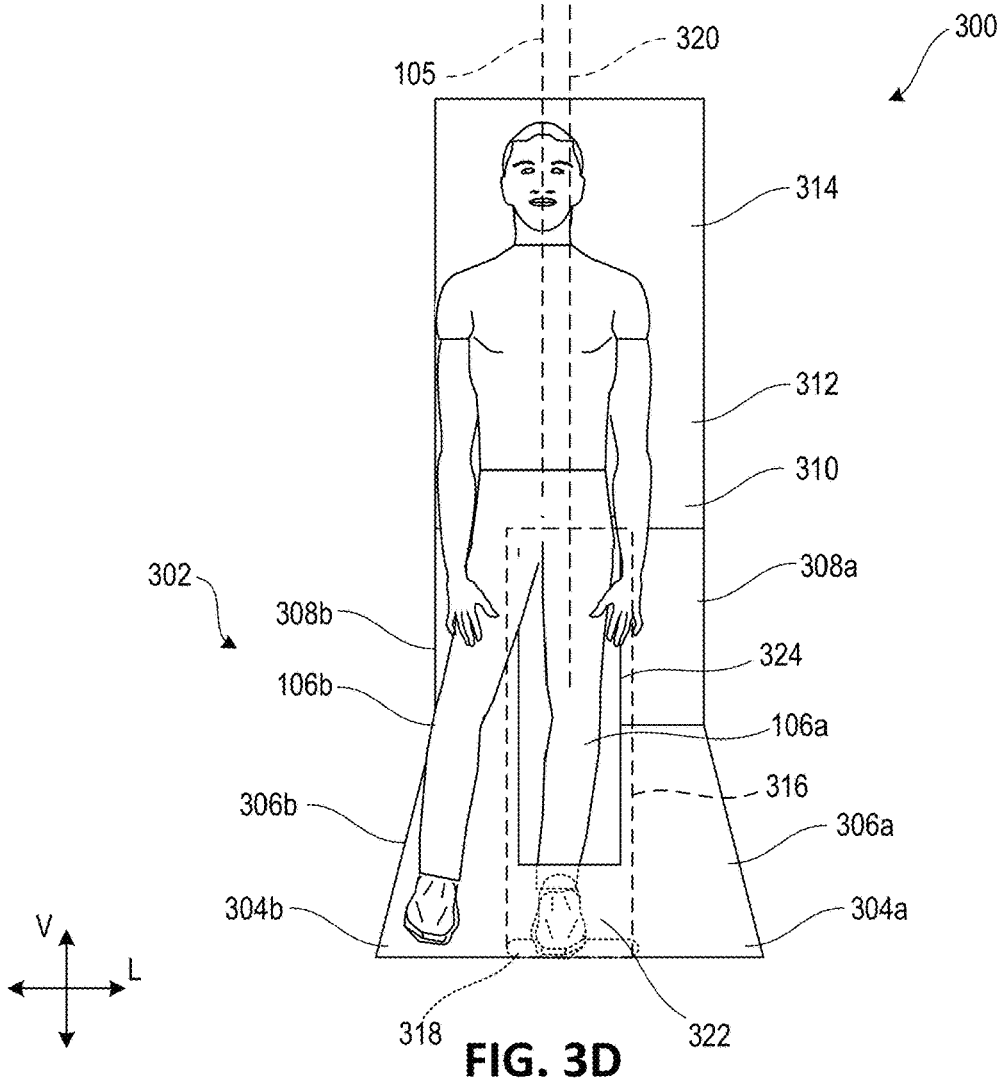
Figure 3E:
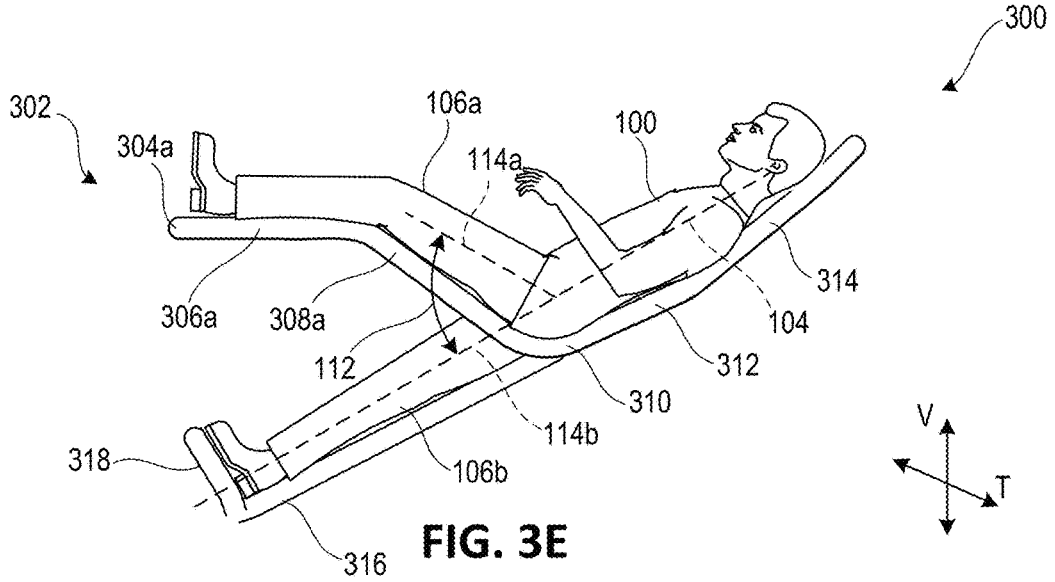
FIGS. 3E-3F are side and front views, respectively, of a user in the chair of FIGS. 3A-3B using the other of the outer fixed structures to support the left leg in a forward orientation.
Figure 3F:
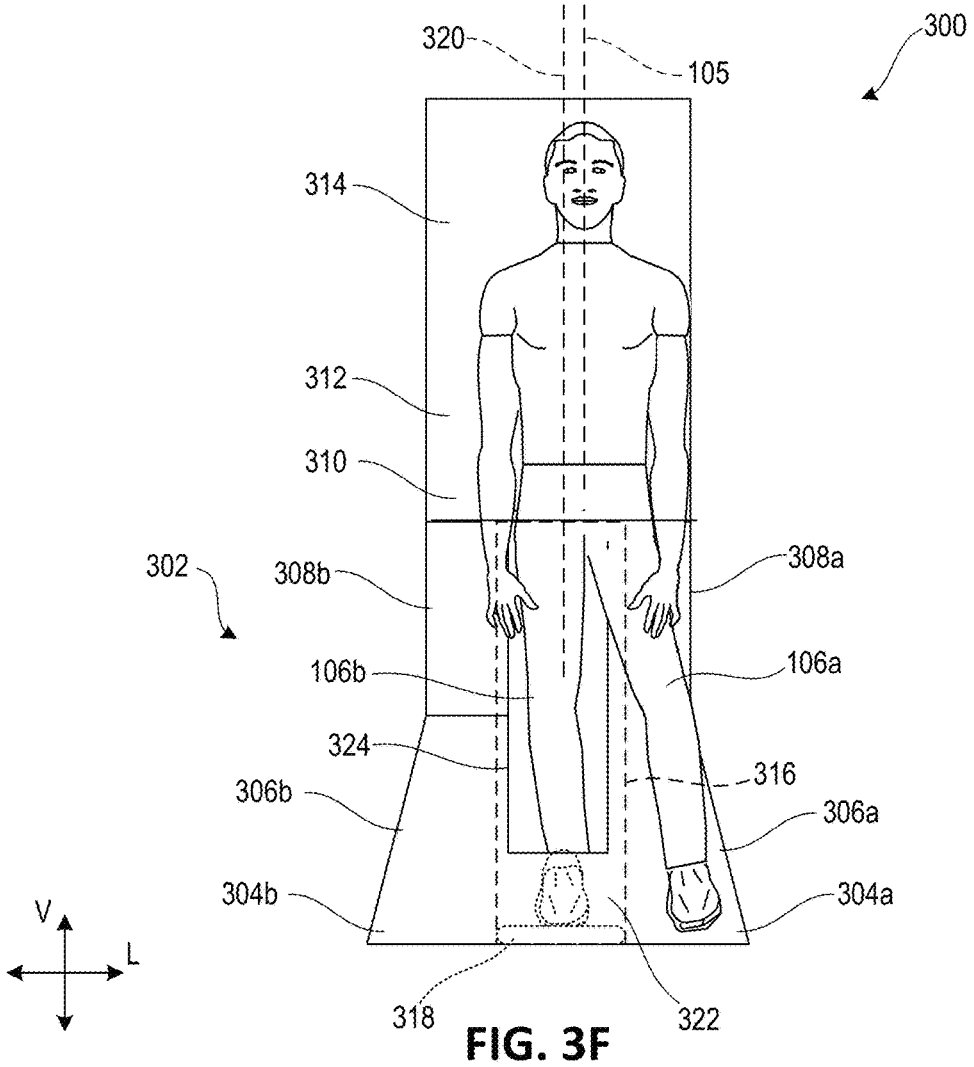

The chair 300 can be supported in an inclined configuration, such that the user 100 can adopt a partly reclined position with respect to the vertical direction. The ergonomic chair 300 can also include a centrally-located secondary leg structure 316 with footrest 318. The secondary leg structure 316 can be aligned with and/or extend from opening 324, so as to support one of the legs 106 of the user 100 when inserted through opening 324. In the illustrated example of FIGS. 3C-3D, the user 100 sits laterally offset toward the right side of the chair 300 (e.g., with center axis 105 of the user 100 offset to the right from a central axis 320 of the chair), such that the right leg 106*b* is supported by right fixed structure 304*b* while the left leg 106*a* is inserted through opening 324 and supported by secondary leg structure 316. The left leg 106*a* and right leg 106*b* are thus supported in an asymmetric configuration, with an angle 112 therebetween, so as to provide at least some stretch to the hip flexor. To stretch the other hip flexor, the user 100 moves to the other side of the chair 300, such that center axis 105 of the user 100 is now offset to the left from central axis 320 of the chair, as shown in FIGS. 3E-3F. The left leg 106*a* is thus supported by the left fixed structure 304*a* while the right leg 106*b* is inserted through opening 324 and supported by second leg structure 316 to provide the asymmetric configuration.

Similar to the chairs illustrated in FIGS. 2A-2B, the ergonomic chair 300 of FIGS. 3A-3F allows the user to adopt a partially-reclined standing configuration with one leg extending through opening 324 partially supporting the weight of the user (e.g., where the back support portions 312, 314 at least partially reduce a weight required to be supported by the extended leg, for example due to friction), while the other leg adopts a supported orientation in front of the user 100. The legs 106*a*, 106*b* thus can easily be arranged in an asymmetric configuration, with the hip flexor of the standing leg (e.g., inserted through opening 324) being extended and/or stretched. In the illustrated example of FIGS. 3A-3F, the opening 324 is sized to allow only one of the user's legs to fit therethrough and has a constant lateral dimension along its length. However, other configurations and arrangements for the opening are also possible according to one or more contemplated embodiments. For example, the opening can have a tailored shape that allows the leg to fit therethrough when the user is a laterally offset position (e.g., with respect to chair central axis 320) but to allow inner portions of fixed structures 304*a*, 304*b* to respectively support the legs in a symmetric configuration when the user is a centrally aligned position (e.g., with user center axis 105 being substantially aligned with chair central axis 320).

FIGS. 4A-4F show another exemplary ergonomic chair 400 with leg support structures 402 for supporting legs 106*a*, 106*b* of a user 100 in asymmetric configurations. The ergonomic chair 400 includes a lower back support portion 414 extending from and integrated with a laterally-extending seat support portion 412, and an upper back support portion 416 extending from and integrated with the lower back support portion 414. The seat support portion 412 can be constructed to contact and/or support buttocks of the user.

Figure 4A:
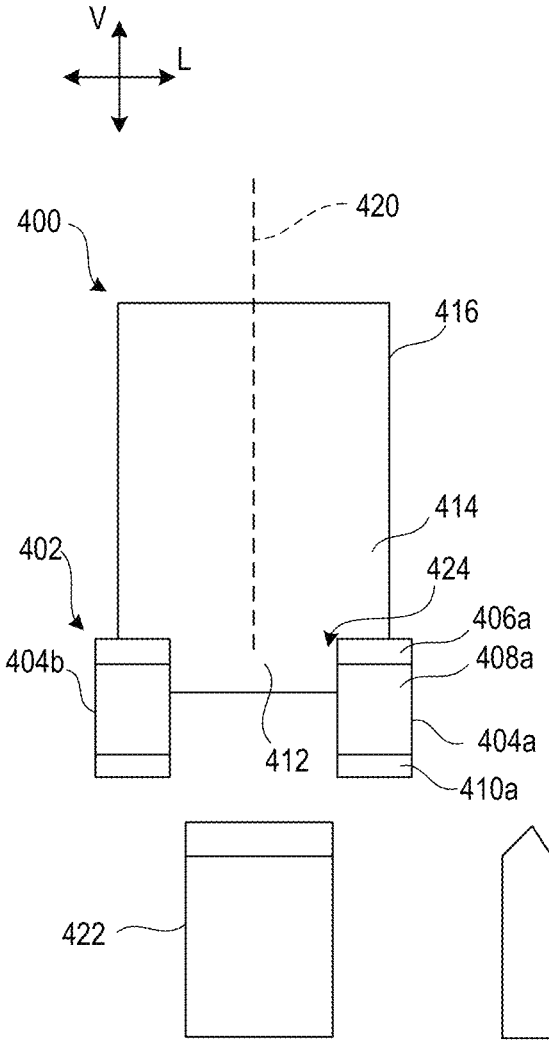
FIGS. 4A-4B are front and side views, respectively, of another exemplary ergonomic chair with laterally outer fixed structures for supporting legs in asymmetric configurations, according to one or more embodiments of the disclosed subject matter.
Figure 4B:
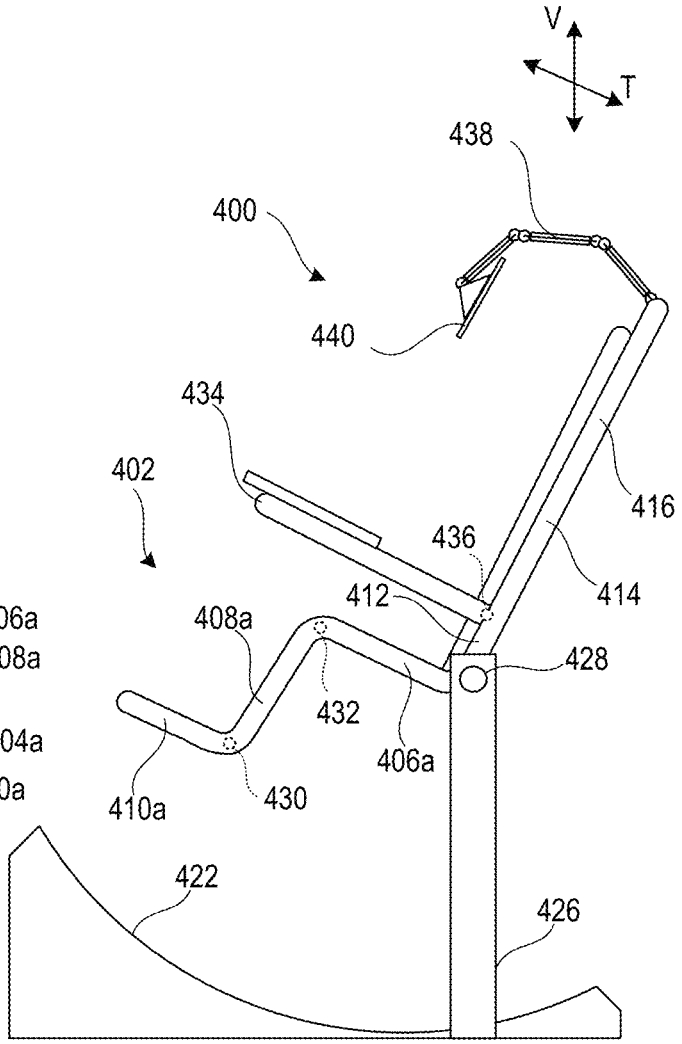
Figure 4C:
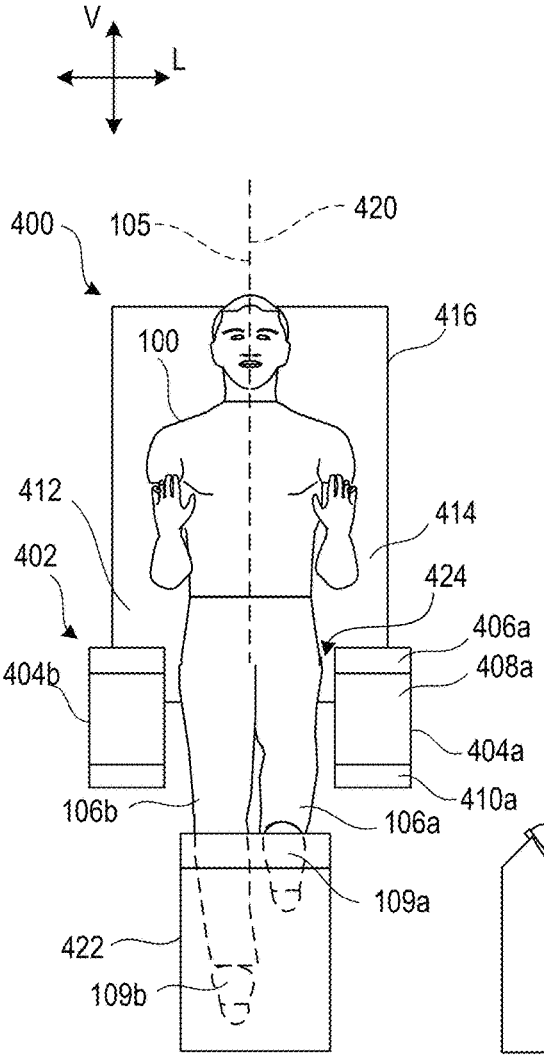
FIGS. 4C-4D are front and side views, respectively, of a user in the chair of FIGS. 4A-4B without using the outer fixed structures.
Figure 4D:
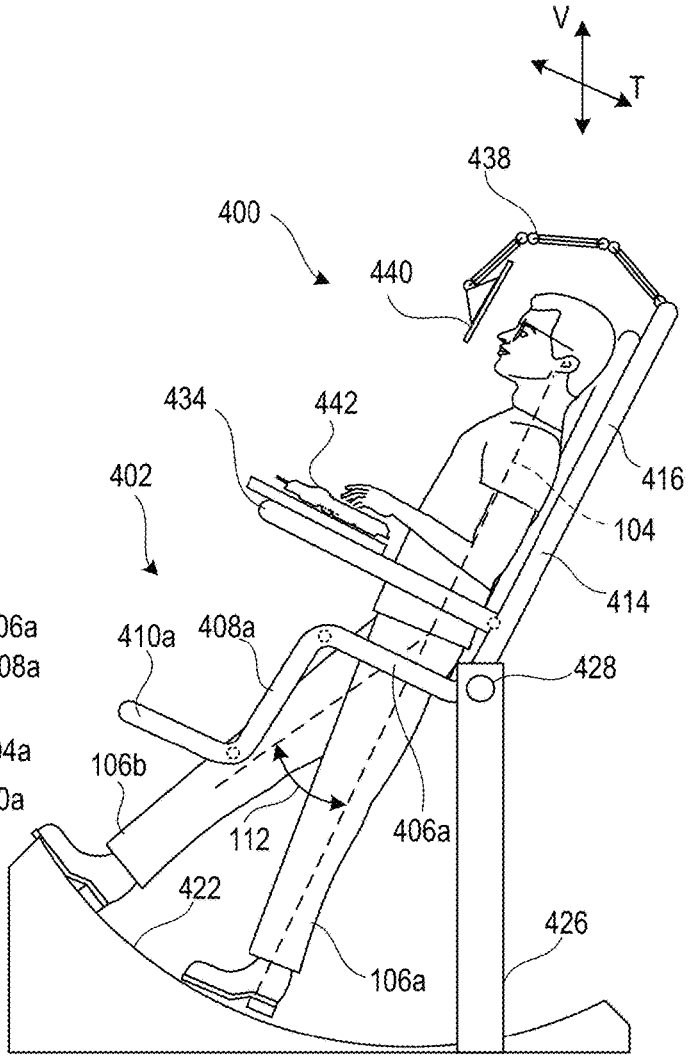

The leg support structures 402 can include laterally-outer fixed structures 404*a*, 404*b* separated by gap 424 sized and shaped to accommodate extension of both legs of the user 100 (e.g., as shown in FIGS. 4C-4D). Each fixed structure 404*a*, 404*b* can extend from (e.g., be coupled to or integrated with) a respective laterally-outer part of the seat support portion 412. For example, the left fixed structure 404*a* can have a thigh support member 406*a*, a shank support member 408*a* extending at an angle from the thigh support member 406*a* (e.g., to define a natural bend for the user's knee), and optionally footrest 410*a*. The right fixed structure 404*b* can have a substantially identical configuration as the left fixed structure 404*a* (e.g., such that the chair 400 is reflection symmetric about central axis 420). In some embodiments, each fixed structure 404*a*, 404*b* can optionally be provided with one or more hinges or pivots 430, 432 to allow adjustment or customization of supported leg position by the user.

A chair support member 426 can be coupled to the seat support portion 412 to support the seat support portion 412 above and with respect to chair base 422, which can have a curved or ramped surface for supporting one or both feet of the user thereon. In some embodiments, seat support portion 412 and/or the leg support structures 402 can be rotatably coupled to the chair support member 426 (e.g., via a hinge or pivot at 428) to allow the user 100 to adopt a partly reclined position with respect to the vertical direction. The chair base 422 can have an arcuate or inclined ramp surface (e.g., centrally located with respect to the chair central axis 420 (e.g., overlapping with gap 424), so as to support one or both legs of the user 100 when extending through the gap 424. Alternatively, in some embodiments, an arcuate or inclined ramp footrest can be provided as a component separate (e.g., independently positionable and/or unconnected) from a chair base.

In the illustrated example of FIGS. 4C-4D, the user sits substantially centered in the chair 400 (e.g., with center axis 105 of the user collinear, or at least crossing, chair central axis 420), such that feet 109*a*, 109*b* of both legs 106*a*, 106*b* are supported by the chair base 422. Moreover, the user 100 can position each foot 109*a*, 109*b* at different positions along the curved surface of the chair base 422, for example, with the left leg 106*a* positioned forward and the right leg 106*b* aligned with the user central plane 104 as in FIG. 4C, or with the right leg 106*b* positioned forward and the left leg 106*a* aligned with the user central plane 104 as in FIG. 4D Alternatively or additionally, the user 100 can position one leg rearward while the other leg is aligned with the central plane, for example, with the left leg 106*a* aligned with the user central plane 104 and the right leg 106*b* positioned rearward as in FIG. 4G. Alternatively or additionally, the user 100 can position one leg forward and one leg rearward, for example, with the left leg 106*a* forward (e.g., defining a first angle, a, with respect to user central plane 104) and right leg 106*b* rearward (e.g., defining a second angle, w, with respect to user central plane 104, which may the same or different than the first angle).

Figure 4E:
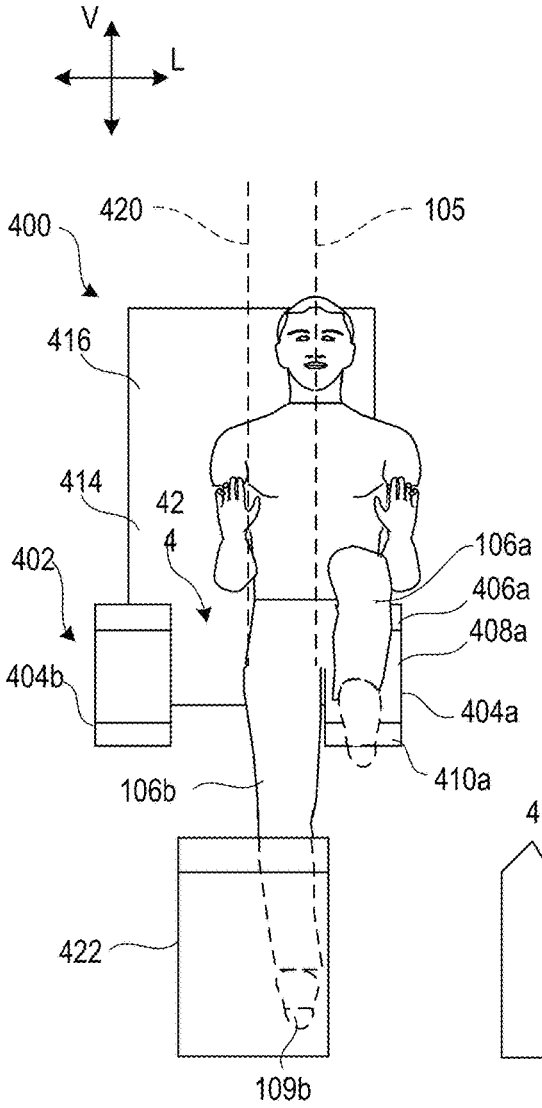
FIGS. 4E-4F are front and side views, respectively, of a user in the chair of FIGS. 4A-4B using one of the outer fixed structures to support the left leg in a forward orientation.
Figure 4F:
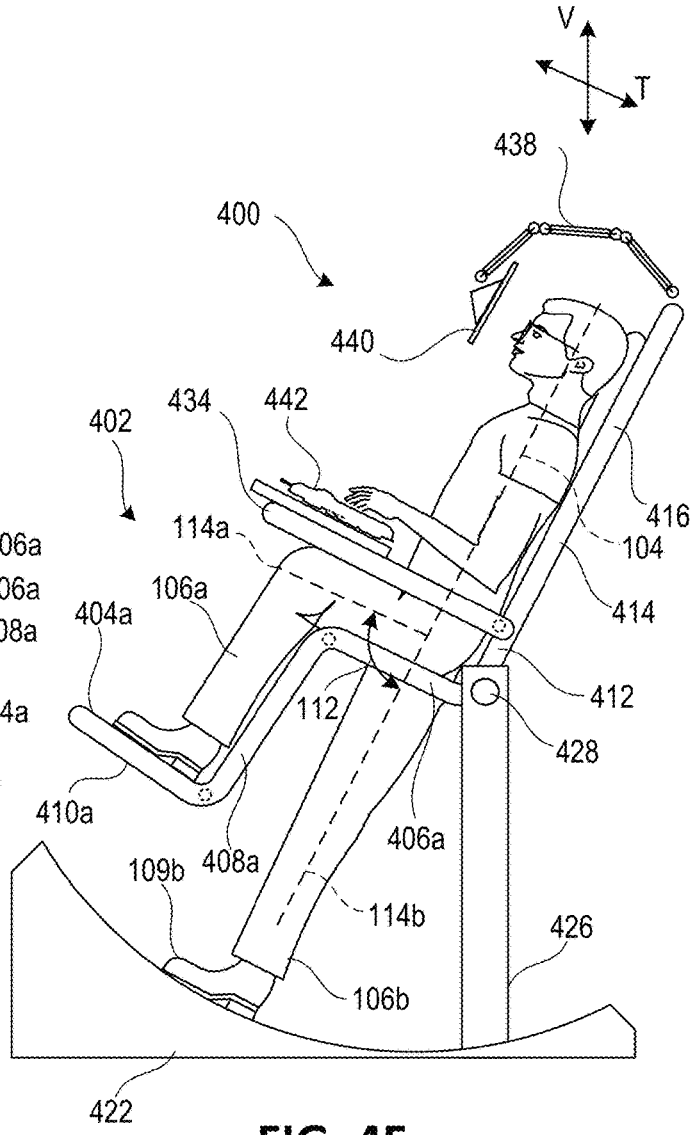
Figure 4G:
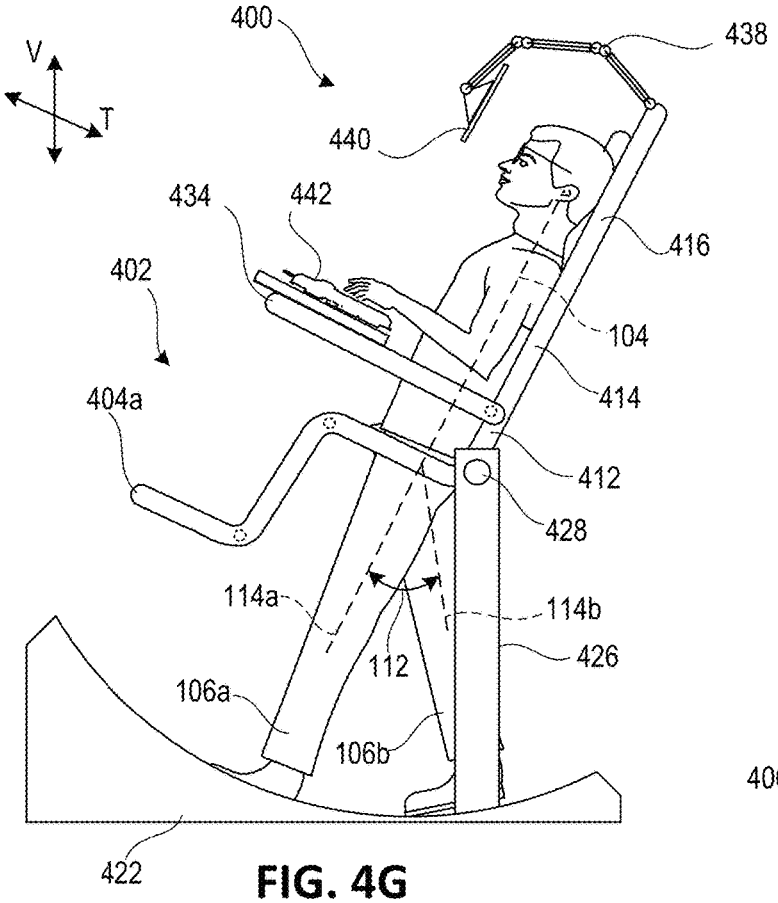
FIGS. 4G-4H are side views of a user in the chair of FIGS. 4A-4B achieving different orientations for the legs without using the outer fixed structures.
Figure 4H:
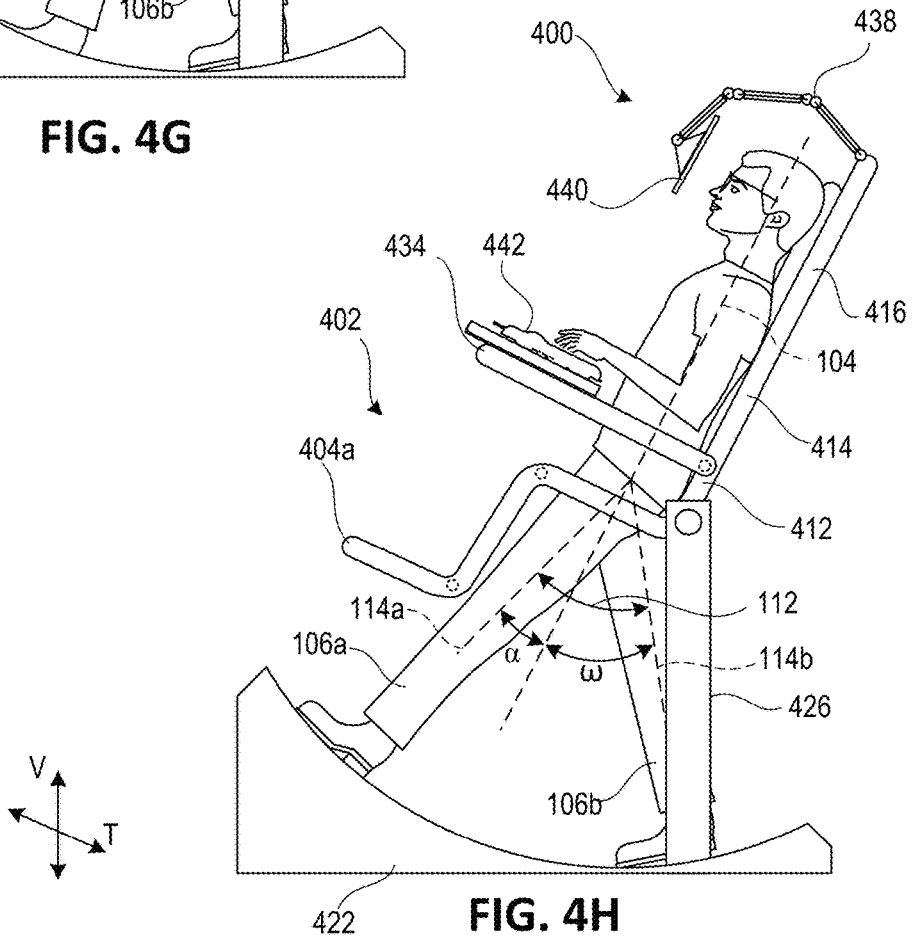
Figure 4I:
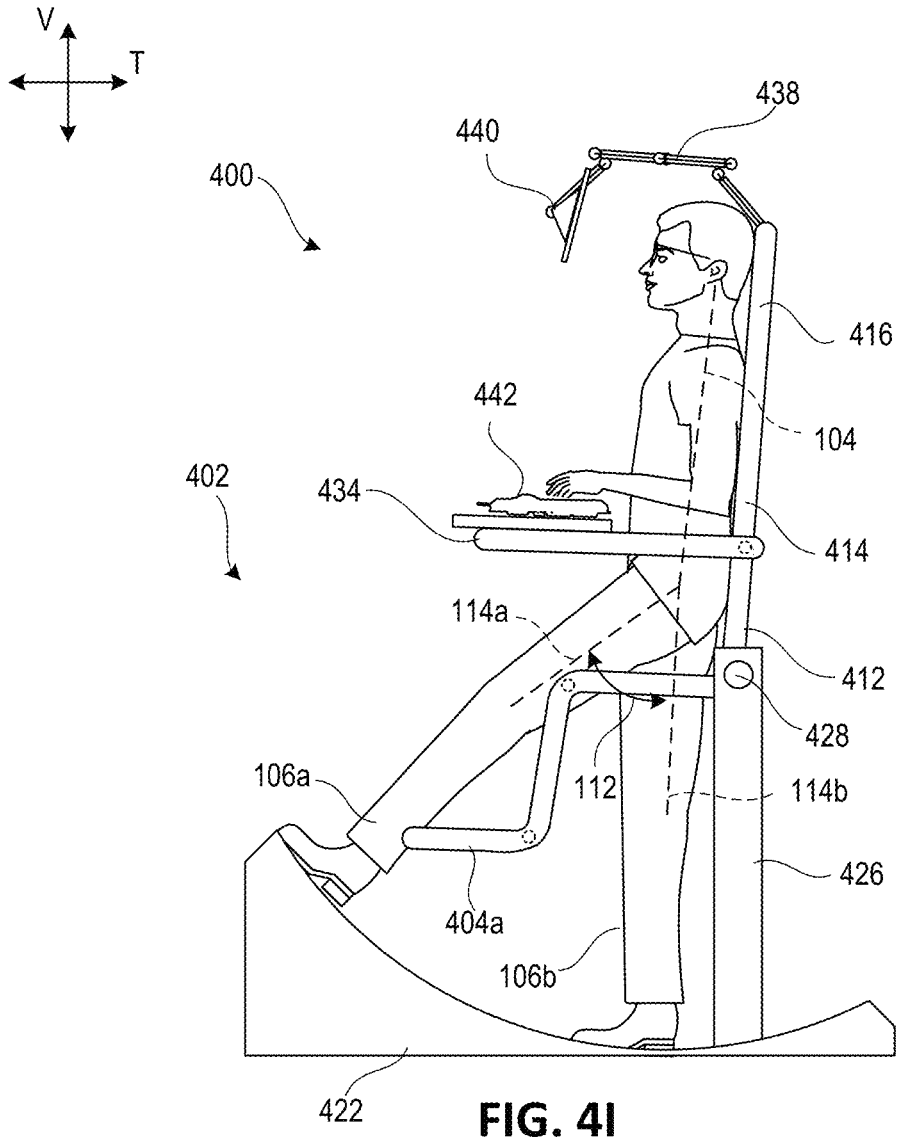

In the illustrated example of FIGS. 4E-4F, the user 100 sits laterally offset toward the left side of the chair 400 (e.g., with center axis 105 of the user 100 offset to the left from a central axis 420 of the chair) such that the left leg 106*a* is supported by left fixed structure 404*a* while the right leg 106*b* extends through gap 424 with foot 109*b* on the chair base 422. The left leg 106*a* and right leg 106*b* are thus supported in an asymmetric configuration, with an angle 112 therebetween, so as to provide at least some stretch to the hip flexor. To stretch the other hip flexor, the user 100 can move to the other side of the chair 400, such that center axis 105 of the user 100 is now offset to the right from central axis 420 of the chair.

Using the arcuate surface of chair base 422, the user 100 can thus position the legs 106*a*, 106*b* in various symmetric and asymmetric configurations, even when the user sits in the center of the chair 400. For example, the legs 106*a*, 106*b* in asymmetric configurations can have angles 112 of 30°-75°, inclusive, when the user is positioned in the center of the chair (e.g., as shown in FIGS. 4C-4D and 4G-4H). Using either of fixed structures 404*a*, 404*b* and the arcuate surface of chair base 422, the user 100 can position legs 106*a*, 106*b* in further asymmetric configurations, for example, having an angle of 30°-90°, inclusive (e.g., at least 75° when one leg is aligned with the user central plane 104), when the user is positioned offset from the center of the chair (e.g., as shown in FIGS. 4E-4F).

When employing one of the fixed structures 404*a*, 404*b*, the user 100 can be partially supported in a manner similar to a zero-gravity chair. For example, as shown in FIGS. 4E-4F, the left half of the user is supported by fixed structure 404*a* (in combination with seat support portion 412, lower back support portion 414, and upper back support portion 416), while the right half of the user 100 adopts a partly-reclined standing configuration at least partially supported by right leg 106*b* (e.g., where the back support portions 414, 416 at least partially reduce a weight required to be supported by extended leg 106*b*). Moreover, the user can further change position of the body in the chair by changing an inclination angle of the chair, e.g., by rotating back support portions 414, 416 and structures extending therefrom about hinge 428. For example, as shown in FIG. 41, the chair 400 can be reoriented to support the user in a substantially upright (e.g., standing) orientation. Thus, the user 100 can adopt any number of customized body positions and leg configurations in the chair to stretch various muscles (e.g., hip flexors) and/or periodically change pressure points to maximize, or at least improve, user comfort.

Ergonomic chair 400 can further include one or more additional structures that allow the chair to be used as a computing workstation, for example. Such additional structures can be integrated with or connected to the back support portions 414, 416 or any other component of the chair. For example, the ergonomic chair 400 can optionally include desk surface 434 coupled to the seat support portion 412 by a rotating hinge or pivot 436, which allows the desk surface to be rotated into or out of position (e.g., to allow ingress or egress of the user 100). The desk surface 434 can support one or more computing input/output devices thereon, for example, a wireless keyboard 442 and/or wireless mouse (not shown). Alternatively or additionally, the desk surface 434 can support a laptop or tablet computer thereon.

Alternatively or additionally, in some embodiments, the ergonomic chair 400 can optionally include a monitor 440 supported by an overhead support frame 438. In some embodiments, the monitor 440 can be of reduced size and/or weight to allow for overhead support, for example, by using a tablet-sized monitor of high resolution. Indeed, one of the reasons conventional zero-gravity chairs tend to be so massive is to support a full-size monitor on the chair. In contrast, ergonomic chair 400 employ a smaller monitor to reduce the corresponding support requirements, thereby allowing the ergonomic chair 400 to be less massive and more portable than conventional zero-gravity chairs. In some embodiments, a user can wear magnifying glasses to permit focusing on the smaller monitor as if it were further away, thereby providing a similar viewing experience as that of a larger monitor.

Figure 5A:
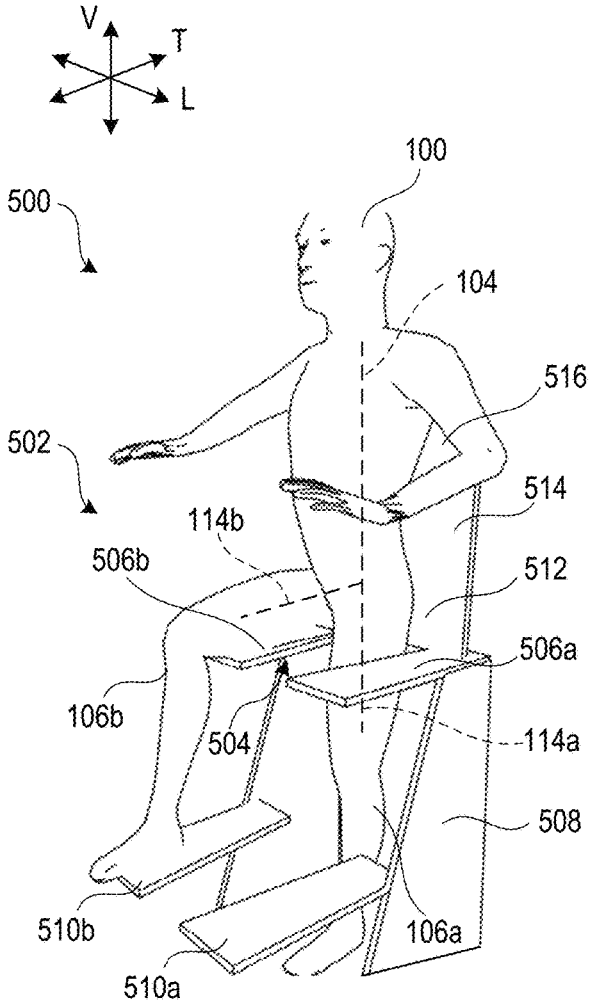
FIG. 5A is a perspective view of a user in another exemplary ergonomic chair using one of laterally outer fixed structures to support the right leg in a bent forward orientation while the left leg adopts a straightened orientation aligned with the body, according to one or more embodiments of the disclosed subject matter.

FIG. 5A shows another exemplary ergonomic chair 500 with fixed support structures 502 for supporting legs 106*a*, 106*b* of a user 100 in asymmetric configurations. The fixed support structures 502 can include laterally-outer fixed structures separated by a lateral gap 504. For example, each laterally-outer fixed structure can have a thigh support member 506*a*, 506*b* (e.g., also acting as a seat support portion to contact and/or support a buttock of the user 100) and a footrest 510*a*, 510*b*. Each thigh support member 506*a*, 506*b* can extend from (e.g., be coupled to or integrated with) a respective lateral end portion of a buttocks contact region 512 of lower back support portion 514. The ergonomic chair 500 can further include an upper back support portion 516 extending from and integrated with the lower back support portion 514. Lateral support frames 508 can connect to and/or be integrated with the footrests 510*a*, 510*b*, the thigh support members 506*a*, 506*b*, and/or the lower back support portion 514, for example, to support the chair 500 on a floor in an upright orientation (as shown in FIG. 5A) or an inclined orientation (not shown). For example, each thigh support member 506*a*, 506*b* and/or each footrest 510*a*, 510*b* can extend substantially horizontal from the respective lateral support frame 508.

In the illustrated example of FIG. 5A, the user 100 sits laterally offset toward the right side of the chair 500 with the right leg 106*b* supported by right thigh support member 506*b* and right footrest 510*b*, while the left leg 106*a* extends through gap 504 (e.g., not in contact with either fixed support structure) to have a substantially aligned orientation with the central plane 104 of the user. The left leg 106*a* and right leg 106*b* are thus supported in an asymmetric configuration, with an angle therebetween, so as to provide at least some stretch to the hip flexor. The user 100 can move along the lateral direction to the opposite side of the chair 500 to position the left leg 106*a* on the left thigh support member 506*a* and left footrest 510*a*, while the right leg 106*b* extends through gap 504 (e.g., not in contact with either fixed support structure) to allow stretching of the other hip flexor in a similar manner.

Figure 5B:
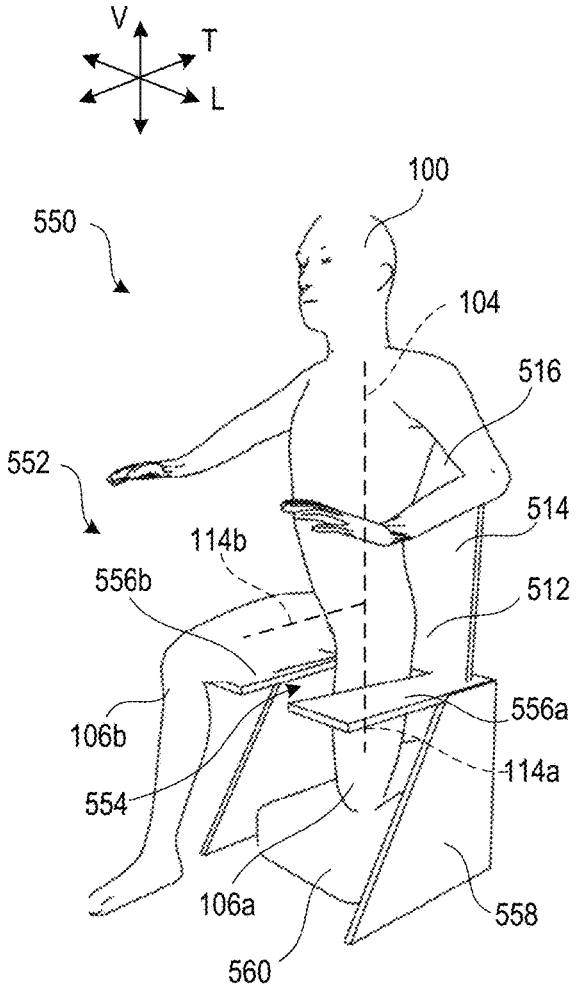
FIG. 5B is a perspective view of a user in another exemplary ergonomic chair using one of laterally outer fixed structures to support the right leg in a bent forward orientation while the left leg adopts a bent orientation aligned with the body, according to one or more embodiments of the disclosed subject matter.

FIG. 5B shows another exemplary ergonomic chair 550 with fixed support structures 552 for supporting legs 106*a*, 106*b* of a user 100 in asymmetric configurations. The fixed support structures 552 can include laterally-outer fixed structures separated by a lateral gap 554. For example, each laterally-outer fixed structure can have a thigh support member 556*a*, 556*b* (e.g., also acting as a seat support portion to contact and/or support a buttock of the user 100) extending extend from (e.g., be coupled to or integrated with) a respective lateral end portion of a buttocks contact region 512 of lower back support portion 514. Without footrests, the lateral support frames 558 can be sized and shaped to allow the user 100 to position the foot flat on the floor when the corresponding leg is otherwise supported by a respective one of the thigh support members 556*a*, 556*b*, as shown in FIG. 5B. In addition, the central leg inserted through gap 554 also adopts a bent configuration (e.g., kneeling), such that at least the thigh thereof can be substantially aligned with the central plane 104 of the user. In some embodiments, the chair 550 can include a kneeling cushion 560 (e.g., knee pad) to support at least the knee and/or shank of the central leg 106 of the user. Otherwise, the ergonomic chair 550 can be substantially similar in structure and operation to chair 500 of FIG. 5A.

FIGS. 6A-6D shows another exemplary ergonomic chair 600 with fixed structures for supporting a user with legs in asymmetric configurations. The ergonomic chair 600 can include a backrest 602 (e.g., with an optional contoured cushion or bladder 620 integrated therewith or coupled thereto), a centrally-located seat support portion 604 (e.g., also acting as a thigh support member), a support frame 608, and leg resting pads 610*a*, 610*b* on opposite lateral sides of the seat support portion 604. In some embodiments, for example, the seat support portion 604 can be sized to support at least a single buttock but less than both buttocks of the user. Each leg resting pad 610*a*, 610*b* can be coupled to the support frame 608 and arranged with respect to the seat support portion 604 to support a shank 108 of a leg 106 of the user when a thigh 107 thereof extends through a corresponding lateral recessed space 606. The backrest 602 can optionally include armrest 612*a*, 612*b* to support elbows and/or forearms of the user, for example, to help users to better support their bodyweight due to any imbalance caused by the stance required by the user when in an offset position with respect to the central axis 614 of the chair 600.

Figure 6A:
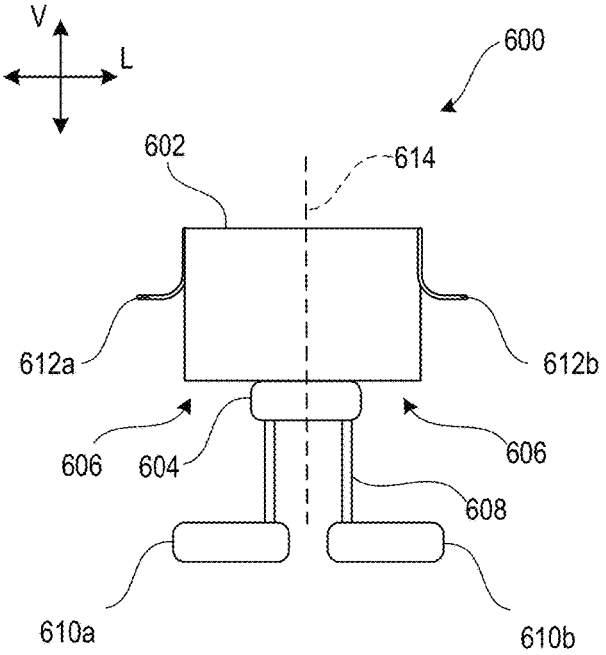
FIG. 6A is a back view of another exemplary ergonomic chair with laterally outer fixed structures for supporting legs in asymmetric configurations, according to one or more embodiments of the disclosed subject matter.
Figure 6B:
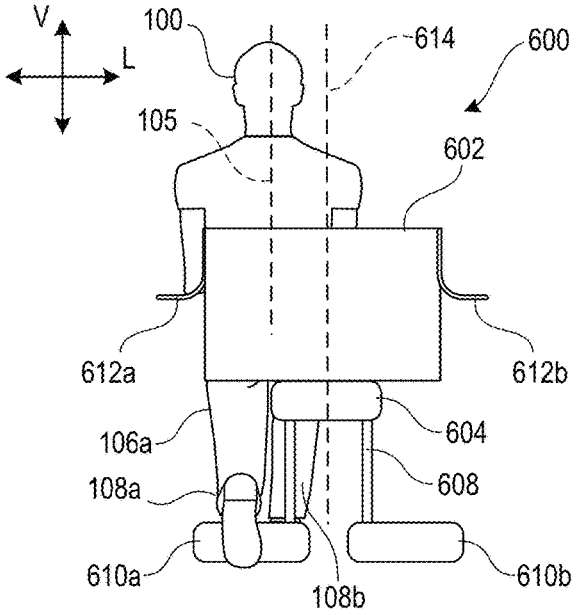
FIGS. 6B, 6C, and 6D are rear, right side, and left side views, respectively, of a user in the chair of FIG. 6A using one of the outer fixed structures to support the right leg in an aligned or rearward orientation.
Figure 6C:
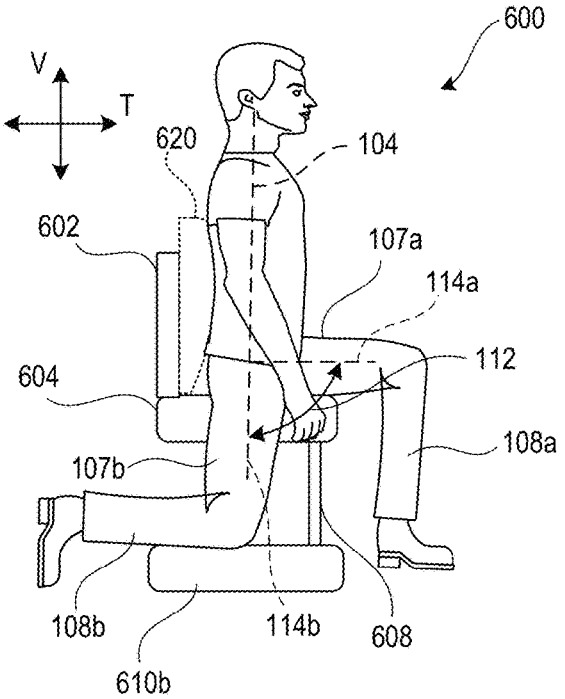
Figure 6D:
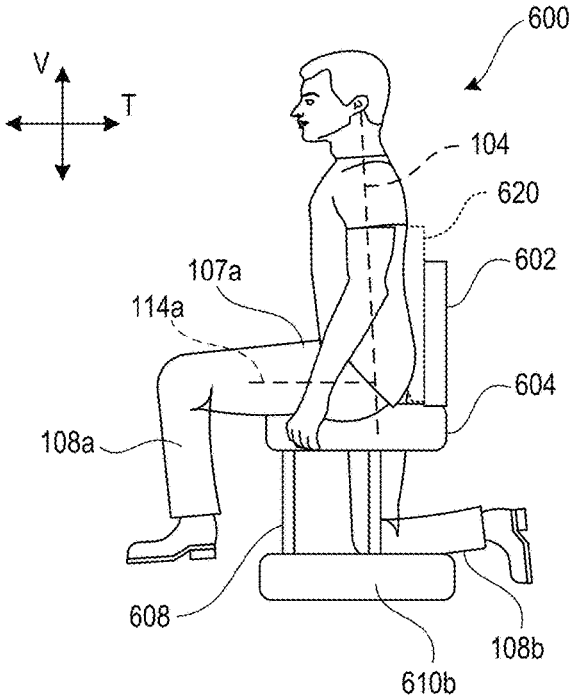

In the illustrated example of FIG. 6B, the user 100 sits laterally offset (with user center axis 105 offset from chair central axis 614) toward the left side of the chair 600 with the left leg 106*a* extending through recessed space 606 to adopt a bent configuration (e.g., with thigh 107*a* being substantially aligned with central plane 104 of the user and with shank 108*a* supported on resting pad 610*a*) and with the right leg 106*b* supported by seat support portion 604 in a forward orientation with a bent configuration. Alternatively, in some embodiments, the left leg 106*a* can be positioned further rearward, e.g., such that the thigh 107*a* is angled rearward of the user central plane 104, for example, to hyperextension of the corresponding hip flexor. The left leg 106*a* and right leg 106*b* are thus supported in an asymmetric configuration, with an angle 112 therebetween, so as to provide at least some stretch to the hip flexor. The user 100 can move along the lateral direction to the opposite side of the chair 600 to position the left leg 106*a* on the central seat support portion 604 and to position the right leg 106*b* extending through the opposite recessed space 606, for example, as shown in FIGS. 6C-6D, to allow stretching of the other hip flexor in a similar manner.

Figure 7A:
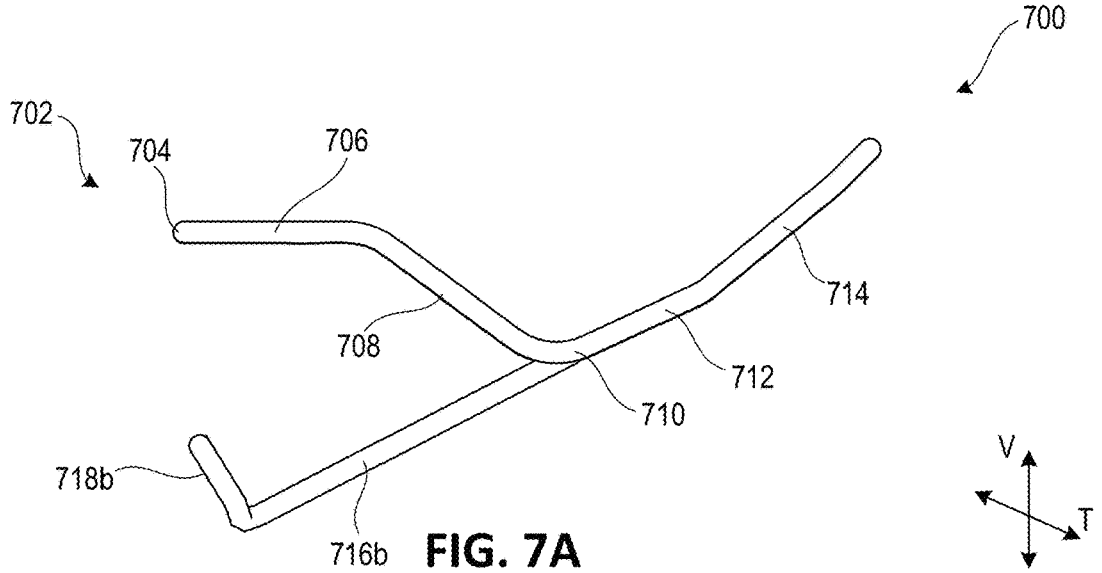
FIGS. 7A-7B are side and front views, respectively, of another exemplary ergonomic chair with a central fixed structure for supporting legs in asymmetric configurations, according to one or more embodiments of the disclosed subject matter.
Figure 7B:
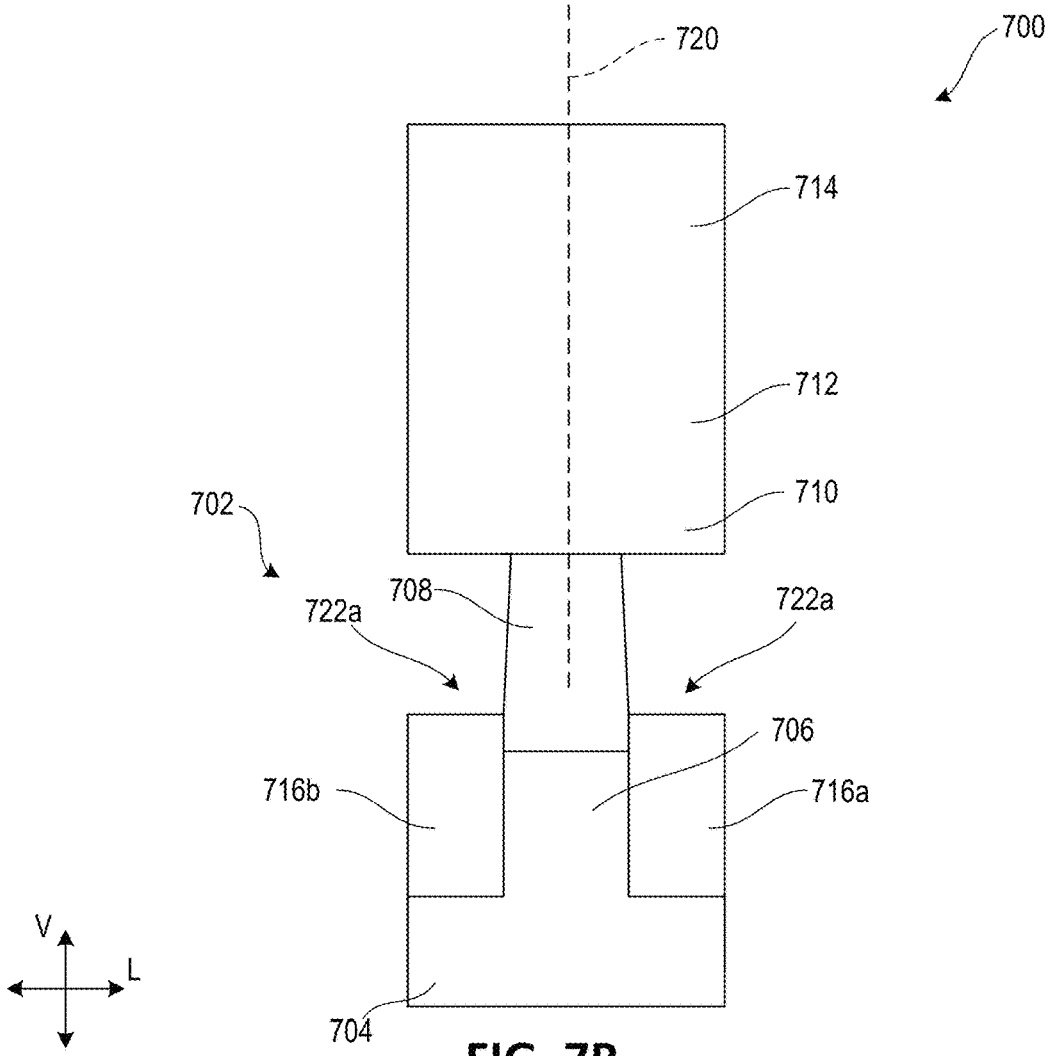
Figure 7C:
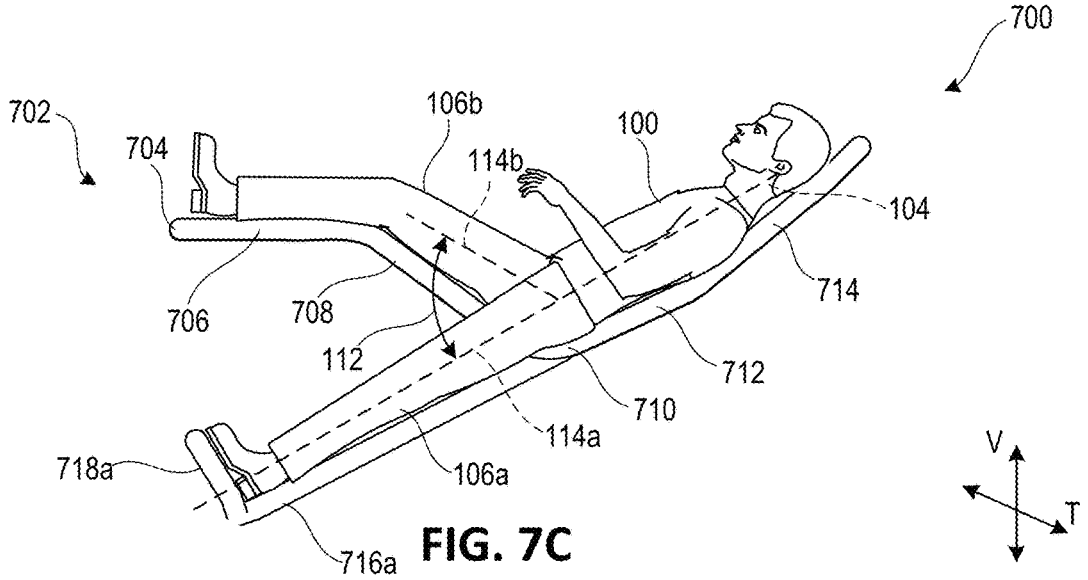
FIGS. 7C-7D are side and front views, respectively, of a user in the chair of FIGS. 7A-7B using the central fixed structure to support the right leg in a forward orientation.
Figure 7D:
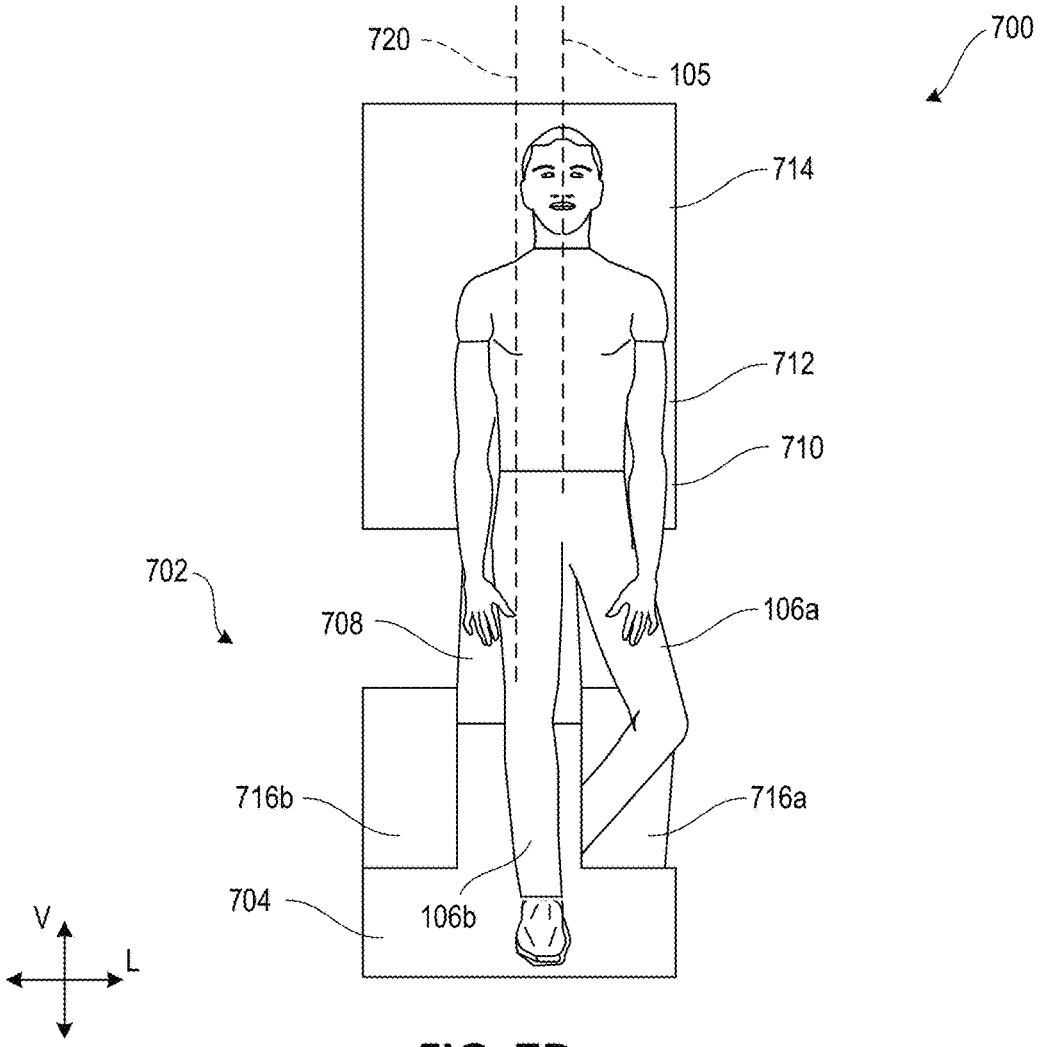

FIGS. 7A-7D show another exemplary ergonomic chair 700 with a fixed structure 702 for supporting legs 106*a*, 106*b* of a user 100 in asymmetric configurations. The ergonomic chair 700 includes a lower back support portion 712 extending from and integrated with a laterally-extending seat support portion 710, and an upper back support portion 714 extending from and integrated with the lower back support portion 712. The fixed structure 702 can include a centrally-arranged leg support structure 704 disposed between right and left recessed portions 722*a*, 722*b* that are sized and shaped to accommodate extension of at least one leg therethrough. The leg support structure 704 can extend from and be integrated with seat support portion 710. The leg support structure 704 can have a thigh support member 708 and a shank support member 706 extending at an angle from the thigh support member 708 (e.g., to define a natural bend for the user's knee). In some embodiments, lateral edges of the leg support structure 704 at a top end thereof can be disposed between lateral edges of the seat support portion 710, while lateral edges of the leg support structure 704 at a bottom end thereof may be disposed further outward from the central axis 720 of the chair 700, for example, as shown in FIG. 7B.

The chair 700 can be supported in an inclined configuration, such that the user 100 can adopt a partly reclined position with respect to the vertical direction. The ergonomic chair 700 can also include a pair of secondary leg structures 716*a*, 716*b* with respective footrests 718*a*, 718*b*. Each secondary leg structure 716*a*, 716*b* can be aligned with respective recess 722*a*, 722*b*, so as to support one of the legs 106 of the user 100 when inserted through the recess. In the illustrated example of FIGS. 7C-7D, the user 100 sits laterally offset toward the left side of the chair 700 (e.g., with center axis 105 of the user 100 offset to the left from a central axis 720 of the chair), such that the right leg 106*b* is supported by central leg support structure 704 while the left leg 106*a* is inserted through recess 722*a* and supported by left secondary leg structure 716*a*. The left leg 106*a* and right leg 106*b* are thus supported in an asymmetric configuration, with an angle 112 therebetween, so as to provide at least some stretch to the hip flexor. To stretch the other hip flexor, the user 100 moves to the other side of the chair 700, such that center axis 105 of the user 100 is now offset to the right from central axis 720 of the chair to provide the opposite asymmetric leg configuration in a similar manner.

Similar to the chairs illustrated in FIGS. 2A-2B and 3A-3F, the ergonomic chair 700 of FIGS. 7A-7D allows the user to adopt a partially-reclined standing configuration with one leg extending through one of the recesses 722*a*, 722*b* partially supporting the weight of the user (e.g., where the back support portions 712, 714 at least partially reduce a weight required to be supported by the extended leg, for example due to friction), while the other leg adopts a supported orientation in front of the user 100. The legs 106*a*, 106*b* thus can easily be arranged in an asymmetric configuration, with the hip flexor of the standing leg (e.g., extending through one of the recesses 722*a*, 722*b*) being extended and/or stretched.

Figure 8A:
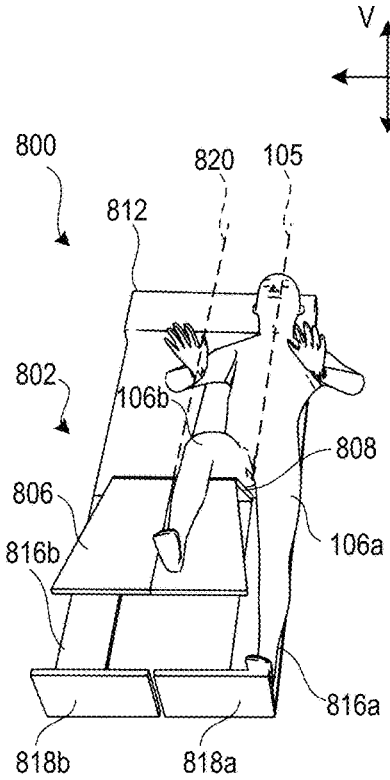
FIGS. 8A-8C are front views of a user in another exemplary ergonomic chair with a central fixed structure for supporting legs in asymmetric configurations, according to one or more embodiments of the disclosed subject matter.
Figure 8B:
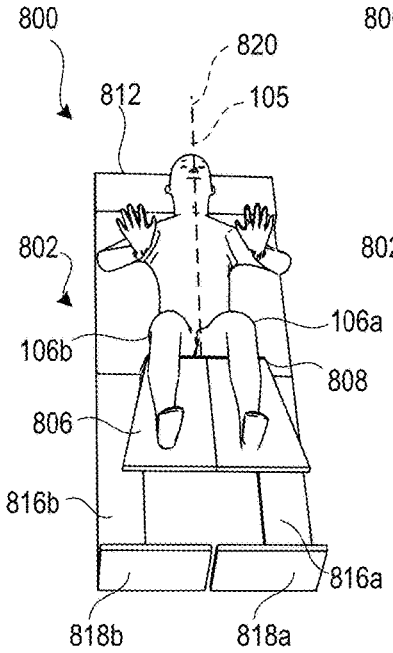

FIGS. 8A-8D show another exemplary ergonomic chair 800 with fixed structures 802 for supporting legs 106*a*, 106*b* of a user 100 in asymmetric configurations. The ergonomic chair 800 includes a backrest 812 and a pair of secondary leg structures 816*a*, 816*b* extending from (or integrated with) a bottom end portion of the backrest 812. Each secondary leg structure 816*a*, 816*b* can include a respective footrest 818*a*, 818*b* extending from a bottom end thereof. The fixed structures 802 can include a centrally-arranged leg support structure, for example, a thigh support member 808 (e.g., which also acts as a seat support portion) and a shank support member 806 extending at an angle from the thigh support member 808 (e.g., to define a natural bend for the user's knee). For example, the thigh support member 808 can be sized and shaped to support both buttocks of the user simultaneously, for example, as shown in FIG. 8B.

Figure 8C:
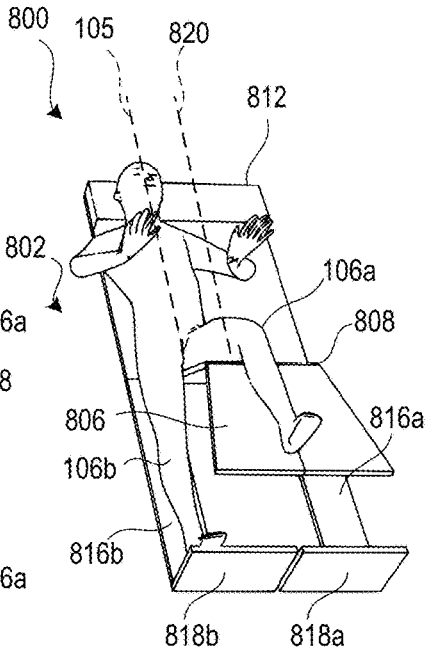
Figure 8D:
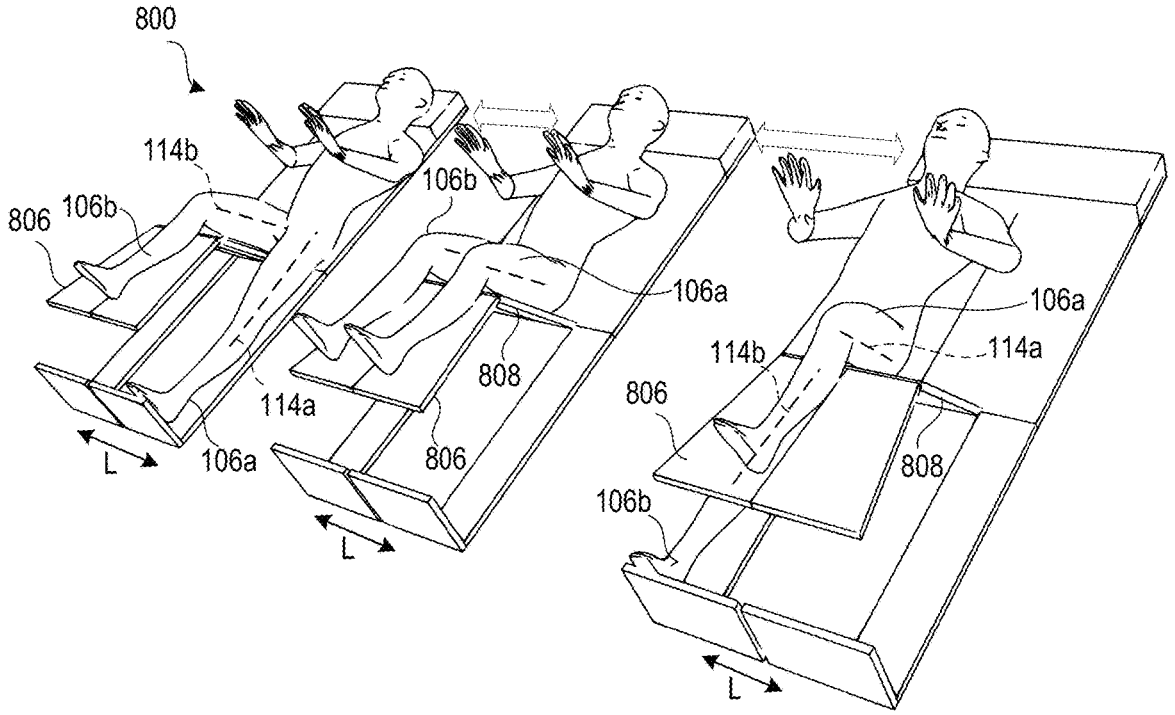
FIG. 8D is a perspective view of the user in the various configurations of FIGS. 8A-8C.

The chair 800 can be supported in an inclined configuration, such that the user 100 can adopt a partly reclined position with respect to the vertical direction. In the illustrated example of FIGS. 8A and 8D, the user 100 sits laterally offset toward the left side of the chair 800 (e.g., with center axis 105 of the user 100 offset to the left from a central axis 820 of the chair), such that the right leg 106*b* is supported by thigh support member 808 and shank support member 806, while the left leg 106*a* is supported by left secondary leg structure 816*a*. The left leg 106*a* and right leg 106*b* are thus supported in an asymmetric configuration so as to provide at least some stretch to the hip flexor. To stretch the other hip flexor, the user 100 moves to the other side of the chair 800, as shown in FIGS. 8C and 8D, such that center axis 105 of the user 100 is now offset to the right from central axis 820 of the chair to provide the opposite asymmetric leg configuration in a similar manner. In the illustrated example of FIG. 8B, the user can sit substantially centered in the chair 800 (e.g., with center axis 105 of the user collinear with, or at least crossing, chair central axis 820), such that both legs 106*a*, 106*b* are supported by the thigh support member 808 and shank support member 806.

Figures 8E, 8F, 8G:
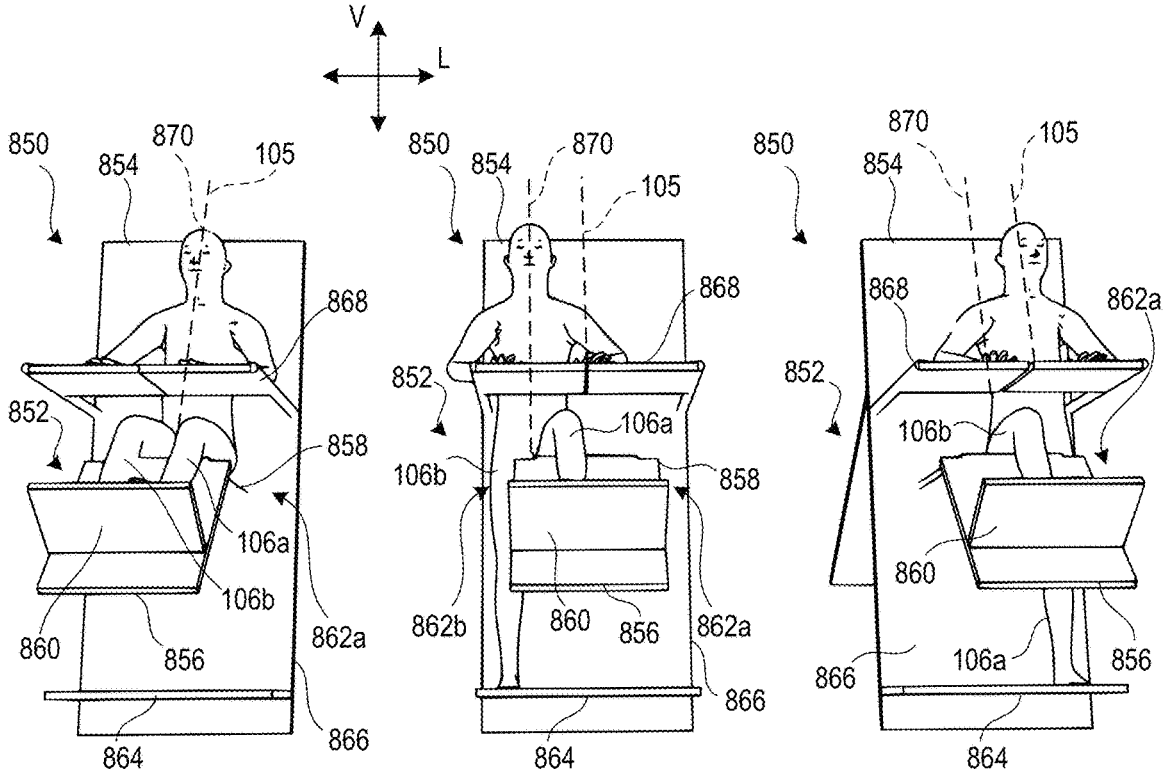
FIGS. 8E-8G are front views of a user in a variation of the ergonomic chair of FIGS. 8A-8D, according to one or more embodiments of the disclosed subject matter.

FIGS. 8E-8H show another exemplary ergonomic chair 850 with fixed structures 852 for supporting legs 106*a*, 106*b* of a user 100 in asymmetric configurations. The ergonomic chair 850 includes a rear frame member 866 that defines a pair of laterally-outer secondary leg structures and a backrest portion 854. The rear frame member 866 can include a footrest 864 that extends across a lateral width of the chair. Alternatively, footrest 864 can be divided into separate parts that align with recessed portions 862*a*, 862*b*, through which an outer leg of the user can be positioned. The fixed structures 852 can include a centrally-arranged leg support structure, for example, a thigh support member 858 (e.g., which also acts as a seat support portion) and a shank support member 856 extending at an angle from the thigh support member 858 (e.g., to define a natural bend for the user's knee). For example, the thigh support member 858 can be sized and shaped to support both buttocks of the user simultaneously, for example, as shown in FIG. 8E. Optionally, a footrest 860 can extend from (e.g., be integrated with and/or coupled to) an end portion or intermediate portion of the shank support member 856, and/or a desk surface 868 can extend from (e.g., be integrated with and/or coupled to) the backrest portion 854. In some embodiments, the desk surface 868 and/or the footrest 860 can be positionable with respect to other portions of the chair. For example, the desk surface 868, or portions thereof, can be coupled to other portions of the chair via a rotating hinge or pivot, to allow the user to enter or exit the chair.

Figure 8H:
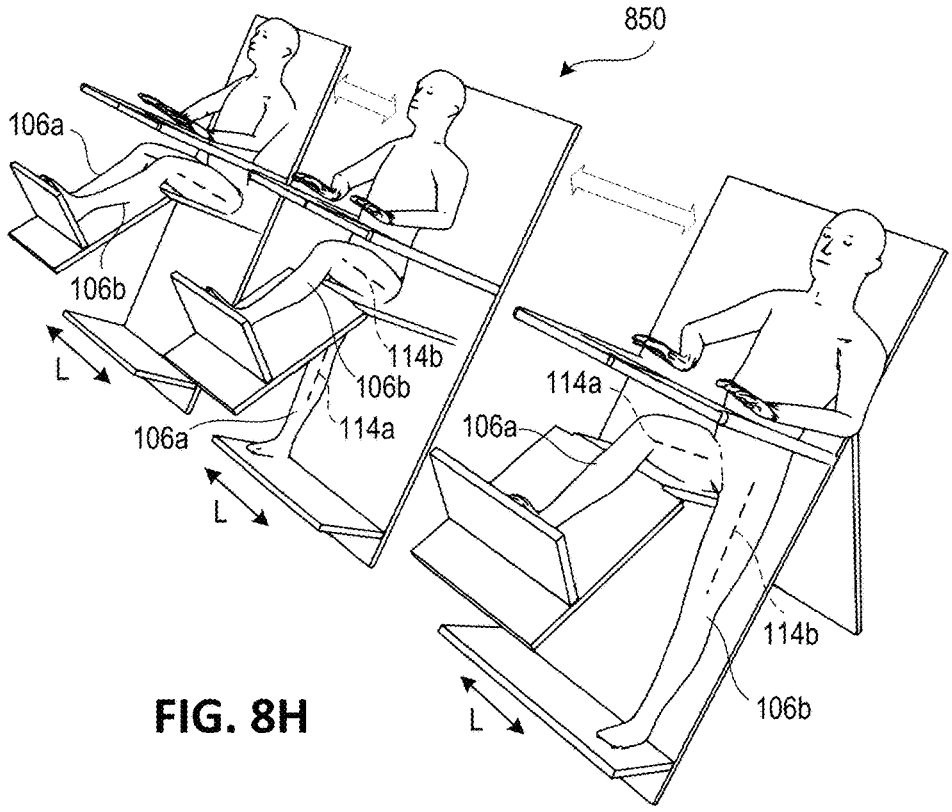
FIG. 8H is a perspective view of the user in the various configurations of FIGS. 8E-8G.

The chair 850 can be supported in an inclined configuration, such that the user 100 can adopt a partly reclined position with respect to the vertical direction. In the illustrated example of FIGS. 8G and 8H, the user 100 sits laterally offset toward the left side of the chair 850 (e.g., with center axis 105 of the user 100 offset to the left from a central axis 870 of the chair), such that the right leg 106*b* is supported by thigh support member 858 and shank support member 856, while the left leg 106*a* is supported by rear frame member 866. The left leg 106*a* and right leg 106*b* are thus supported in an asymmetric configuration so as to provide at least some stretch to the hip flexor. To stretch the other hip flexor, the user 100 moves to the other side of the chair 850, as shown in FIGS. 8F and 8H, such that center axis 105 of the user 100 is now offset to the right from central axis 870 of the chair to provide the opposite asymmetric leg configuration in a similar manner. In the illustrated example of FIG. 8E, the user can sit substantially centered in the chair 850 (e.g., with center axis 105 of the user collinear with, or at least crossing, chair central axis 870), such that both legs 106*a*, 106*b* are supported by the thigh support member 858 and shank support member 856.

Figure 9A:
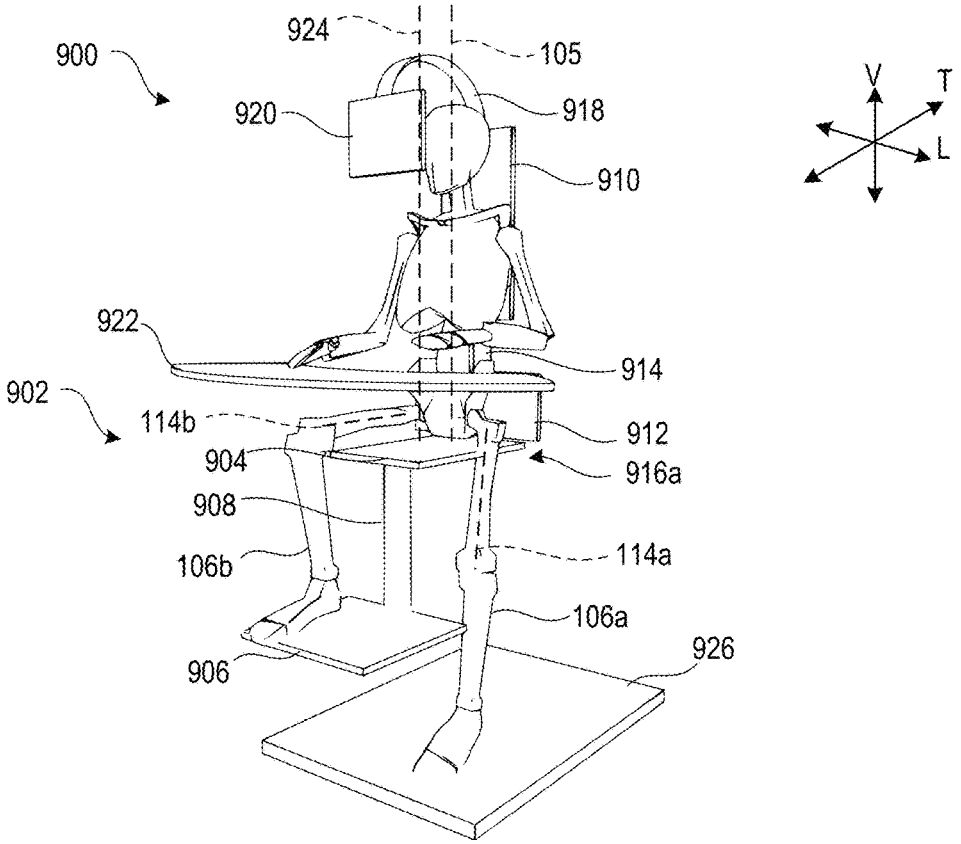
FIG. 9A is a front perspective view of a user in another exemplary ergonomic chair with a central fixed structure for supporting legs in asymmetric configurations, according to one or more embodiments of the disclosed subject matter.

FIG. 9A shows another exemplary ergonomic chair 900 with fixed support structures 902 for supporting legs 106*a*, 106*b* of a user 100 in asymmetric configurations. The ergonomic chair 900 can include an upper back rest 910, a lower back rest 912 connected to the upper back rest 910 by a connecting rod 914, and a chair base 926. The fixed support structures 902 can include a centrally-arranged leg support structure, for example, a thigh support member 904 (e.g., which also acts as a seat support portion) and footrest 906 connected to the thigh support member 904 by a connecting rod 908. In some embodiments, for example, the thigh support member 904 can be sized to support at least a single buttock but less than both buttocks of the user.

In the illustrated example of FIG. 9A, the user 100 sits laterally offset toward the left side of the chair 900 (e.g., with center axis 105 of the user 100 offset to the left from a central axis 924 of the chair), such that the right leg 106*b* is supported by thigh support member 904 and footrest 906, while the left leg 106*a* extends through left outer recess 916*a* in a substantially aligned configuration with the user central plane. The left leg 106*a* and right leg 106*b* are thus supported in an asymmetric configuration so as to provide at least some stretch to the hip flexor. To stretch the other hip flexor, the user 100 moves to the other side of the chair 900, such that center axis 105 of the user 100 is now offset to the right from central axis 924 of the chair to provide the opposite asymmetric leg configuration in a similar manner.

Ergonomic chair 900 can further include one or more additional structures that allow the chair to be used as a computing workstation, for example. Such additional structures can be integrated with or connected to the back rests 910, 912 or any other component of the chair. For example, the ergonomic chair 900 can optionally include desk surface 922 coupled to the lower back rest 912. For example, the desk surface 922 can support thereon one or more computing input/output devices, a laptop computer, a tablet computer, or any combination thereof. Alternatively or additionally, in some embodiments, the ergonomic chair 900 can optionally include a monitor 920 supported by an overhead support frame 918. In some embodiments, the monitor 920 can be of reduced size and/or weight to allow for overhead support, for example, by using a tablet-sized monitor of high resolution.

Figure 9B:
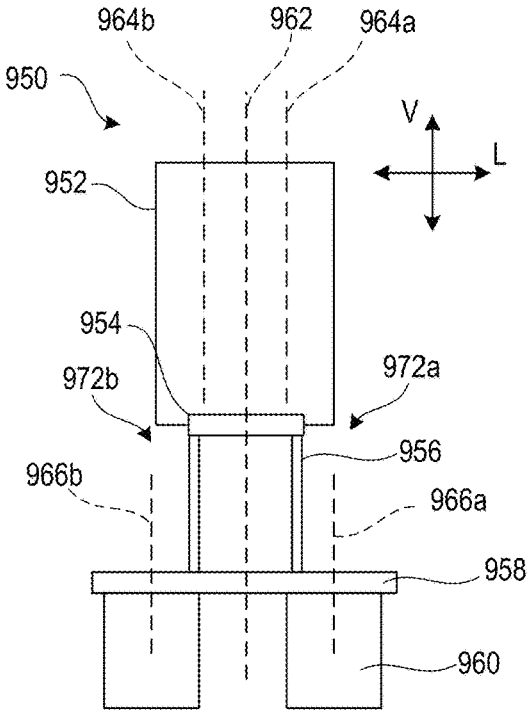
FIGS. 9B-9C are front and side views, respectively, of a variation of the ergonomic chair of FIG. 9A employing an A-frame support structure, according to one or more embodiments of the disclosed subject matter.
Figure 9C:
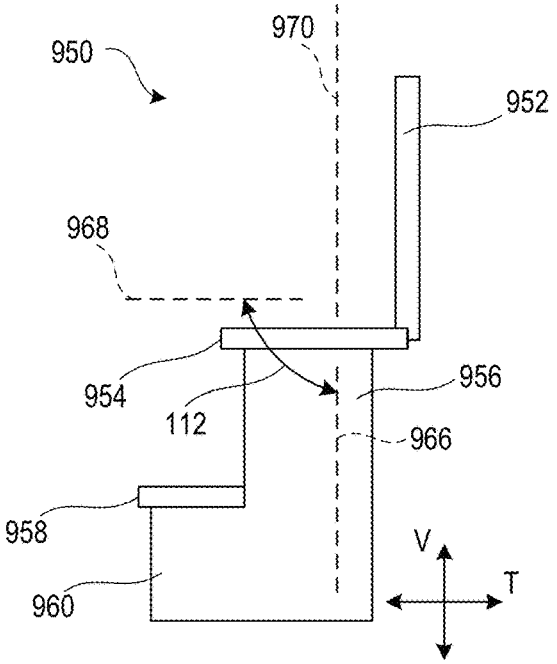

FIGS. 9B-9*c* shows another exemplary ergonomic chair 950 with fixed structures for supporting legs 106*a*, 106*b* of a user 100 in asymmetric configurations. The ergonomic chair 950 can include a back rest 952 and a base frame (e.g., A-frame). Portions of the base frame may further define the central fixed structure, which can include a centrally-arranged thigh support member 954 (e.g., which also acts as a seat support portion) and footrest 958 connected to the thigh support member 954 by a forward extending portion 960 of vertical support members 956 of the base frame. In some embodiments, for example, the thigh support member 954 can be sized to support at least a single buttock but less than both buttocks of the user.

In a first asymmetric leg configuration in the chair 950, the user 100 sits laterally offset toward the left side of the chair 950 (e.g., with central axis 964*a* of the user 100 offset to the left from a central axis 962 of the chair), such that the right leg is supported in a bent orientation by thigh support member 954 and footrest 958 (e.g., with axis 968 of the right thigh extending substantially horizontal), while the left leg extends through a left outer recess 972*a* (e.g., with axis 966*a* of the left thigh being substantially aligned with user central plane 970). The left and right legs can thus be supported in an asymmetric configuration so as to provide at least some stretch to the hip flexor. To stretch the other hip flexor, the user 100 moves to the other side of the chair 950, such that central axis 964*b* of the user 100 is now offset to the right from central axis 962 of the chair and with the right leg extending through a right outer recess 972*b* (e.g., with axis 966*b* of the right thigh being substantially aligned with user central plane 970), so as to provide the opposite asymmetric leg configuration in a similar manner.

Figure 10A:
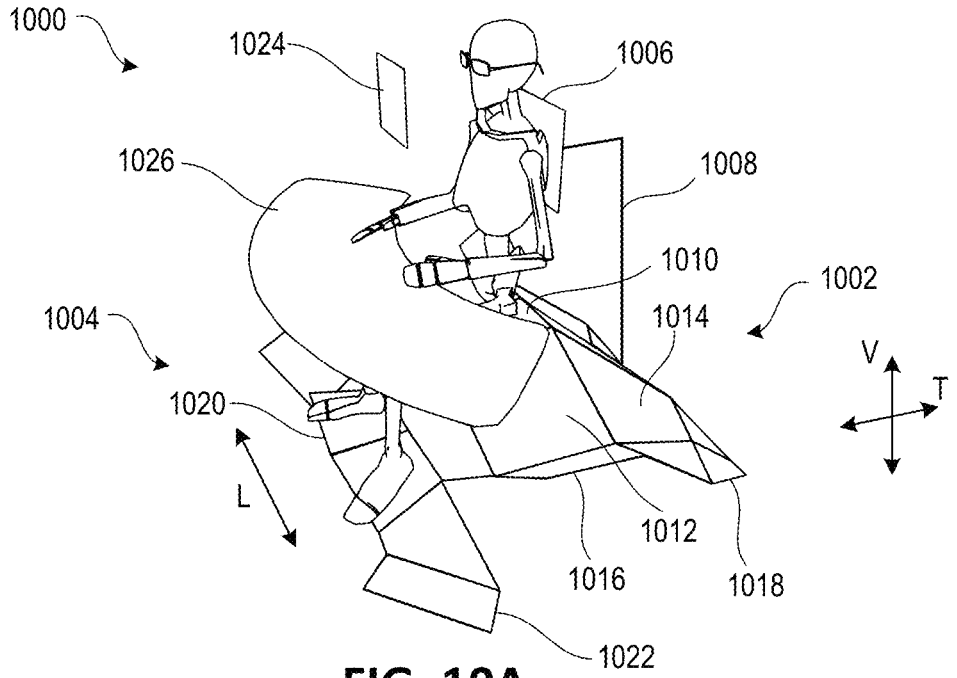
FIGS. 10A-10B are front and rear perspective views, respectively, of a user in another exemplary chair with a central fixed structure for supporting legs in asymmetric configurations, according to one or more embodiments of the disclosed subject matter.
Figure 10B:
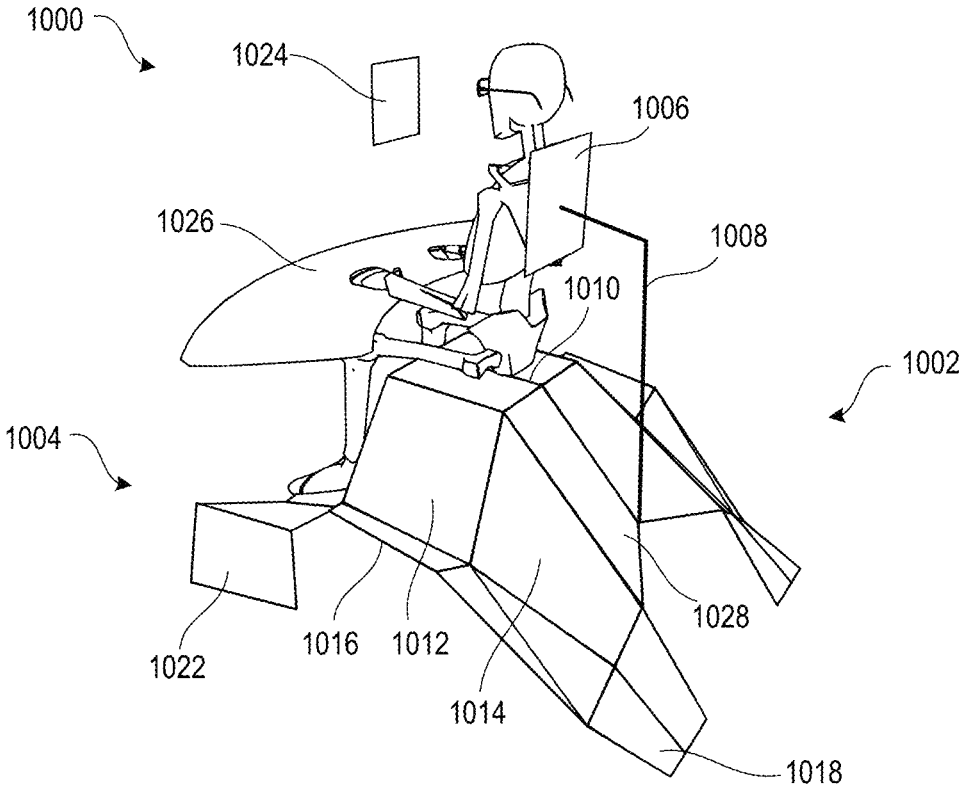
Figure 10C:
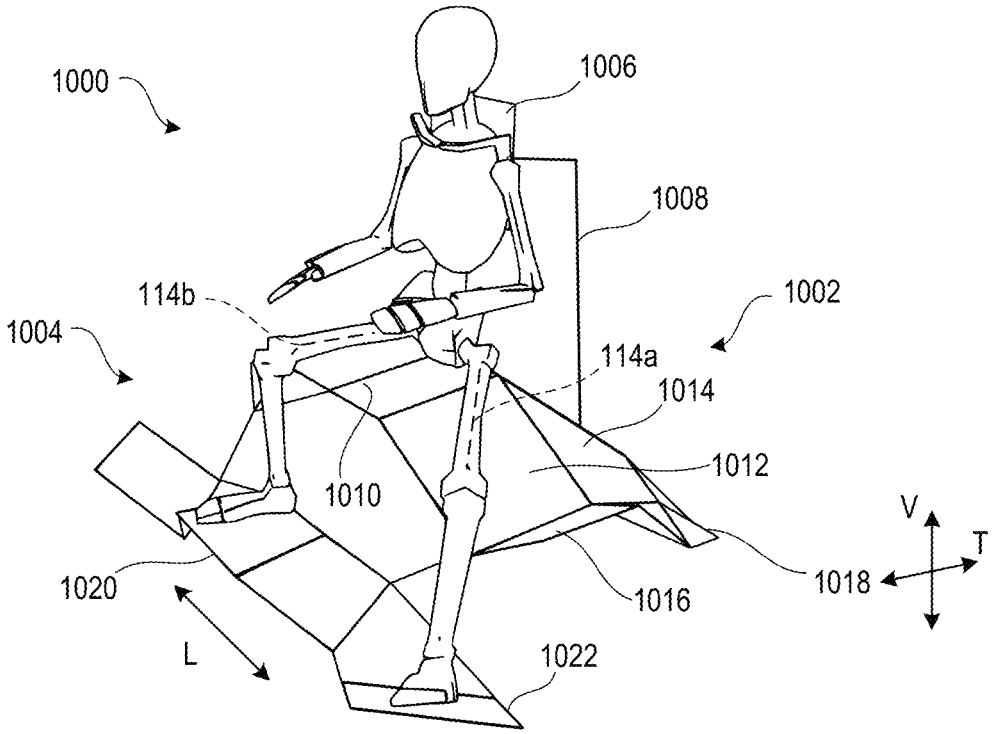
FIGS. 10C-10D are front and rear perspective views, respectively, of the user in the chair of FIGS. 10A-10B with the left leg in a forward orientation.
Figure 10D:
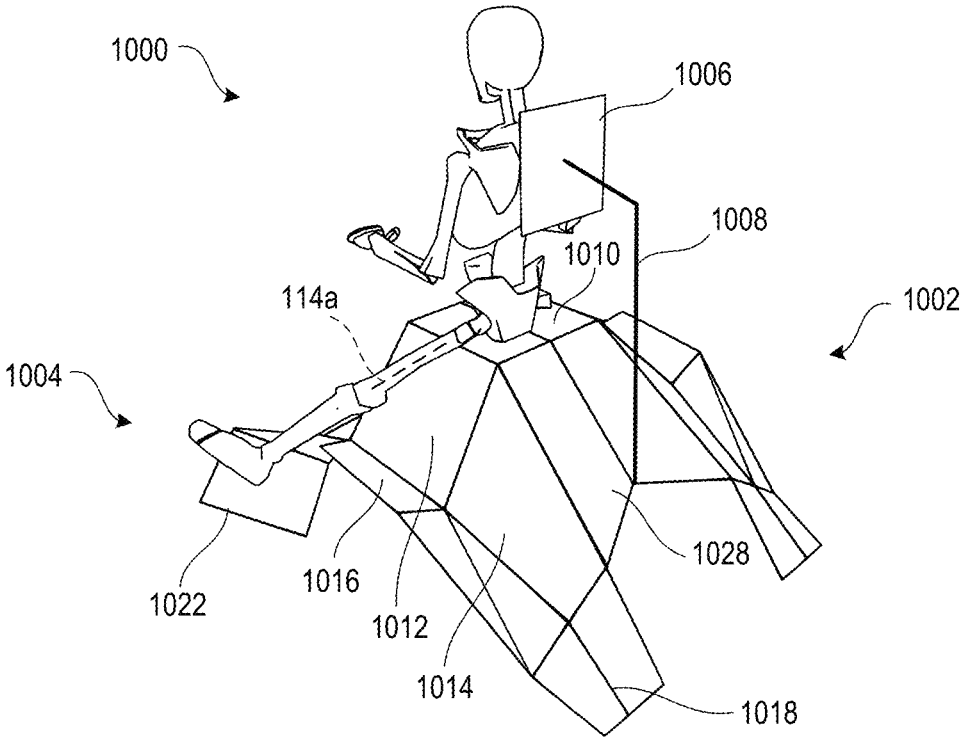

FIGS. 10A-10H show another exemplary ergonomic chair 1000 with fixed structures for supporting legs 106*a*, 106*b* of a user 100 in asymmetric configurations. The ergonomic chair 1000 can include a multi-faceted body 1002 and a backrest 1006 connected to the multi-faceted body by a frame 1008. In addition, the ergonomic chair 1000 can include a footrest structure 1004, with a plurality of surfaces for supporting feet of the user 100 in different configurations. For example, each lateral half of the footrest structure 1004 can define at least a central footrest support surface 1020 and a laterally outer footrest support surface 1022. In some embodiments, instead of being part of the ergonomic chair 1000, the footrest structure 1004 can be separate (e.g., unconnected from and/or independently positionable with respect to the multi-faceted body) from the ergonomic chair 1000, The multi-faceted body 1002 can have faceted surfaces that act as support surfaces for portions of the legs of the users in different configurations. For example, each lateral half of the multi-faceted body 1002 can define at least a seat support portion 1010, a front faceted surface 1012, a rear faceted surface 1014, a first lower faceted surface 1016, a second lower faceted surface 1018, and a rear deck surface 1028 (e.g., to which the frame 1008 for the backrest 1006 is coupled). In some embodiments, the seat support portions 1010 can be sized and shaped to support both buttocks of the user simultaneously, for example, as shown in FIGS. 10A-10B. Thus, in the illustrated example of FIGS. 10A-10B, the user 100 can sit substantially centered in the chair 1000 (e.g., with the central axis of the user collinear with, or at least crossing, a central axis of the chair), such that both legs 106*a*, 106*b* are supported by the seat support portion 1010 and central footrest support surface 1020.

Figure 10E:
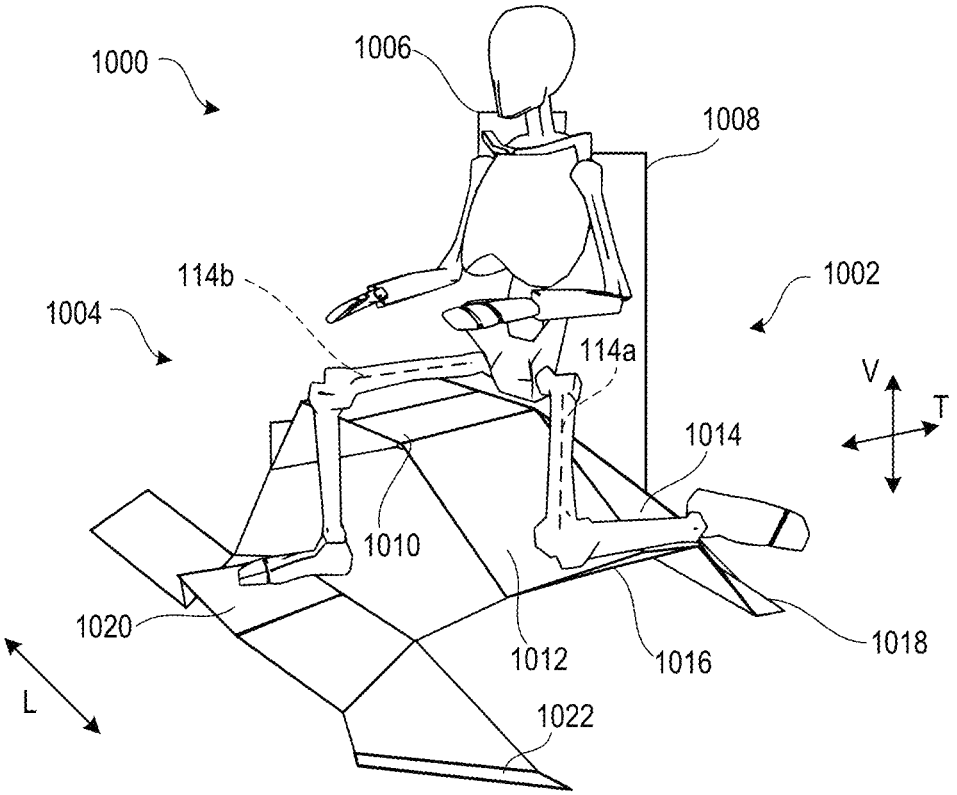
FIGS. 10E-10F are front and rear perspective views, respectively, of the user in the chair of FIGS. 10A-10B with the left leg in an aligned orientation.
Figure 10F:
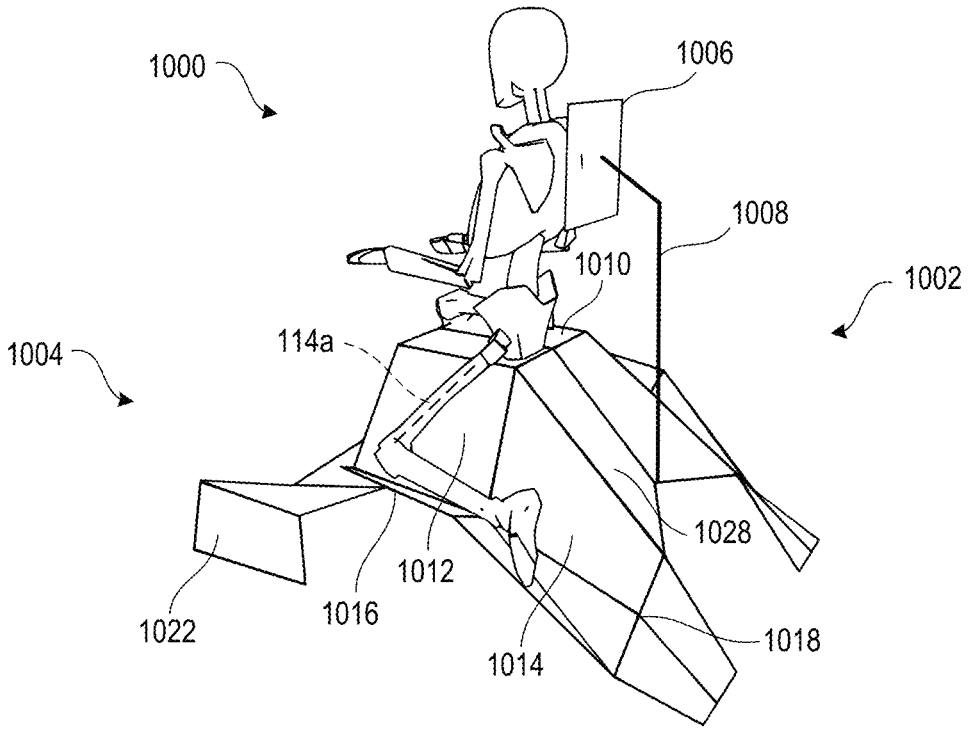
Figure 10G:
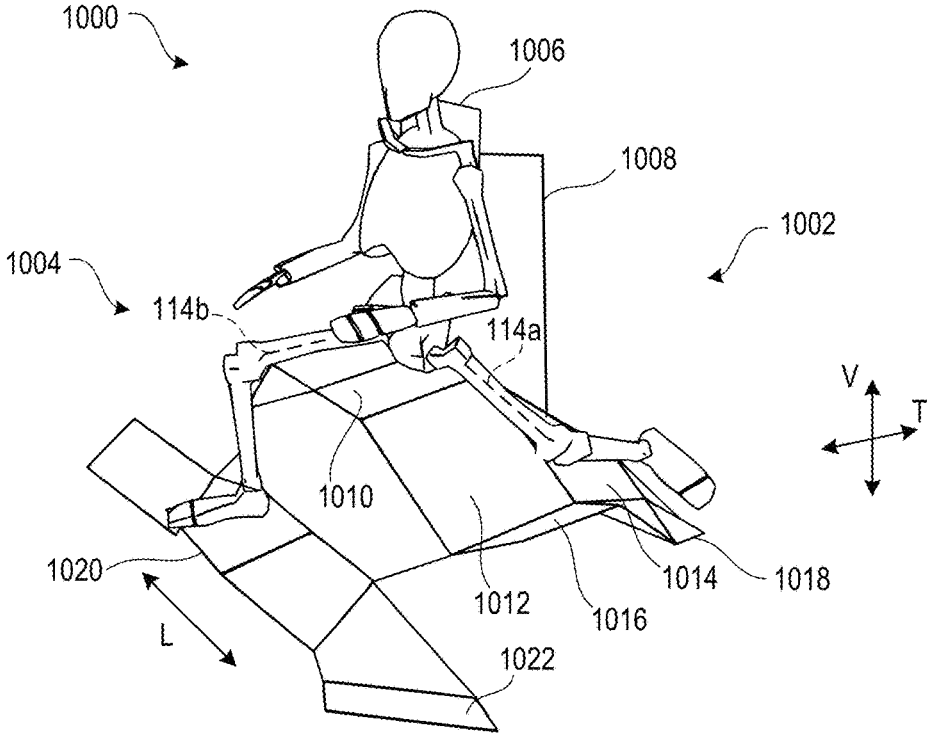
FIGS. 10G-10H are front and rear perspective views, respectively, of the user in the chair of FIGS. 10A-10B with the left leg in a rearward orientation.
Figure 10H:
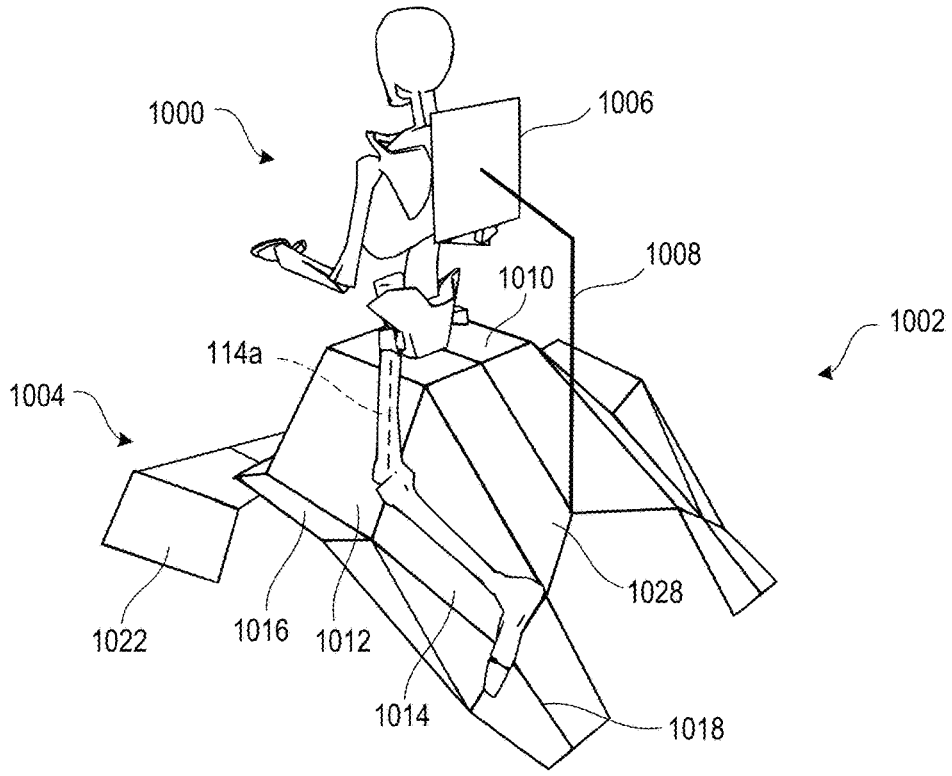

To obtain a stretch of the hip flexor by adopting an asymmetric leg configuration, the user 100 can move laterally outward to access one or more of the faceted surfaces of the multi-faceted body. For example, in FIGS. 10C-10D, the user 100 has moved to the left (e.g., with the central axis of the user now offset from a central axis of the chair) to allow the thigh of left leg 106*a* to contact and/or be supported by front faceted surface 1012 and the foot of left leg 106*a* to be supported by laterally outer footrest support surface 1022. Meanwhile, the right leg 106*b* can remain supported in a bent forward orientation by seat support portion 1010 and central footrest support surface 1020. In the laterally offset position, the user 100 can further reposition the outer leg to obtain other asymmetric configurations. For example, in FIGS. 10E-10F, the left leg can adopt a bent aligned orientation (e.g., with the axis 114*a* of the left thigh being substantially aligned with the central plane of the user in a side view), with the front faceted surface 1012 contacting and/or supporting the left thigh and with first lower faceted surface 1016 contacting and/or supporting the left knee and/or left shank. As compared to FIGS. 10C-10D, the arrangement of FIGS. 10E-10F provides a larger angle between the left and right legs (e.g., angle of ~90°), which can increase a stretch of the hip flexor. In FIGS. 10G-10H, the left leg is positioned further rearward (e.g., with the axis 114*a* of the left thigh being angled behind the central plane of the user in a side view), with the front faceted surface 1012 contacting and/or supporting the left thigh and with rear faceted surface 1014 contacting and/or supporting the left shank. As compared to FIGS. 10C-10D, the arrangement of FIGS. 10G-10H provides an even larger angle between the left and right legs (e.g., angle >~90°), which can further increase a stretch of the hip flexor.

Ergonomic chair 1000 can further include one or more additional structures that allow the chair to be used as a computing workstation, for example. Such additional structures can be integrated with or connected to the multi-faceted body 1002 or any other component of the chair. For example, the ergonomic chair 1000 can optionally include desk surface 1026, which can support thereon one or more computing input/output devices, a laptop computer, a tablet computer, or any combination thereof. Alternatively or additionally, in some embodiments, the ergonomic chair 1000 can optionally include a monitor 1024. For example, the monitor 1024 can be coupled to and supported by the desk surface 1026 or otherwise supported by an overhead support assembly in a manner similar to that described for FIG. 4B or 9A.

Examples of Ergonomic Chairs with Dynamic Structures

FIGS. 11A-11E show an exemplary ergonomic chair 1100 with dynamic structures 1102 for supporting legs 106*a*, 106*b* of a user 100 in symmetric or asymmetric configurations. The dynamic structures 1102 can include laterally-outer dynamic leg support structures 1104*a*, 1104*b* separated by a lateral gap 1130 (e.g., having a lateral size insufficient to allow a leg of the user to extend therethrough). Each laterally-outer dynamic leg support structure 1104*a*, 1104*b* can have a thigh support member 1114*a*, 1114*b* (which can also act as a seat support portion supporting a buttock of a user thereon), a shank support member 1110*a*, 1110*b* coupled to the thigh support member 1114*a*, 1114*b* by a user-adjustable rotating hinge or pivot 1112*a*, 1112*b* (e.g., including a locking mechanism, such as a friction lock, to allow custom configuration by the user of the angle between the shank and thigh support members), and a footrest 1108*a*, 1108*b*. Each laterally-outer dynamic leg support structure 1104*a*, 1104*b* can be coupled to bottom end portion of a backrest 1105 by another user-adjustable rotating hinge or pivot 1116*a*, 1116*b*.

Figure 11A:
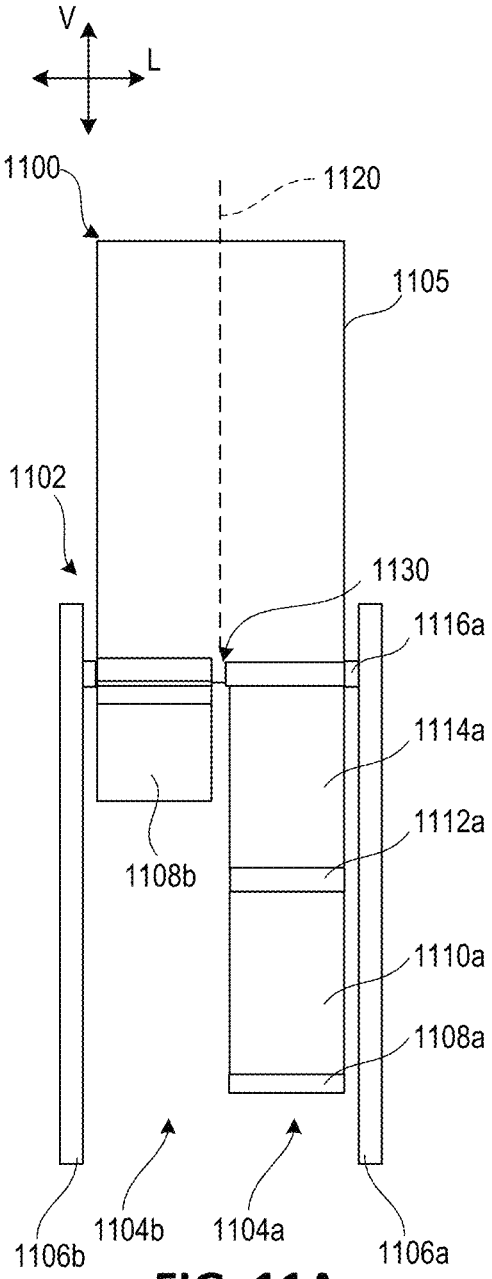
FIGS. 11A-11B are front and side views, respectively, of an exemplary ergonomic chair with dynamic structures for supporting legs in asymmetric configurations, according to one or more embodiments of the disclosed subject matter.
Figure 11B:
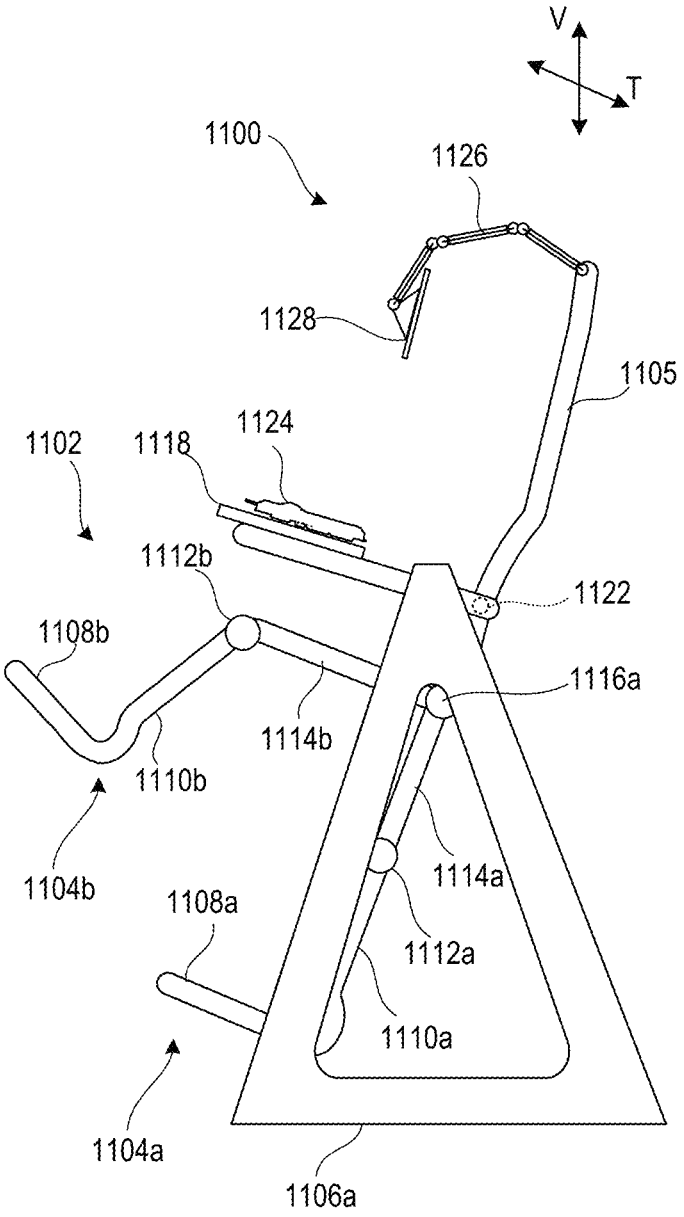
Figure 11C:
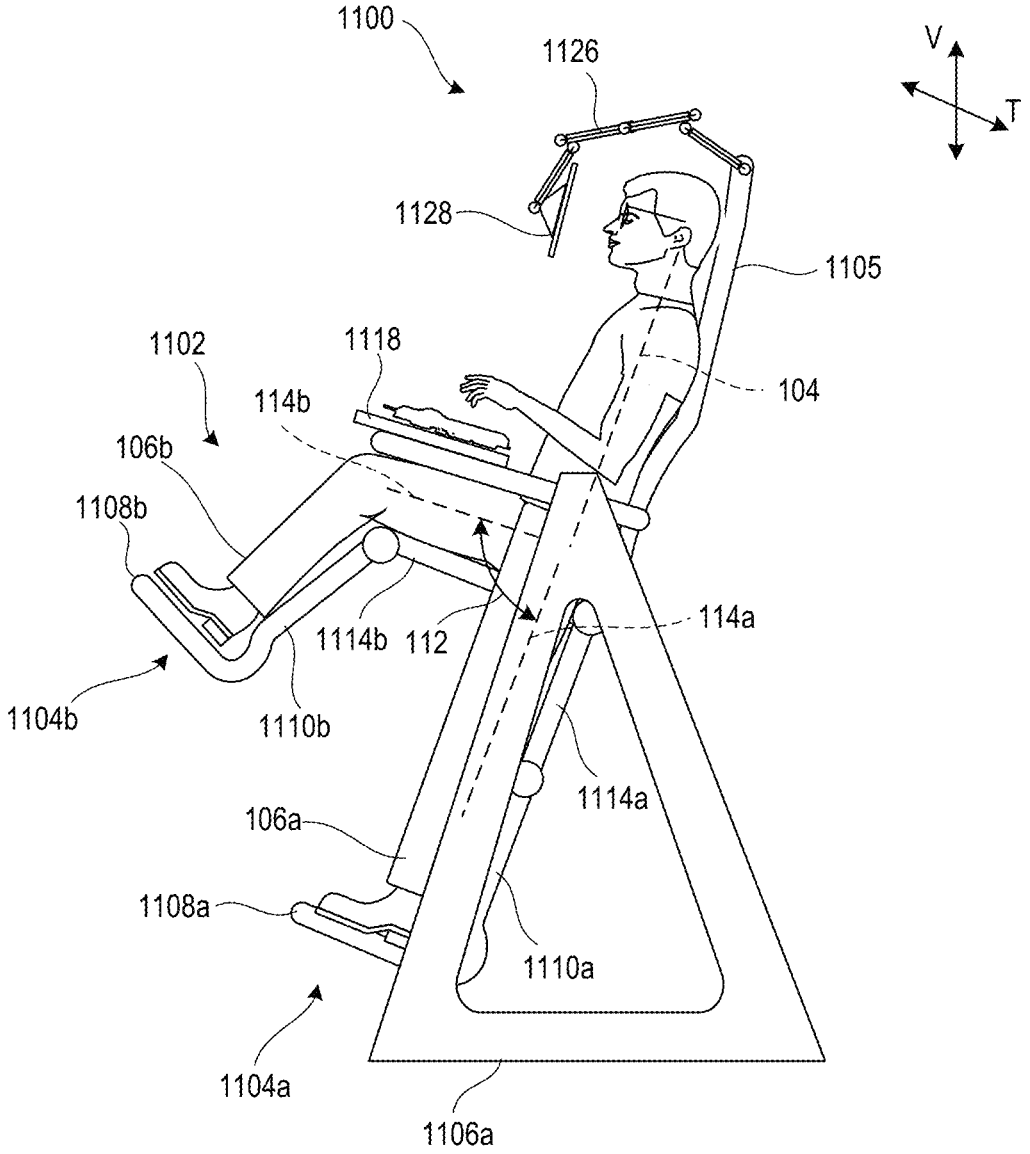
FIGS. 11C-11D are side and front views, respectively, of a user in the chair of FIGS. 11A-11B with the right leg in a forward orientation.
Figure 11D:
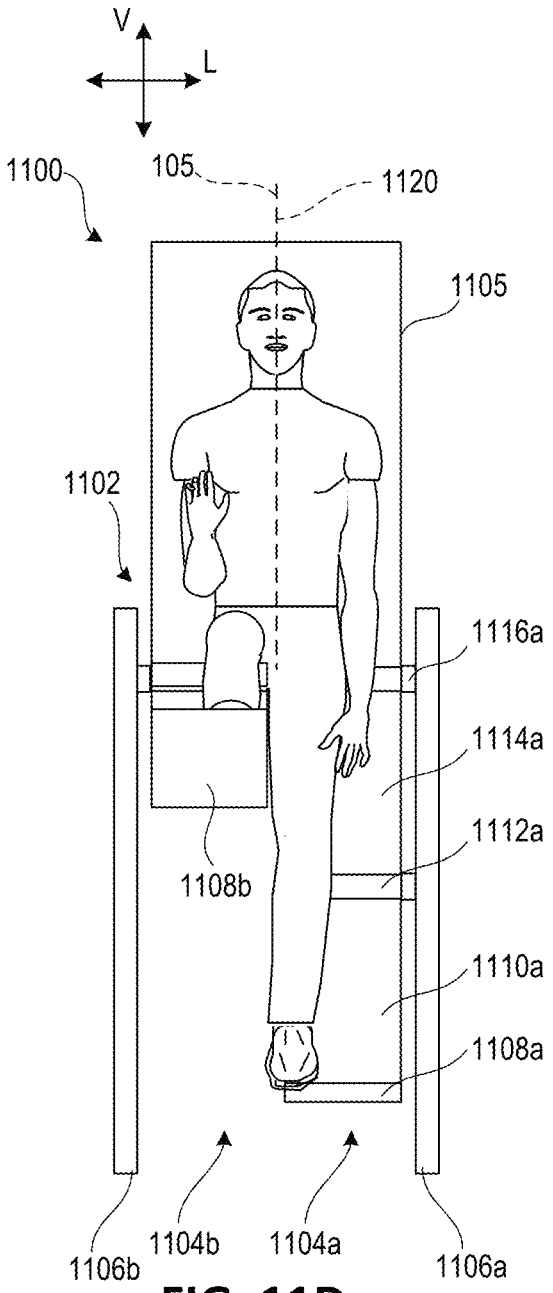
Figure 11E:
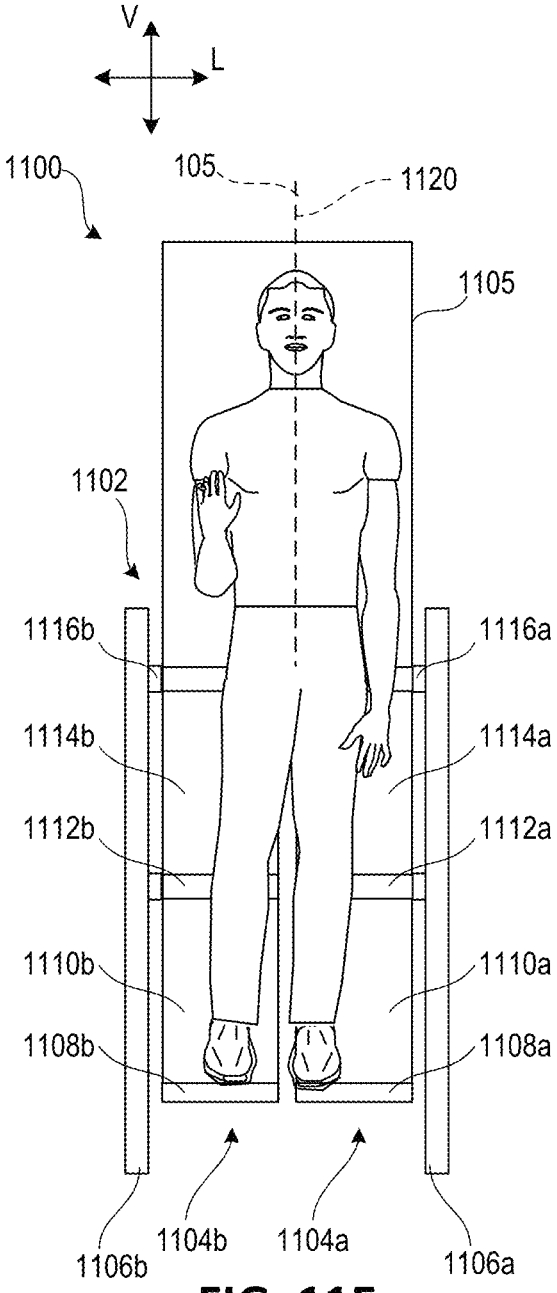
FIG. 11E is a front view of a user in the chair of FIGS. 11A-11B with the legs in a symmetric configuration.

The backrest 1105 and/or the dynamic structures 1102 can be rotatably supported (e.g., via hinge or pivot 1116*a*, 1116*b*) within a pair of support frames 1106*a*, 1106*b* (e.g., triangular-shaped or A-shaped frames). Thus, the inclination angle of the backrest 1105 and/or the dynamic structures 1102 can be adjusted to allow the user 100 to adopt a partially reclined position with respect to the vertical direction, for example, as shown in FIGS. 11B-11C. In the illustrated example of FIGS. 11C-11E, the user 100 sits substantially aligned with a center of the chair 1100, with a center axis 105 of the user 100 being collinear with, or at least crossing, the central axis 1120 of the chair 1100. As shown in FIG. 11E, with the dynamic structures 1102 in their initial configuration, the legs of the user 100 can adopt a symmetric configuration, with both legs being substantially aligned with a central plane 104 of the user.

To obtain an asymmetric configuration, the user can manipulate one or both of the dynamic structures 1102 to position one of the legs in an orientation different from the other. The positions of the dynamic structures 1102 can be completely customizable by the user 100, limited only by the range of motion of the respective hinges 1112, 1116. For example, as shown in FIGS. 11A-11D, the right leg support structure 1104*b* can be repositioned with the thigh support member 1114*b* extending forward and the shank support member 1110*b* extending at a downward angle therefrom. With the user sitting in the chair, the right leg 106*b* of the user 100 is thus supported in a forward orientation while the left leg 106*a* remains substantially aligned with the central plane 104 of the user, thereby obtaining an asymmetric leg configuration to provide at least some stretch to the hip flexor. Whether in the symmetric configuration or the asymmetric configuration, each leg of the user can remain supported by, or at least in contact with, a respective one of the leg support structures 1104*a*, 1104*b*.

When employing the dynamic structures 1102, the user 100 can be partially supported in a manner similar to a zero-gravity chair. For example, as shown in FIGS. 11C-11D, the right half of the user is supported by right leg support structure 1104*b* (in combination with backrest 1105), while the left half of the user 100 adopts a partly-reclined standing configuration at least partially supported by left leg 106*a* (e.g., where the backrest 1105 at least partially reduces a weight required to be supported by extended leg 106*a*). Moreover, the user can further change position of the body in the chair by changing an inclination angle of the chair, e.g., by rotating backrest 1105 and/or dynamic structures 1102 about a horizontal axis, for example, to support the user in a substantially upright (e.g., standing) orientation. Thus, the user 100 can adopt any number of customized body positions and leg configurations in the chair to stretch various muscles (e.g., hip flexors) and/or periodically change pressure points to maximize, or at least improve, user comfort, without otherwise having to move laterally within the chair.

Ergonomic chair 1100 can further include one or more additional structures that allow the chair to be used as a computing workstation, for example. Such additional structures can be integrated with or connected to backrest 1105 or any other component of the chair. For example, the ergonomic chair 1100 can optionally include desk surface 1118 coupled to the backrest 1105 by an optional rotating hinge or pivot 1122, which allows the desk surface to be rotated into or out of position (e.g., to allow ingress or egress of the user 100). The desk surface 1118 can support thereon one or more computing input/output devices (e.g., wireless keyboard 1124), a laptop computer, a tablet computer, or any combination thereof. Alternatively or additionally, in some embodiments, the ergonomic chair 1100 can optionally include a monitor 1128 supported by an overhead support frame 1126. In some embodiments, the monitor 1128 can be of reduced size and/or weight to allow for overhead support, for example, by using a tablet-sized monitor of high resolution.

Figure 12A:
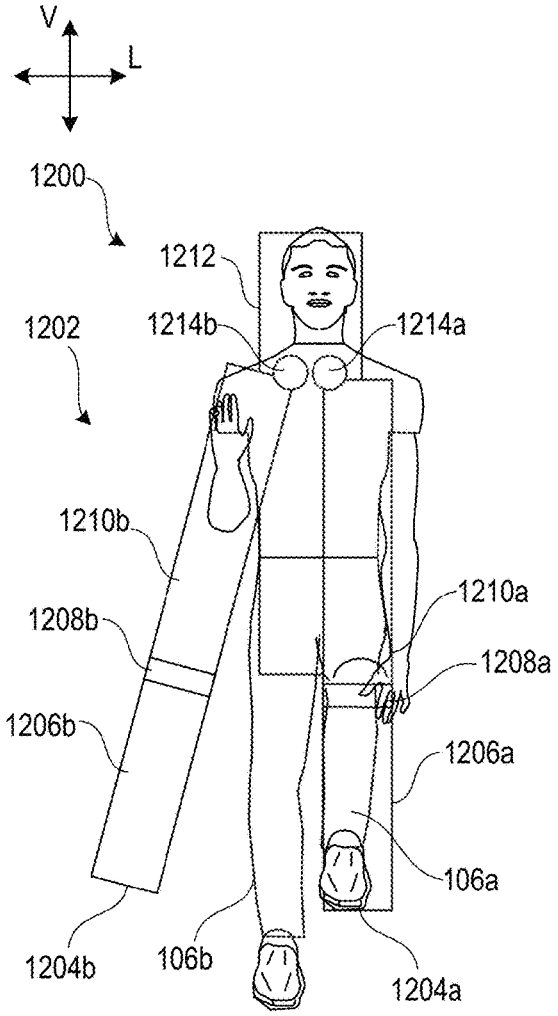
FIG. 12A is a front view of another exemplary ergonomic chair with dynamic structures for supporting legs in asymmetric configurations, according to one or more embodiments of the disclosed subject matter.

In the illustrated example of FIGS. 11A-11E, each leg support structure 1104*a*, 1104*b* is dynamically positionable with respect to the vertical and/or traverse directions (e.g., by rotation about an axis parallel to the lateral direction). Alternatively or additionally, in some embodiments, each leg support structure can be dynamically positionable with respect to the lateral direction, for example, to be displaced between a stowed position (e.g., where the structure does not support a leg of the user and the legs adopt a symmetric configuration) and a use position (e.g., where the structure supports one leg of the user, and the legs adopts an asymmetric configuration). For example, FIG. 12A shows another exemplary ergonomic chair 1200 with laterally-dynamic structures 1202 for supporting legs 106*a*, 106*b* of a user 100 in asymmetric configurations. The dynamic structures 1202 can include laterally-outer dynamic leg support structures 1204*a*, 1204*b*, each having a thigh support member 1210*a*, 1210*b* (which can also act as a seat support portion supporting a buttock of a user thereon) and a shank support member 1206*a*, 1206*b* coupled to the thigh support member 1210*a*, 1210*b* by rotating hinges or pivots 1208*a*, 1208*b*. Alternatively, in some embodiments, pivots 1208*a*, 1208*b* can be eliminated in favor of providing the shank support members 1206*a*, 1206*b* at a fixed orientation (e.g., bent) with respect to the thigh support members 1210*a*, 1210*b*.

Each dynamic leg support structure 1204*a*, 1204*b* can be rotatably coupled to a backrest 1212 (or a frame supporting the backrest 1212) via respective hinges 1214*a*, 1214*b*. The leg support structures can thus swing in in the vertical-lateral plane (e.g., about an axis of rotation substantially parallel to the transverse direction) to displace between a laterally-outward position where the user 100 does not use the structure to support a leg (e.g., as with right leg support structure 1204*b* in FIG. 12A) and a more central position where a leg of the user is supported (e.g., as with left leg support structure 1204*a* in FIG. 12A). Alternatively, the leg support structures 1204*a*, 1204*b* can be supported on rails, or via other linear displacement mechanisms, that allow the structures to move laterally toward or away from the center of the chair rather than swing. Using one of the leg support structures 1204*a*, 1204*b* for support, the legs of the user 100 can adopt an asymmetric configuration. Using neither or both of the leg support structures 1204*a*, 1204*b* for support, the legs of the user 100 can adopt a substantially symmetric configuration.

Figure 12B:
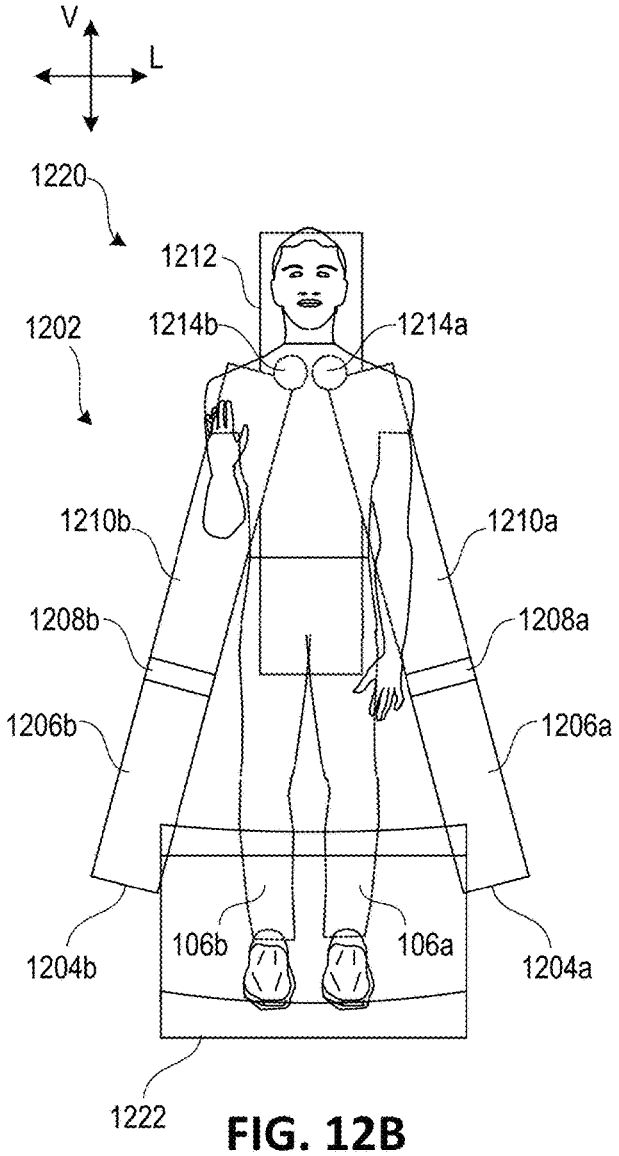
FIG. 12B is a variation of the ergonomic chair of FIG. 12A employing a ramp footrest, according to one or more embodiments of the disclosed subject matter.

In the illustrated example of FIG. 12A, when neither of the leg support structures 1204*a*, 1204*b* are employed for support (e.g., both displaced laterally outward), the feet of the user may rest on the floor or a common footrest of the chair, thereby providing a symmetric configuration for the legs. Alternatively, in some embodiments, the user can be provided with an arcuate or inclined ramp footrest (e.g., as part of the chair or as a separate component positioned with respect to the chair) to support the legs of the user in an asymmetric configuration even when the dynamic structures 1204*a*, 1204*b* are not employed. For example, FIG. 12B shows another ergonomic chair 1220, which may be substantially the same as the chair 1200 of FIG. 12A but with an arcuate footrest 1222. For example, footrest 1222 may have a configuration and be used in a manner similar to that of chair base 422 in FIGS. 4A-4I.

Figure 12C:
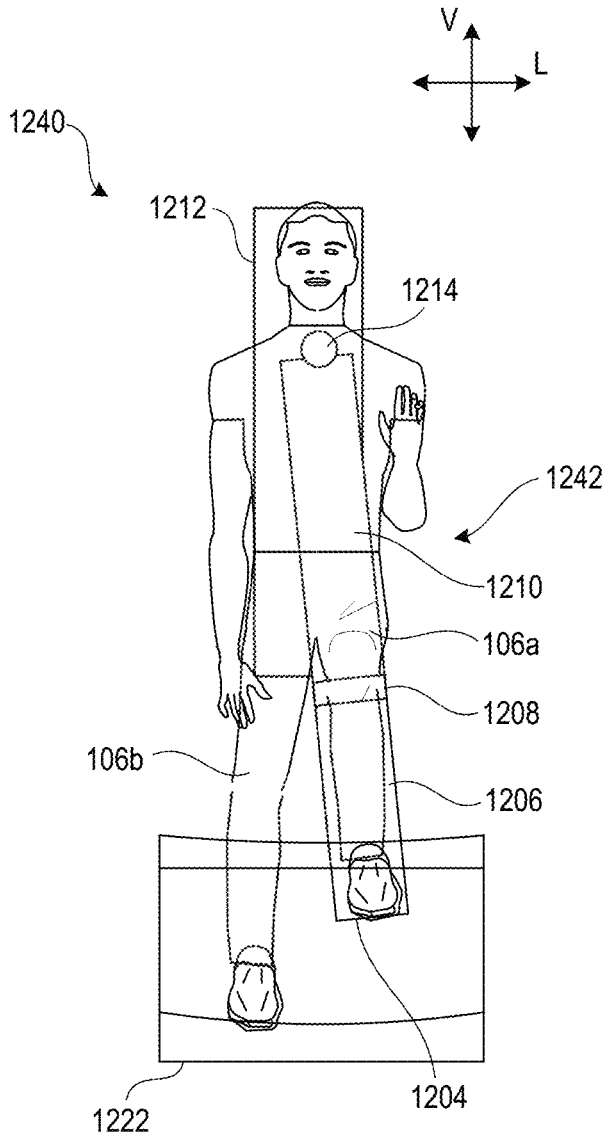
FIG. 12C is a variation of the ergonomic chair of FIG. 12A employing a single dynamic structure, according to one or more embodiments of the disclosed subject matter.

In the illustrated examples of FIGS. 12A-12B, a separate leg support structure 1204 is provided for each leg. Alternatively, in some embodiments, a single dynamic leg support structure can be used. For example, the single leg support structure can be displaced between a stowed position (e.g., where the structure does not support a leg of the user and the legs adopt a symmetric configuration), a first use position (e.g., where the structure supports one of the legs such that the legs adopts an asymmetric configuration), and a second use position (e.g., where the structure supports the other of the legs such that the legs adopt an opposite asymmetric configuration). For example, FIG. 12C shows another exemplary ergonomic chair 1240, which may substantially the same as the chair 1220 of FIG. 12B, but with a single dynamic structure 1242. For example, the single dynamic structure 1242 can include a single leg support 1204 rotatably coupled to backrest 1212 via a centrally located hinge 1214. The single leg support 1204 can have a thigh support member 1210 (which can also act as a seat support portion supporting a buttock of a user thereon) and a shank support member 1206 coupled to the thigh support member 1210 by rotating hinge or pivot 1208.

FIGS. 13A-13D show another exemplary ergonomic chair 1300 with dynamic structures for supporting legs 106*a*, 106*b* of a user 100 in asymmetric configurations. The ergonomic chair 1300 includes a backrest 1302 (with optional headrest 1314), a pair of L-shaped frame members 1304*a*, 1304*b*, and a pair of footrests 1310*a*, 1310*b*. Each L-shape frame member 1304*a*, 1304*b* can be coupled to and support the backrest 1302. A lower extension 1306*a*, 1306*b* of each L-shaped frame member 1304*a*, 1304*b* can be further coupled to and support the respective footrest 1310*a*, 1310*b*. The dynamic structures can include a pair of thigh support members 1308*a*, 1308*b* (e.g., which also acts as a seat support portion). For example, each thigh support member 1308*a*, 1308*b* can be sized and shaped to support a single buttock of the user.

In some embodiments, the thigh support members 1308*a*, 1308*b* can be movable between a use position supporting a thigh and corresponding buttock of the user (e.g., extending substantially horizontal) and a stowed position defining a gap that allows the leg of the user to extend therethrough (e.g., extending substantially vertical). In some embodiments, each thigh support member 1308*a*, 1308*b* can be rotatably coupled to the backrest 1302 and/or the frame 1304 (e.g., via a rotating hinge or pivot), so as to rotate about an axis substantially parallel to the lateral direction, for example, rearward from the use position of FIG. 13B to the stowed position of thigh support member 1308*a* in FIG. 13A. Alternatively or additionally, in some embodiments, each thigh support member 1308*a*, 1308*b* can be rotatably coupled to the backrest 1302 and/or the frame 1304 (e.g., via a rotating hinge or pivot), so as to rotate about an axis substantially parallel to the transvers direction, for example, centrally from the use position of FIG. 13B to the stowed position of thigh support member 1308*b* in FIG. 13C.

Figures 13A, 13B, 13C:
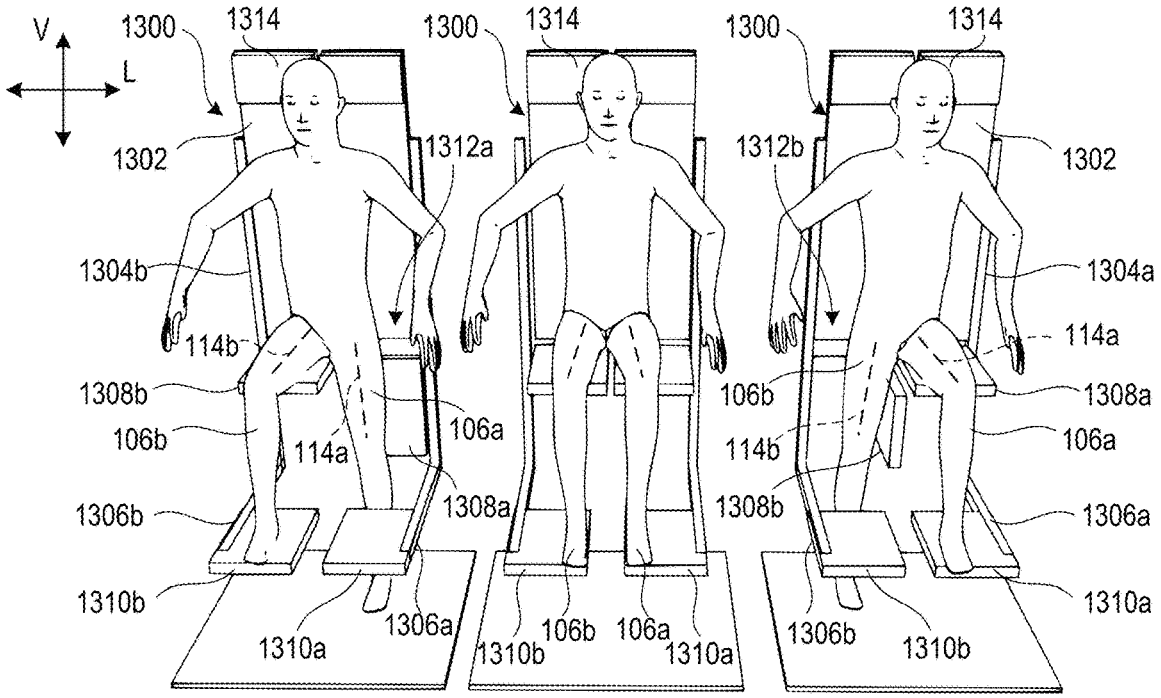
FIGS. 13A-13C are front views of a user in another exemplary ergonomic chair with dynamic structures for supporting legs in asymmetric configurations, according to one or more embodiments of the disclosed subject matter.
Figure 13D:
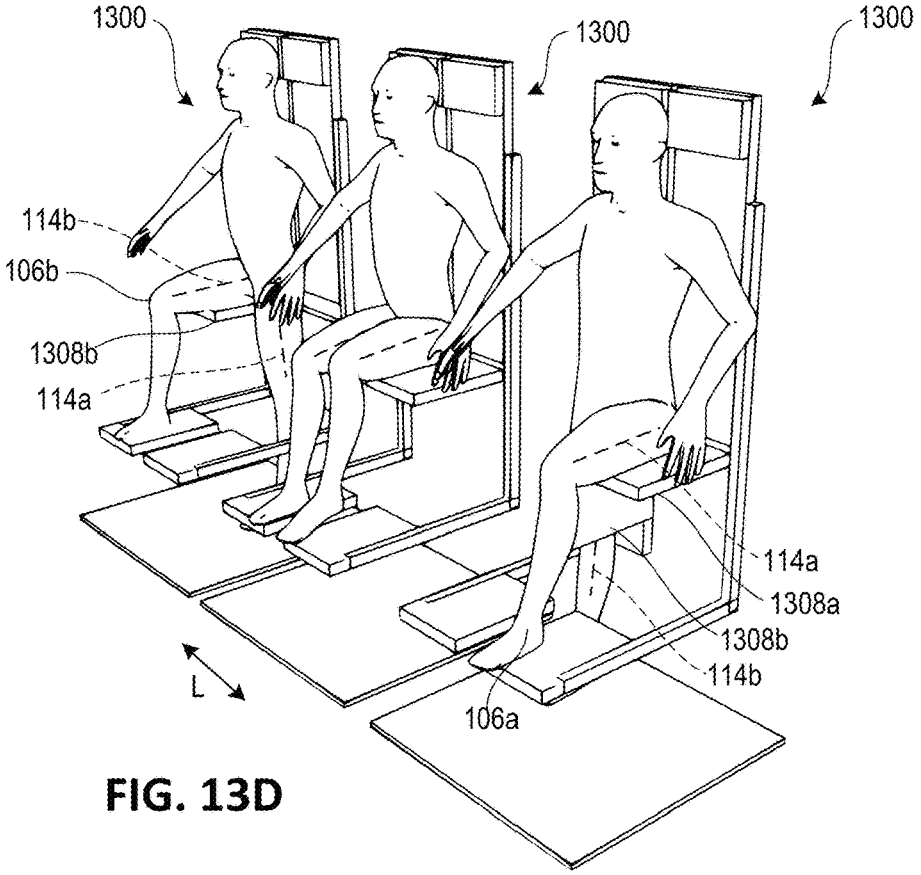
FIG. 13D is a perspective view of the user in the various configurations of FIGS. 13A-13C.

In the illustrated example of FIGS. 13A-13D, the user 100 sits substantially aligned with a center of the chair 1300 (e.g., with a center axis 105 of the user 100 being collinear with, or at least crossing, the central axis of the chair). As shown in FIG. 13B, with the thigh support members 1308*a*, 1308*b* in their use configurations, the legs of the user 100 can adopt a symmetric configuration, with both legs extending in a bent forward orientation. To obtain an asymmetric configuration, the user can manipulate one of the thigh support members 1308*a*, 1308*b* into its stowed position, such that one of the legs can extend in a substantially aligned configuration with the central plane of the user while the other leg remains in the bent forward orientation. For example, as shown in FIG. 13A, the left thigh support member 1308*a* can be repositioned such that the left leg 106*a* extends through newly opened recess 1312*a*, thereby providing the asymmetric leg configuration to provide at least some stretch to the hip flexor without the user having to move laterally. Alternatively, as shown in FIG. 13C, the right thigh support member 1308*b* can be repositioned such that the right leg 106*b* extends through newly opened recess 1312*b*, thereby providing the asymmetric leg configuration to provide at least some stretch to the hip flexor without the user having to move laterally. In some embodiments, the configuration of the thigh support members 1308*a*, 1308*b* can be such that, with the legs in an asymmetric configuration, the buttock of the leg that extends through the opened recess is completely unsupported by any portion of the chair, while the opposite buttock is completely supported by the corresponding thigh support member.

Additional Examples of the Disclosed Technology

In view of the above-described implementations of the disclosed subject matter, this application discloses the additional examples in the clauses enumerated below. It should be noted that one feature of a clause in isolation, or more than one feature of the clause taken in combination, and, optionally, in combination with one or more features of one or more further clauses are further examples also falling within the disclosure of this application.

Clause 1. An ergonomic chair comprising:

a back support member constructed to contact at least a portion of a back of a user; and means for arranging and supporting legs of the user in an asymmetric configuration, the asymmetric configuration comprising (i) a first leg extending in front of a body of the user and (ii) a second leg aligned with or extending behind the body of the user, an angle between the first and second legs in a side view being at least 30 degrees.

Clause 2. The ergonomic chair of any clause or example herein, in particular, Clause 1, wherein the means for arranging and supporting legs of the user comprises one or more fixed structures constructed to support the first leg in a first predetermined orientation.

Clause 3. The ergonomic chair of any clause or example herein, in particular, Clause 2, wherein the one or more fixed structures comprises first and second fixed structures, the first fixed structure being disposed on a side of the back support member opposite from the second fixed structure with respect to a lateral direction.

Clause 4. The ergonomic chair of any clause or example herein, in particular, Clause 3, wherein the first and second fixed structures are arranged such that, with the legs of the user in the asymmetric configuration, a centerline of the user is offset from a centerline of the back support member with respect to the lateral direction.

Clause 5. The ergonomic chair of any clause or example herein, in particular, any one of Clauses 3-4, wherein, with the legs of the user in the asymmetric configuration, the first leg is in contact with the first fixed structure or the second fixed structure, and the second leg is not in contact with either the first fixed structure or the second fixed structure.

Clause 6. The ergonomic chair of any clause or example herein, in particular, Clause 5, wherein:

the means for arranging and supporting legs of the user further comprises a seat support portion constructed to contact and support buttocks of the user;

each of the first and second fixed structures extends from a respective bottom part of the seat support portion; and at least an intermediate portion of the first fixed structure is separated from a corresponding intermediate portion of the second fixed structure along the lateral direction by a gap that is sized and shaped to accommodate insertion of the second leg therein.

Clause 7. The ergonomic chair of any clause or example herein, in particular, Clause 6, wherein an end portion of the first fixed structure distal from the bottom part of the seat support portion is coupled to or integral with a corresponding end portion of the second fixed structure distal from the bottom part of the seat support portion.

Clause 8. The ergonomic chair of any clause or example herein, in particular, any one of Clauses 6-7, wherein each of the first and second fixed structures comprises:

a first member arranged to support a thigh of the user thereon; and a second member extending from the first member and arranged to support a shank of the user thereon.

Clause 9. The ergonomic chair of any clause or example herein, in particular, any one of Clauses 6-8, wherein the means for arranging and supporting legs of the user further comprises a third fixed structure constructed to support the second leg in a predetermined orientation.

Clause 10. The ergonomic chair of any clause or example herein, in particular, Clause 9, wherein the third fixed structure comprises a footrest.

Clause 11. The ergonomic chair of any clause or example herein, in particular, Clause 5, wherein:

each of the first and second fixed structures comprises a seat support portion constructed to contact and support at least part of buttocks of the user; and the first fixed structure is separated from the second fixed structure along the lateral direction by a gap that is sized and shaped to accommodate insertion of both legs of the user therein.

Clause 12. The ergonomic chair of any clause or example herein, in particular, Clause 11, wherein each of the first and second fixed structures comprises:

a first member arranged to support a thigh of the user thereon; and a second member extending from the first member and arranged to support a shank of the user thereon.

Clause 13. The ergonomic chair of any clause or example herein, in particular, any one of Clauses 11-12, wherein each of the first and second fixed structures further comprises a footrest extending from the second member.

Clause 14. The ergonomic chair of any clause or example herein, in particular, any one of Clauses 11-13, wherein the means for arranging and supporting legs of the user further comprises an arcuate or inclined ramp disposed to support a foot of the second leg of the user.

Clause 15. The ergonomic chair of any clause or example herein, in particular, Clause 14, wherein the arcuate or inclined ramp is coupled to the back support member.

Clause 16. The ergonomic chair of any clause or example herein, in particular, any one of Clauses 11-15, further comprising:

a chair support member coupled to the ramp and the back support member, wherein the back support member is rotatably coupled to the chair support member so as to allow rotation of the back support member about a substantially horizontal axis.

Clause 17. The ergonomic chair of any clause or example herein, in particular, Clause 5, wherein:

the means for arranging and supporting legs of the user further comprises first and second seat support portions, each seat support portion being constructed to contact and support at least part of a buttock of the user;

at least an intermediate portion of the first seat support portion is separated from a corresponding intermediate portion of the second seat support portion along the lateral direction by a gap that is sized and shaped to accommodate insertion of the second leg therein; and each of the first and second fixed structures comprises a footrest.

Clause 18. The ergonomic chair of any clause or example herein, in particular, Clause 17, further comprising:

first and second frame members, each frame member being coupled to the back support member, the first frame member being separated from the second frame member along the lateral direction, wherein the first fixed structure and the first seat support portion are coupled to and extend substantially horizontal from the first frame member, and the second fixed structure and the second seat support portion are coupled to and extend substantially horizontal from the second frame member.

Clause 19. The ergonomic chair of any clause or example herein, in particular, any one of Clauses 17-18, wherein each of the first and second seat support portions is constructed to contact and support a least part of a thigh of the user.

Clause 20. The ergonomic chair of any clause or example herein, in particular, any one of Clauses 3-4, wherein, with the legs of the user in the asymmetric configuration, the second leg is in contact with the first fixed structure or the second fixed structure, and the first leg is not in contact with either the first fixed structure or the second fixed structure.

Clause 21. The ergonomic chair of any clause or example herein, in particular, Clause 20, wherein:

each of the first and second fixed structures comprises a knee pad;

the means for arranging and supporting legs of the user further comprises a seat support member constructed to contact and support at least part of a buttock of a user; and the seat support member is coupled to the back support member and the knee pads.

Clause 22. The ergonomic chair of any clause or example herein, in particular, Clause 2, wherein the one or more fixed structures comprises a single fixed structure, the single fixed structure being substantially aligned with a centerline of the back support member along a lateral direction.

Clause 23. The ergonomic chair of any clause or example herein, in particular, Clause 22, wherein the single fixed structure is arranged such that, with the legs of the user in the asymmetric configuration, a centerline of the user is offset from the centerline of the back support member with respect to the lateral direction.

Clause 24. The ergonomic chair of any clause or example herein, in particular, any one of Clauses 22-23, wherein, with the legs of the user in the asymmetric configuration, the first leg is in contact with the single fixed structure, and the second leg is not in contact with the single fixed structure.

Clause 25. The ergonomic chair of any clause or example herein, in particular, Clause 24, wherein:

the means for arranging and supporting legs of the user further comprises a seat support portion constructed to contact and support buttocks of the user;

the single fixed structure extends from a bottom part of the seat support portion; and along a lateral direction, a width of a first portion of the single fixed structure extending from said bottom part is less than a width of the seat support portion supporting the buttocks of the user.

Clause 26. The ergonomic chair of any clause or example herein, in particular, Clause 25, wherein the seat support portion extends along the lateral direction past opposite edges of the first portion of the single fixed structure.

Clause 27. The ergonomic chair of any clause or example herein, in particular, any one of Clauses 25-26, wherein an end portion of the single fixed structure distal from the bottom part of the seat support portion extends along the lateral direction past opposite edges of the first portion of the single fixed structure.

Clause 28. The ergonomic chair of any clause or example herein, in particular, any one of Clauses 24-27, wherein the single fixed structures comprise:

a first member arranged to support a thigh of the user thereon; and a second member extending from the first member and arranged to support a shank of the user thereon.

Clause 29. The ergonomic chair of any clause or example herein, in particular, any one of Clauses 24-28, wherein the means for arranging and supporting legs of the user further comprises a third fixed structure constructed to support the second leg in a second predetermined orientation.

Clause 30. The ergonomic chair of any clause or example herein, in particular, Clause 29, wherein the third fixed structure comprises a footrest.

Clause 31. The ergonomic chair of any clause or example herein, in particular, Clause 24, wherein:

the means for arranging and supporting legs of the user further comprises first and second outer leg support structures, each outer leg support structure being constructed to support the second leg in a second predetermined orientation;

the single fixed structure comprises a seat support portion constructed to contact and support at least part of buttocks of the user;

the single fixed structure extends from a central bottom part of the back support member; each of the first and second outer leg support structures extends from a respective outer bottom part of the back support member; and along a lateral direction, the single fixed structure is disposed between the first and second outer leg support structures.

Clause 32. The ergonomic chair of any clause or example herein, in particular, Clause 31, wherein each of the first and second outer leg support structures comprises a footrest.

Clause 33. The ergonomic chair of any clause or example herein, in particular, any one of Clauses 31-32, wherein a width of the seat support portion along the lateral direction is at least 50% and less than 100% of a maximum width of the back support member along the lateral direction.

Clause 34. The ergonomic chair of any clause or example herein, in particular, any one of Clauses 31-33, wherein the single fixed structures comprise:

a first member arranged to support a thigh of the user thereon; and a second member extending from the first member and arranged to support a shank of the user thereon.

Clause 35. The ergonomic chair of any clause or example herein, in particular, any one of Clauses 31-34, wherein the single fixed structure further comprises a footrest.

Clause 36. The ergonomic chair of any clause or example herein, in particular, Clause 35, wherein the footrest is a single member shared by the first and second outer leg support structures.

Clause 37. The ergonomic chair of any clause or example herein, in particular, Clause 24, wherein:

the means for arranging and supporting legs of the user further comprises a seat support portion constructed to contact and support at least part of buttocks of the user, the seat support portion being coupled to and extending from the back support member; and the single fixed structure comprises a footrest coupled to the seat support portion.

Clause 38. The ergonomic chair of any clause or example herein, in particular, any one of Clauses 22-23, wherein, with the legs of the user in the asymmetric configuration, the second leg is in contact with the single fixed structure, and the first leg is not in contact with the single fixed structure.

Clause 39. The ergonomic chair of any clause or example herein, in particular, Clause 38, wherein:

the single fixed structure comprises a knee pad;

the means for arranging and supporting legs of the user further comprises a pair of seat support members, each seat support member being constructed to contact and support at least part of a buttock of a user; and each seat support member is coupled to the back support member; and one of the pair of seat support members is disposed on a side of the back support member opposite from the other of the pair of eat support members with respect to a lateral direction.

Clause 40. The ergonomic chair of any clause or example herein, in particular, Clause 39, wherein the seat support members are separated from each other along the lateral direction by a gap that is sized and shaped to accommodate insertion of the second leg therein.

Clause 41. The ergonomic chair of any clause or example herein, in particular, Clause 38, wherein the means for arranging and supporting legs of the user comprises a multi-faceted seating structure, facets of the seating structure defining respective surfaces for supporting parts of the user, the seating structure being reflection symmetric with respect to a lateral centerline of the seating structure, each reflection half of the seating structure comprising:

a first surface portion constructed to contact and support at least part of a buttock of the user; and a second surface portion disposed laterally outward of and extending from the first surface portion, the second surface portion being constructed to contact and support at least part of the second leg.

Clause 42. The ergonomic chair of any clause or example herein, in particular, Clause 41, wherein:

each reflection half of the seating structure further comprises a third surface portion disposed rearward of and extending from the second surface portion;

the second surface portion is arranged to contact a thigh of the second leg; and the third surface portion is arranged to contact a shank of the second leg.

Clause 43. The ergonomic chair of any clause or example herein, in particular, any one of Clauses 41-42, further comprising a multi-faceted footrest coupled to or disposed separate from the multi-faceted seating structure.

Clause 44. The ergonomic chair of any clause or example herein, in particular, Clause 1, wherein the means for arranging and supporting legs of the user comprises one or more dynamic structures constructed to be positioned by the user to support the first leg in a first orientation.

Clause 45. The ergonomic chair of any clause or example herein, in particular, Clause 44, wherein the one or more dynamic structures comprises first and second dynamic structures, the first dynamic structure being disposed on a side of a centerline of the back support member opposite from the second dynamic structure with respect to a lateral direction.

Clause 46. The ergonomic chair of any clause or example herein, in particular, Clause 45, wherein each of the first and second dynamic structures comprises a seat support portion constructed to contact and support at least part of buttocks of the user.

Clause 47. The ergonomic chair of any clause or example herein, in particular, Clause 46, wherein, with the legs of the user in the asymmetric configuration, the first leg is in contact with the first dynamic structure, and the second leg is in contact with the second dynamic structure.

Clause 48. The ergonomic chair of any clause or example herein, in particular, any one of Clauses 46-47, wherein the first and second dynamic structures are arranged such that, with the legs of the user in the asymmetric configuration, a centerline of the user is substantially collinear with, or at least intersecting with, a centerline of the back support member with respect to the lateral direction.

Clause 49. The ergonomic chair of any clause or example herein, in particular, any one of Clauses 46-48, wherein each seat support portion is constructed to be moveable from a first position contacting and supporting at least part of a corresponding buttock of the user and a second position that does not support the corresponding buttock of the user.

Clause 50. The ergonomic chair of any clause or example herein, in particular, Clause 49, wherein, in the first position, the seat support portion is constructed to contact and support a least part of a thigh of the user.

Clause 51. The ergonomic chair of any clause or example herein, in particular, any one of Clauses 49-50, wherein the means for arranging and supporting legs of the user further comprises at least one footrest.

Clause 52. The ergonomic chair of any clause or example herein, in particular, any one of Clauses 49-51, further comprising one or more frame members, each frame member being coupled to the back support member.

Clause 53. The ergonomic chair of any clause or example herein, in particular, Clause 52, wherein:

each seat support portion is movably coupled to and, in the first position, extend substantially horizontal from the one or more frame members or the back support member; and the at least one footrest is coupled to and extends substantially horizontal from the one or more frame members so as to support the first leg.

Clause 54. The ergonomic chair of any clause or example herein, in particular, Clause 45, wherein:

each of the first and second dynamic structures comprises a seat support portion constructed to contact and support at least part of buttocks of the user; and the first dynamic structure is separated from the second dynamic structure along the lateral direction by a gap that is sized and shaped to accommodate insertion of both legs of the user therein.

Clause 55. The ergonomic chair of any clause or example herein, in particular, Clause 54, wherein, with the legs of the user in the asymmetric configuration, the first leg is in contact with the first dynamic structure or the second dynamic structure, and the second leg is not in contact with either the first dynamic structure or the second dynamic structure.

Clause 56. The ergonomic chair of any clause or example herein, in particular, any one of Clauses 54-55, wherein the first and second dynamic structures are arranged such that, with the legs of the user in the asymmetric configuration, a centerline of the user is offset from a centerline of the back support member with respect to the lateral direction.

Clause 57. The ergonomic chair of any clause or example herein, in particular, any one of Clauses 54-56, wherein the means for arranging and supporting legs of the user further comprises an arcuate or inclined ramp disposed to support a foot of the second leg of the user. Clause 58. The ergonomic chair of any clause or example herein, in particular, Clause 57, wherein the arcuate or inclined ramp is coupled to the back support member.

Clause 59. The ergonomic chair of any clause or example herein, in particular, any one of Clauses 57-58, further comprising a chair support member coupled to the ramp and the back support member, wherein back support member is rotatably coupled to the chair support member so as to allow rotation of the back support member about a substantially horizontal axis.

Clause 60. The ergonomic chair of any clause or example herein, in particular, Clause 45, wherein each of the first and second dynamic structures comprises:

a first member rotatably coupled to the back support member and arranged to support a thigh of the user thereon; and a second member rotatably coupled to and extending from the first member, the second member being arranged to support a shank of the user thereon.

Clause 61. The ergonomic chair of any clause or example herein, in particular, Clause 60, wherein each of the first and second dynamic structures further comprises a footrest rotatably coupled to and extending from the second member.

Clause 62. The ergonomic chair of any clause or example herein, in particular, Clause 45, wherein each of the first and second dynamic structures are movably coupled to the back support member so as to displace between a first laterally-outward position away from the user to a second laterally-inward position that supports the first leg in the first orientation.

Clause 63. The ergonomic chair of any clause or example herein, in particular, Clause 62, wherein each of the first and second dynamic structures are rotatably coupled to the back support member so as to swing between the first laterally-outward position and the second laterally-inward position.

Clause 64. The ergonomic chair of any clause or example herein, in particular, any one of Clauses 62-63, wherein the means for arranging and supporting legs of the user further comprises an arcuate or inclined ramp disposed to support a foot of the second leg of the user.

Clause 65. The ergonomic chair of any clause or example herein, in particular, Clause 64, wherein the arcuate or inclined ramp is coupled to the back support member.

Clause 66. The ergonomic chair of any clause or example herein, in particular, any one of Clauses 62-65, wherein each of the first and second dynamic structures comprises:

a first member arranged to support a thigh of the user thereon; and a second member extending from the first member and arranged to support a shank of the user thereon.

Clause 67. The ergonomic chair of any clause or example herein, in particular, Clause 45, wherein the one or more dynamic structures comprises a single dynamic structure being movably coupled to the back support member so as to displace between a first laterally-outward position distal from a centerline of the back support member along a lateral direction and a second laterally-inward position proximal to the centerline that supports the first leg in the first orientation.

Clause 68. The ergonomic chair of any clause or example herein, in particular, Clause 67, wherein the means for arranging and supporting legs of the user further comprises an arcuate or inclined ramp disposed to support a foot of the second leg of the user.

Clause 69. The ergonomic chair of any clause or example herein, in particular, Clause 68, wherein the arcuate or inclined ramp is coupled to the back support member.

Clause 70. The ergonomic chair of any clause or example herein, in particular, any one of Clauses 67-69, wherein the single dynamic structure comprises:

a first member arranged to support a thigh of the user thereon; and a second member extending from the first member and arranged to support a shank of the user thereon.

Clause 71. The ergonomic chair of any clause or example herein, in particular, any one of Clauses 1-70, wherein the back support member is disposed at a non-zero angle with respect to a direction of gravity.

Clause 72. The ergonomic chair of any clause or example herein, in particular, any one of Clauses 2-71, wherein the first predetermined orientation comprises a bend at a knee of the first leg.

Clause 73. The ergonomic chair of any clause or example herein, in particular, any one of Clauses 29-72, wherein the second leg in the second predetermined orientation is substantially straight.

Clause 74. The ergonomic chair of any clause or example herein, in particular, any one of Clauses 1-73, wherein the back support member comprises a contoured cushion.

Clause 75. The ergonomic chair of any clause or example herein, in particular, any one of Clauses 1-74, further comprising:

a desk surface disposed in front of the body of the user; and/or a monitor support arm constructed to support a monitor in front of a face of the user.

Clause 76. The ergonomic chair of any clause or example herein, in particular, any one of Clauses 1-75, wherein the angle between the first and second legs is effective to stretch a hip flexor of the user.

Clause 77. An ergonomic chair comprising:

a back support;

a first configurable body support connected to the back support and configurable to support one buttock and thigh or one foot; and a second configurable body support connected to the back support and configurable to support one buttock and thigh or one foot, wherein the first and second configurable body supports are independently movable such that a user may selectively be supported at once by one buttock and thigh and an opposite foot.

Clause 78. An ergonomic chair comprising:

a back support;

a first body support connected to the back support to support a first foot of a user; and a second body support connected to the back support to support a second foot of the user, wherein the first and second body supports permit a hip flexion angle difference of at least 30 degrees.

Clause 79. The ergonomic chair of any clause or example herein, in particular, Clause 78, wherein the first and second body supports permit a hip flexion angle difference of at least 45 degrees.

Clause 80. The ergonomic chair of any clause or example herein, in particular, any one of Clauses 78-79, wherein the first and second body supports permit a hip flexion angle difference of at least 60 degrees.

Clause 81. The ergonomic chair of any clause or example herein, in particular, any one of Clauses 78-80, wherein the first and second body supports permit a hip flexion angle difference of at least 75 degrees.

Clause 82. The ergonomic chair of any clause or example herein, in particular, any one of Clauses 78-81, wherein the first and second body supports permit a hip flexion angle difference of at least 90 degrees.

Clause 83. The ergonomic chair of any clause or example herein, in particular, any one of Clauses 78-82, further comprising at least one third body support connected to the back support to support a buttock and thigh of a user.

Clause 84. The ergonomic chair of any clause or example herein, in particular, any one of Clauses 78-83, wherein the at least one third body support is positioned and shaped to be used in combination with either of the first and second body supports to permit the buttock on one side of the user and the foot on an opposite side of the user to support the body of the user.

Clause 85. The ergonomic chair of any clause or example herein, in particular, any one of Clauses 77-84, wherein the back support is between 0 and 45 degrees with respect to a direction of gravity.

Clause 86. The ergonomic chair of any clause or example herein, in particular, any one of Clauses 77-85, further comprising a support for a laptop or keyboard positioned in alignment with the elbows of the user.

Clause 87. An ergonomic chair comprising:

a seat sized and positioned in a frame to support a left or right buttock of a user; and a leg support sized and positioned in said frame to support a foot or knee of the user on a side opposite said left or right buttock, wherein positions of the seat and leg support being such that the opposing thighs can have different angles of flexion relative to a hip of the user.

Clause 88. The ergonomic chair of any clause or example herein, in particular, Clause 87, wherein an angle formed between the opposing thighs is at least 45 degrees.

Clause 89. The ergonomic chair of any clause or example herein, in particular, any one of Clauses 87-88, wherein said seat and leg supports are positioned and angled such that both provide partial support for a body of the user against force of gravity.

Clause 90. The ergonomic chair of any clause or example herein, in particular, any one of Clauses 87-89, wherein said seat and leg support are movable to different configurations relative to said frame, such that the seat can support the other of said left or right buttock and the leg support can support the foot or knee on a side opposite said other of said left or right buttock.

Clause 91. The ergonomic chair of any clause or example herein, in particular, Clause 90, wherein said seat and leg supports are configured to be locked in the different configurations.

Clause 92. The ergonomic chair of any clause or example herein, in particular, any one of Clauses 87-91, wherein said angles of flexion are variable.

Clause 93. The ergonomic chair of any clause or example herein, in particular, any one of Clauses 87-92, wherein said seat supports the thigh as well as said left or right buttock.

Clause 94. The ergonomic chair of any clause or example herein, in particular, any one of Clauses 87-93, wherein the leg support is sized and positioned in said frame to support the foot by the sole thereof as in an at least partial standing position or the knee as in an at least partial kneeling position.

Clause 95. The ergonomic chair of any clause or example herein, in particular, any one of Clauses 87-92, wherein the angles of flexion are such that a thigh supported by the leg support is fully extended.

Clause 96. The ergonomic chair of any clause or example herein, in particular, any one of Clauses 87-95, wherein said frame has a back support configured to support the back in various angles of inclination.

Clause 97. The ergonomic chair of any clause or example herein, in particular, any one of Clauses 87-96, further comprising at least one calf support connected to said frame and positioned to support at least one calf of the user.

Clause 98. The ergonomic chair of any clause or example herein, in particular, any one of Clauses 87-97, further comprising a support for a laptop or keyboard positioned in alignment with elbows of the user.

Conclusion

Any of the features illustrated or described with respect to Clauses 1-98 and/or FIGS. 1B-13D can be combined with any other features illustrated or described with respect to Clause 1-98 and/or FIGS. 1B-13D to provide systems, methods, devices, and embodiments not otherwise illustrated or specifically described herein. For example, desk surface 226 of FIG. 2B, desk surface 434 of FIG. 4B, desk surface 868 of FIG. 8E, desk surface 922 of FIG. 9A, desk surface 1026 of FIG. 10A, or desk surface 1118 of FIG. 11B can be provided in the ergonomic chair of any of FIGS. 1B-13D or Clauses 1-98. Alternatively or additionally, monitor support frame 438 (with or without monitor 440) of FIG. 4B, monitor support frame 918 (with or without monitor 920) of FIG. 9A, and/or monitor support frame 1126 (with or without monitor 1128) of FIG. 11B can be provided in the ergonomic chair of any of FIGS. 1B-13D or Clauses 1-98. Other combinations and variations are also possible according to one or more contemplated embodiments. Indeed, all features described herein are independent of one another and, except where structurally impossible, can be used in combination with any other feature described herein.

Any of the ergonomic chairs described herein can be constructed to be substantially portable, for example, to be manually transported by a user between different locations (e.g., between a work office and a home office). In some embodiments, each ergonomic chair, or at least some structural components thereof, can be formed of light-weight materials (e.g., wood, carbon fiber, aluminum, etc.). Alternatively or additionally, in some embodiments, each ergonomic chair, or at least some structural components thereof, can be constructed to fold or collapse to a reduced size or volume that can be hand-carried by a user, for example, by allowed leg support structures to fold into back support members to provide a more planar profile for carrying.

In view of the many possible embodiments to which the principles of the disclosed technology may be applied, it should be recognized that the illustrated embodiments are only preferred examples and should not be taken as limiting the scope of the disclosed technology. Rather, the scope is defined by the following claims. We therefore claim all that comes within the scope and spirit of these claims.

The invention claimed is:

1. An ergonomic chair comprising:

a back support member constructed to contact at least a portion of a back of a user; and means for arranging and supporting legs of the user in an asymmetric configuration, the asymmetric configuration comprising (i) a first leg extending in front of a body of the user and (ii) a second leg aligned with or extending behind the body of the user, an angle between the first and second legs in a side view being at least 30 degrees, wherein the means for arranging and supporting legs of the user comprises one or more fixed structures constructed to support the first leg in a first predetermined orientation, the one or more fixed structures comprises first and second fixed structures, the first fixed structure being disposed on a side of the back support member opposite from the second fixed structure with respect to a lateral direction, the first and second fixed structures are arranged such that, with the legs of the user in the asymmetric configuration, a centerline of the user is offset from a centerline of the back support member with respect to the lateral direction, and with the legs of the user in the asymmetric configuration, the second leg is in contact with the first fixed structure or the second fixed structure, and the first leg is not in contact with either the first fixed structure or the second fixed structure.

2. The ergonomic chair of claim 1, wherein:

each of the first and second fixed structures comprises a knee pad;

the means for arranging and supporting legs of the user further comprises a seat support member constructed to contact and support at least part of a buttock of a user; and the seat support member is coupled to the back support member and the knee pads.

3. An ergonomic chair comprising:

a back support member constructed to contact at least a portion of a back of a user; and means for arranging and supporting legs of the user in an asymmetric configuration, the asymmetric configuration comprising (i) a first leg extending in front of a body of the user and (ii) a second leg aligned with or extending behind the body of the user, an angle between the first and second legs in a side view being at least 30 degrees, wherein the means for arranging and supporting legs of the user comprises one or more fixed structures constructed to support the first leg in a first predetermined orientation, the one or more fixed structures comprises first and second fixed structures, the first fixed structure being disposed on a side of the back support member opposite from the second fixed structure with respect to a lateral direction, the one or more fixed structures comprises a single fixed structure, the single fixed structure being substantially aligned with a centerline of the back support member along a lateral direction, and the single fixed structure is arranged such that, with the legs of the user in the asymmetric configuration, a centerline of the user is offset from the centerline of the back support member with respect to the lateral direction.

4. An ergonomic chair comprising:

a back support member constructed to contact at least a portion of a back of a user; and means for arranging and supporting legs of the user in an asymmetric configuration, the asymmetric configuration comprising (i) a first leg extending in front of a body of the user and (ii) a second leg aligned with or extending behind the body of the user, an angle between the first and second legs in a side view being at least 30 degrees, wherein the means for arranging and supporting legs of the user comprises one or more fixed structures constructed to support the first leg in a first predetermined orientation, the one or more fixed structures comprises first and second fixed structures, the first fixed structure being disposed on a side of the back support member opposite from the second fixed structure with respect to a lateral direction, the one or more fixed structures comprises a single fixed structure, the single fixed structure being substantially aligned with a centerline of the back support member along a lateral direction, and with the legs of the user in the asymmetric configuration, the first leg is in contact with the single fixed structure, and the second leg is not in contact with the single fixed structure.

5. The ergonomic chair of claim 4, wherein:

the means for arranging and supporting legs of the user further comprises a seat support portion constructed to contact and support buttocks of the user;

the single fixed structure extends from a bottom part of the seat support portion; and along a lateral direction, a width of a first portion of the single fixed structure extending from said bottom part is less than a width of the seat support portion supporting the buttocks of the user.

6. The ergonomic chair of claim 4, wherein the single fixed structure comprises:

a first member arranged to support a thigh of the user thereon; and a second member extending from the first member and arranged to support a shank of the user thereon.

7. The ergonomic chair of claim 4, wherein the means for arranging and supporting legs of the user further comprises a third fixed structure constructed to support the second leg in a second predetermined orientation.

8. The ergonomic chair of claim 7, wherein the third fixed structure comprises a footrest.

9. The ergonomic chair of claim 4, wherein:

the means for arranging and supporting legs of the user further comprises first and second outer leg support structures, each outer leg support structure being constructed to support the second leg in a second predetermined orientation;

the single fixed structure comprises a seat support portion constructed to contact and support at least part of buttocks of the user;

the single fixed structure extends from a central bottom part of the back support member each of the first and second outer leg support structures extends from a respective outer bottom part of the back support member; and along a lateral direction, the single fixed structure is disposed between the first and second outer leg support structures.

10. The ergonomic chair of claim 9, wherein the single fixed structure further comprises a footrest, and the footrest is a single member shared by the first and second outer leg support structures.

* * * * *